US009583037B2

(12) United States Patent
Omoto

(10) Patent No.: US 9,583,037 B2
(45) Date of Patent: Feb. 28, 2017

(54) DISPLAY UNIT AND ELECTRONIC APPARATUS

(71) Applicant: JOLED Inc., Tokyo (JP)

(72) Inventor: Keisuke Omoto, Kanagawa (JP)

(73) Assignee: JOLED Inc., Tokyo (JP)

( * ) Notice: Subject to any disclaimer, the term of this patent is extended or adjusted under 35 U.S.C. 154(b) by 545 days.

(21) Appl. No.: 13/678,700

(22) Filed: Nov. 16, 2012

(65) Prior Publication Data

US 2013/0147858 A1 Jun. 13, 2013

(30) Foreign Application Priority Data

Dec. 8, 2011 (JP) ..... 2011-268685

(51) Int. Cl.
*G09G 1/00* (2006.01)
*G09G 3/30* (2006.01)
*G09G 3/32* (2016.01)

(52) U.S. Cl.
CPC ..... *G09G 3/30* (2013.01); *G09G 3/3233* (2013.01); *G09G 2300/0452* (2013.01); *G09G 2320/0295* (2013.01); *G09G 2330/10* (2013.01); *G09G 2330/12* (2013.01)

(58) Field of Classification Search
CPC .... G09G 2330/10; G09G 3/30; G09G 3/3225; G09G 2330/08; G09G 2320/0233; G09G 2330/01
USPC ..... 345/629, 690
See application file for complete search history.

(56) References Cited

U.S. PATENT DOCUMENTS 6,583,774 B1 * 6/2003 Yoshida ..... G09G 3/2092 345/214
2005/0270444 A1 * 12/2005 Miller et al. ..... 349/108
2006/0164407 A1 * 7/2006 Cok ..... 345/204
2006/0268003 A1 11/2006 Tanase et al.
2007/0109327 A1 * 5/2007 Cok ..... G09G 3/2003 345/690
2008/0029714 A1 * 2/2008 Olsen ..... G02B 7/04 250/475.2
2008/0117231 A1 * 5/2008 Kimpe ..... G09G 3/20 345/629

FOREIGN PATENT DOCUMENTS

JP 2006-330237 A 12/2006
JP 2007-041574 A 2/2007

OTHER PUBLICATIONS

Japanese Office Action issued Oct. 6, 2015 for corresponding Japanese Application No. 2011-268685.

* cited by examiner

*Primary Examiner* — Michael Faragalla
(74) *Attorney, Agent, or Firm* — Michael Best & Friedrich LLP

(57) ABSTRACT

A display unit includes: a display panel including, for each pixel, four or more types of sub-pixels that are different from one another in luminescent colors; and a driving circuit applying a pulse based on an image signal to each of the sub-pixels, and applying, when the sub-pixels include a sub-pixel of a defect dot, a compensated pulse configured to correct the defect dot to the sub-pixels that are adjacent or close to the sub-pixel of the defect dot.

16 Claims, 52 Drawing Sheets

| | SUB-PIXEL TYPES | DISPLAY COLORS | LUMINESCENT SUB-PIXELS | NONLUMINESCENT SUB-PIXELS | SUB-PIXELS TO BE CORRECTED |
|---|---|---|---|---|---|
| EXAMPLE 1 | R, G, B, W | R | R | R | W |
| EXAMPLE 2 | R, G, B, W | G | G | G | W |
| EXAMPLE 3 | R, G, B, W | B | B | B | W |
| EXAMPLE 4 | R, G, B, W | W | W | W | R, G, B |
| EXAMPLE 5 | R, G, B, Y | R | R | R | Y |
| EXAMPLE 6 | R, G, B, Y | G | G | G | Y |
| EXAMPLE 7 | R, G, B, Y | B | B | B | Y |
| EXAMPLE 8 | R, G, B, Y | W | B, Y | Y | R, G |

FIG. 48

DISPLAY UNIT AND ELECTRONIC APPARATUS

BACKGROUND

The present disclosure relates to a display unit and an electronic apparatus that include a nonluminescent spot (defect dot) correction capability thereon.

In recent years, in the field of a display unit for performing an image display, a display unit using a current drive type optical device the luminescence of which varies depending on a value of a flowing current, such as an organic EL device as a pixel light-emitting device has been developed and the commercialization thereof has been advanced (for example, see Japanese Unexamined Patent Application Publication No. 2007-41574). Unlike a liquid crystal device and the like, an organic EL device is a self-emitting device. Therefore, a display unit using an organic EL device (organic EL display unit) eliminates the necessity of providing a light source (backlight), achieving higher image visibility, lower power consumption, and higher device response speed as compared with a liquid crystal display unit involving a light source.

As with a liquid crystal display unit, an organic EL display unit has a simple (passive) matrix method and an active matrix method as a drive method thereof. The former is disadvantageous in that it is difficult to achieve a large-sized and high-definition display unit in spite of a simple structure. Consequently, at present, an organic EL display unit that employs the active matrix method has been actively developed. This method controls a current flowing through a light-emitting device arranged for each pixel using an active device (typically a TFT (Thin-Film Transistor)) that is provided within a driving circuit prepared for each light-emitting device.

Meanwhile, an organic EL device has a structure that holds an organic film including a light-emitting layer between an anode electrode and a cathode electrode. In an organic EL display unit using an organic EL device with such a structure as a pixel light-emitting device, introduction of any foreign material in a process of forming the organic EL device causes a pixel luminance defect. In concrete terms, any foreign material introduced in a manufacturing process may cause an inter-electrode short-circuiting between an anode electrode and a cathode electrode on the organic EL device. In the event of such an inter-electrode short-circuiting on an organic EL device, the organic EL device is unable to perform any light-emitting operation, which causes a luminance defect that is referred to as a so-called nonluminescent spot (hereinafter called a defect dot) wherein a sub-pixel including such organic EL device is visible as a nonluminescent pixel.

As measures against such a luminance defect caused by introduction of any foreign material, a technique for providing plural sets of pixel configuration devices including an organic EL device within a single sub-pixel is proposed in the past (for example, see Japanese Unexamined Patent Application Publication No. 2007-41574). Even in the event of a defect in an organic EL device included in any set due to an inter-electrode short-circuiting and the like, use of this technique makes it possible to prevent a defect dot from occurring in a sub-pixel because pixel configuration devices included in any other sets operate normally.

SUMMARY

However, the above-described measures complicate a pixel circuit. Accordingly, it is presumable to enhance the luminescence of sub-pixels around a defect dot instead of modifying a pixel circuit. For example, when one sub-pixel emitting red-color light becomes nonluminescent in a display panel of RGB stripe arrangement, if a white display is performed, a viewer sees an emerald green defect dot at a location corresponding to a nonluminescent sub-pixel. At this time, even though the luminescence of a plurality of sub-pixels surrounding a defect dot is enhanced, it is likely that the white luminance around a defect dot is only enhanced, and a defect dot may be highly visible as an opposite effect. Therefore, it does not become the measures against a defect dot to simply enhance only the luminescence of sub-pixels surrounding a defect dot.

It is desirable to provide a display unit and an electronic apparatus that allow a defect dot correction to be performed without complicating a pixel circuit.

A display unit according to an embodiment of the present disclosure includes: a display panel including, for each pixel, four or more types of sub-pixels that are different from one another in luminescent colors; and a driving circuit applying a pulse based on an image signal to each of the sub-pixels, and applying, when the sub-pixels include a sub-pixel of a defect dot, a compensated pulse configured to correct the defect dot to the sub-pixels that are adjacent or close to the sub-pixel of the defect dot.

An electronic apparatus according to an embodiment of the present disclosure is provided with a display unit. The display unit includes: a display panel including, for each pixel, four or more types of sub-pixels that are different from one another in luminescent colors; and a driving circuit applying a pulse based on an image signal to each of the sub-pixels, and applying, when the sub-pixels include a sub-pixel of a defect dot, a compensated pulse configured to correct the defect dot to the sub-pixels that are adjacent or close to the sub-pixel of the defect dot.

In the display unit and the electronic apparatus according to the above-described respective embodiments of the present disclosure, four or more types of sub-pixels different from one another in luminescent colors are provided for each pixel. Upon presence of the sub-pixel of the defect dot, the compensated pulse that corrects the defect dot is applied to the plurality of sub-pixels that are adjacent or close to that sub-pixel, allowing the defect dot to be made less visible. That is, the above-described respective embodiments of the present disclosure eliminate the necessity of modifying a pixel circuit, and avoid a disadvantage that a luminance around a defect dot is only modulated to make the defect dot highly visible as an opposite effect.

In the display unit and the electronic apparatus according to the above-described respective embodiments of the present disclosure, four or more types of sub-pixels that are different from one another in luminescent colors are provided for each of the pixels, and the compensated pulse that corrects the defect dot is applied to the plurality of sub-pixels that are adjacent or close to the sub-pixel of the defect dot. Hence, it is possible to perform a defect dot correction without complicating a pixel circuit.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the present disclosure, and are incorporated in and constitute a part of this specification.

The drawings illustrate embodiments and, together with the specification, serve to explain the principles of the present technology.

FIG. 48 is a diagram summarizing the above-described defect dot corrections according to the respective embodiments and the modifications.

FIG. 51A is a perspective view showing an external appearance of an application example 2 that is viewed from the front side thereof, while

DETAILED DESCRIPTION

Hereinafter, some embodiments of the present disclosure are described in details with reference to the drawings. It is to be noted that the descriptions are provided in the order given below.

1. First Embodiment
Example where each pixel arranged in a tiled array is composed of RGBW sub-pixels.
2. Second Embodiment
Example where each pixel arranged in a tiled array is composed of RGBY sub-pixels.
3. Modification Examples
Example where a pixel array is in a stripe arrangement or a delta arrangement.
4. Module and Application Examples

1. First Embodiment

[Configuration]

Figure 1:
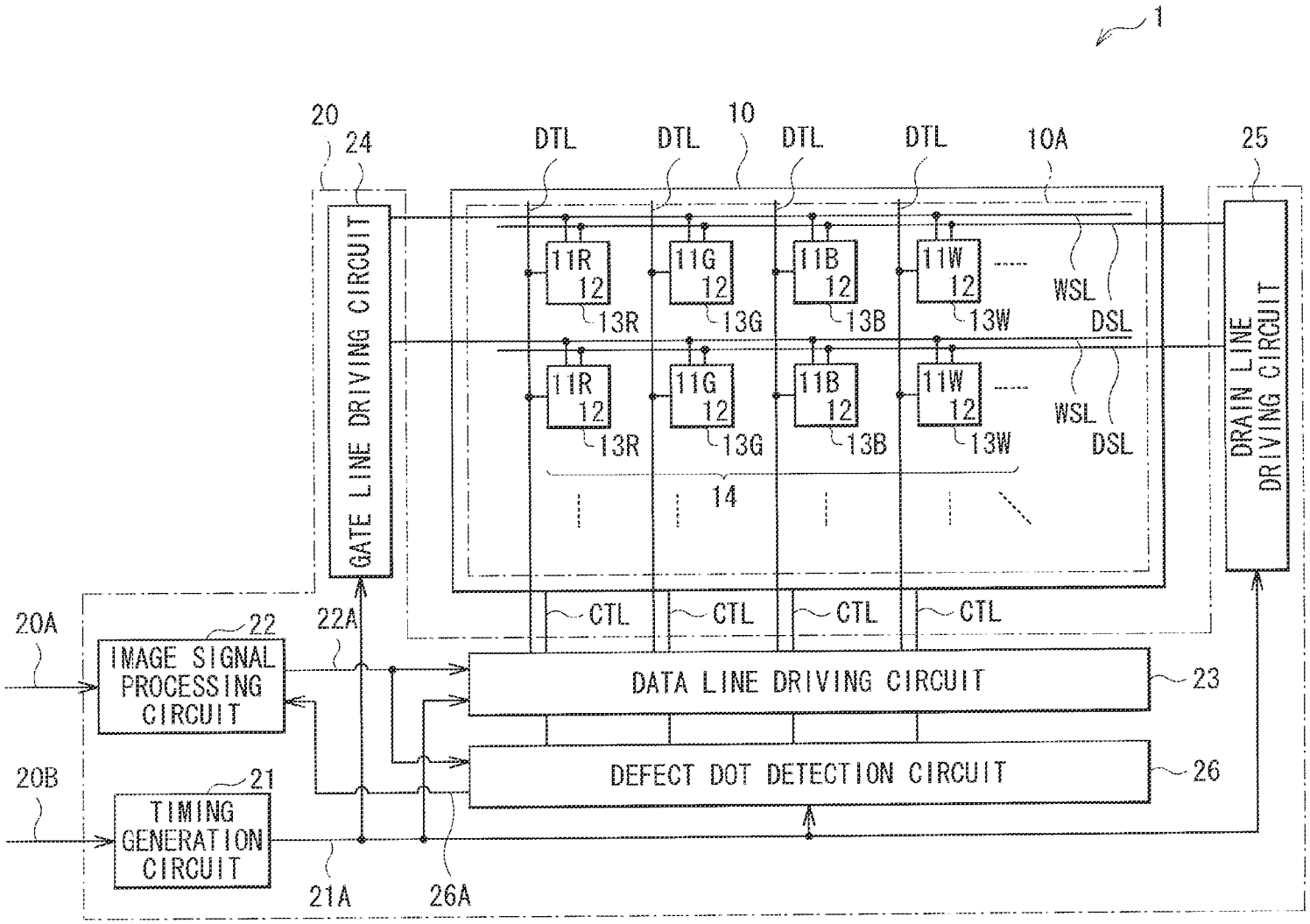
FIG. 1 is a schematic block diagram of a display unit according to a first embodiment of the present disclosure.

FIG. 1 shows an example of an overall configuration for a display unit 1 according to a first embodiment of the present disclosure. The display unit 1 includes a display panel 10, and a driving circuit 20 to drive the display panel 10.

(Display Panel 10)

The display panel 10 has a display region 10A where a plurality of display pixels 14 are arranged two-dimensionally in a row direction and a column direction. The display panel 10 displays an image based on an image signal 20A that is input externally through an active matrix driving of each of the display pixels 14. Each of the display pixels 14 is composed of four types of sub-pixels different from one another in luminescent colors. As four types of sub-pixels, each of the display pixels 14 has three sub-pixels 13R, 13G, and 13B (first sub-pixels) that emit light of three primary colors individually, as well as a sub-pixel 13W (second sub-pixel) that emits color light obtained by additive color mixing. The sub-pixel 13R is a sub-pixel emitting red light that is one of the light of three primary colors, and the sub-pixel 13G is a sub-pixel emitting green light that is one of the light of three primary colors, while the sub-pixel 13B is a sub-pixel emitting blue light that is one of the light of three primary colors. The sub-pixel 13W is a sub-pixel emitting white light that is obtained by additive color mixing of every light of three primary colors. It is to be noted that the sub-pixels 13R, 13G, 13B, and 13W are hereinafter collectively referred to as a sub-pixel 13.

Figure 2:
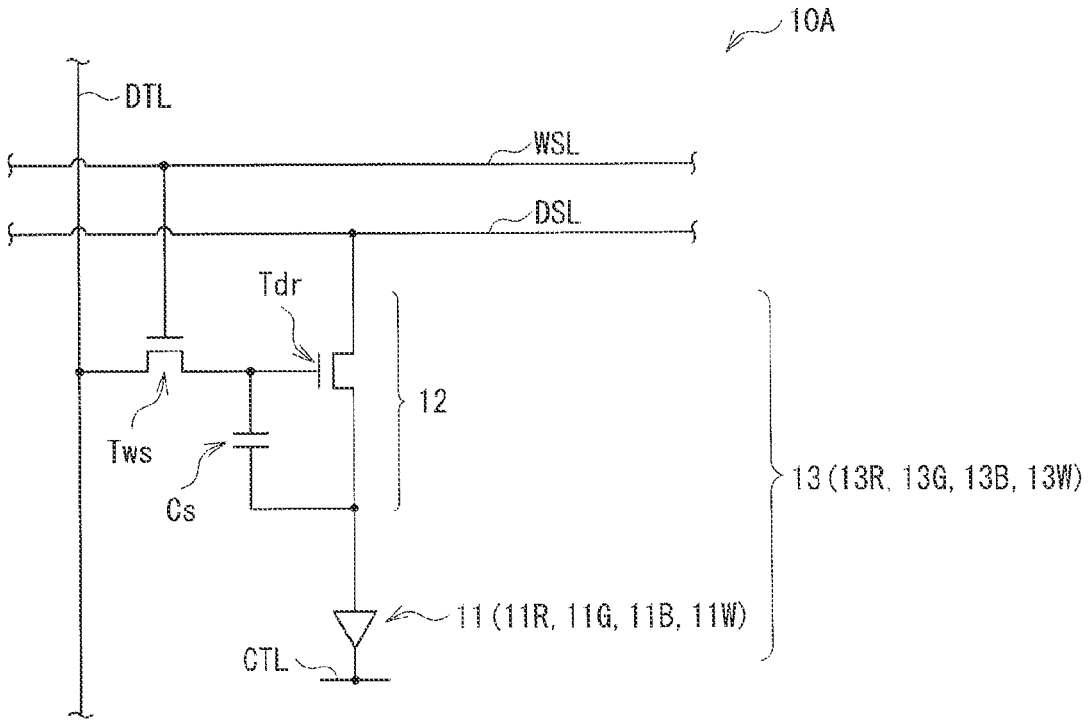
FIG. 2 is a circuit diagram of a sub-pixel illustrated in FIG. 1.

FIG. 2 shows an example of a circuit configuration for the sub-pixel 13. The sub-pixel 13 has an organic EL device 11 and a pixel circuit 12 to drive the organic EL device 11. The sub-pixel 13R has an organic EL device 11R that emits red light as the organic EL device 11. The sub-pixel 13G has an organic EL device 11G that emits green light as the organic EL device 11. The sub-pixel 13B has an organic EL device 11B that emits blue light as the organic EL device 11. The sub-pixel 13W has an organic EL device 11W that emits white light as the organic EL device 11. The pixel circuit 12 includes, for example, a writing transistor Tws, a driving transistor Tdr, and a holding capacitor Cs, employing a circuit configuration of 2 Tr 1 C. It is to be noted that the pixel circuit 12 is not limited to the circuit configuration of 2 Tr 1 C, but may have a circuit configuration in which a transistor and a capacitor other than those described above are used.

The writing transistor Tws is a transistor that writes a voltage corresponding to the image signal 20A into the holding capacitor Cs. The driving transistor Tdr is a transistor to drive the organic EL device 11 on the basis of a voltage on the holding capacitor Cs that is written by the writing transistor Tws. Each of the transistors Tws and Tdr is composed of, for example, an n-channel MOS type thin-film transistor (TFT). Alternatively, each of the transistors Tws and Tdr may be composed of a p-channel MOS type TFT.

The display panel 10 also has a plurality of gate lines WSL extending in a row direction, a plurality of drain lines DSL extending in a row direction, a plurality of data lines DTL extending in a column direction, and cathode lines CTL. Each of the gate lines WSL is connected with a gate on the writing transistor Tws. Each of the drain lines DSL is connected with a drain on the driving transistor Tdr. Each of the data lines DTL is connected with a drain on the writing transistor Tws. A source on the writing transistor Tws is connected with a gate on the driving transistor Tdr and a first end on the holding capacitor Cs. A source on the driving transistor Tdr and a second end on the holding capacitor Cs are connected with an anode on the organic EL device 11. A cathode on the organic EL device 11 is connected with the cathode line CTL.

Figure 3:
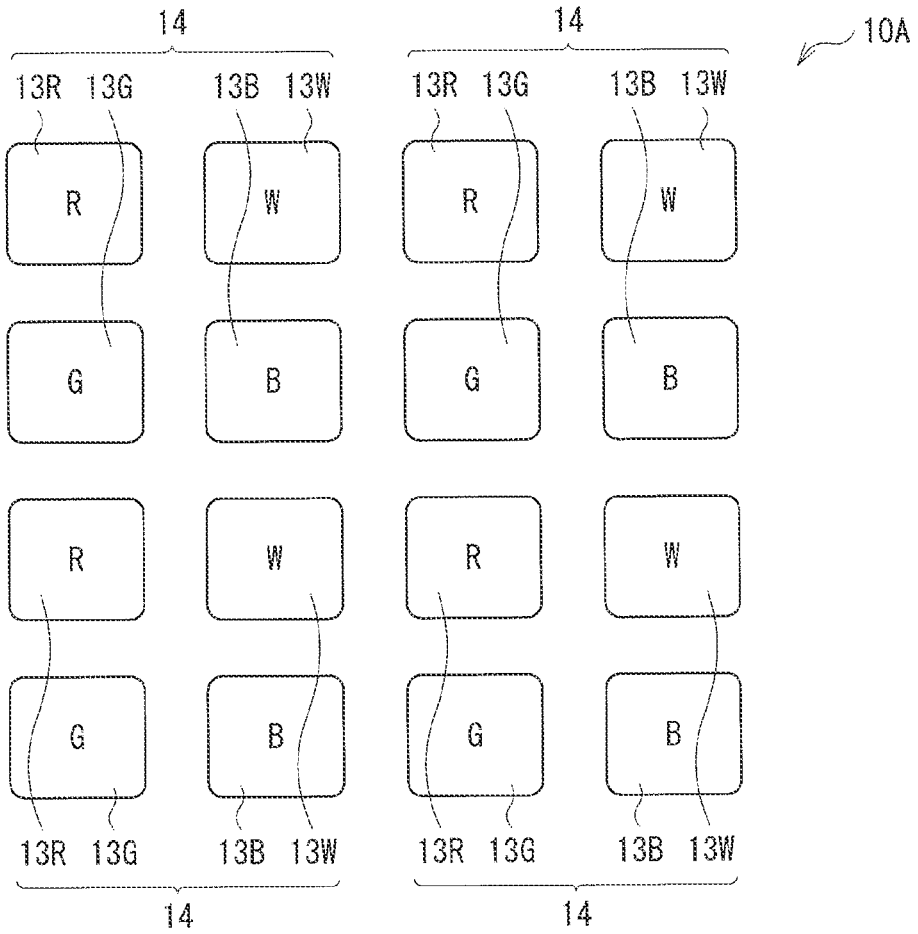
FIG. 3 is a diagram showing an example of layout for a display region illustrated in FIG. 1.

FIG. 3 shows an example of layout for the display region 10A. In the display region 10A, the plurality of display pixels 14 are arranged two-dimensionally, and in each of the display pixels 14 as well, the plurality of sub-pixels 13 (13R, 13G, 13B, and 13W) are also arranged two-dimensionally. In other words, the plurality of sub-pixels 13 are arrayed in a tiled form. Further, in the display region 10A, the plurality of sub-pixels 13 are arranged to prevent the sub-pixels 13 of the same kind from being placed next to each other. For example, in paying focused attention to one sub-pixel 13R, in a peripheral area around the sub-pixel 13R, there exist no sub-pixels of the same kind, but other kinds of sub-pixels 13G, 13B, and 13W are arranged instead.

In each of the display pixels 14, it is preferable that a layout of the sub-pixels 13 be common to each other. For example, the sub-pixel 13R is arranged at the upper left within the display pixels 14, the sub-pixel 13G is arranged at the lower left within the display pixels 14, the sub-pixel 13B is arranged at the lower right within the display pixels 14, and the sub-pixel 13W is arranged at the upper right within the display pixels 14. It is to be noted that a layout within each of the display pixels 14 is not limited to the above-described layout. As long as the plurality of sub-pixels 13 are arranged in a two-by-two matrix pattern (that is, in a tiled form), a positional relation for each of the sub-pixels 13G, 13B, and 13W is optionally.

(Driving Circuit 20)

The driving circuit 20 has a timing generation circuit 21, an image signal processing circuit 22, a data line driving circuit 23, a gate line driving circuit 24, a drain line driving circuit 25, and a defect dot detection circuit 26. An output of the data line driving circuit 23 is connected with the data line DTL, while an output of the gate line driving circuit 24 is connected with the gate line WSL. Further, an output of the drain line driving circuit 25 is connected with the drain line DSL, while an output of the defect dot detection circuit 26 is connected with the cathode line CTL.

The timing generation circuit 21, for example, controls the data line driving circuit 23, the gate line driving circuit 24, the drain line driving circuit 25, and the defect dot detection circuit 26 to operate in conjunction with each other. For example, the timing generation circuit 21 outputs a control signal 21A to these circuits depending on (in synchronization with) a synchronization signal 20B that is input externally.

The image signal processing circuit 22, for example, performs a predetermined correction for the digital image signal 20A that is input externally, outputting a resultant image signal 22A derived by such a correction to the data line driving circuit 23. Examples of the predetermined correction include a gamma correction, overdrive correction, and the like. Further, for example, when a correction instruction is given from the defect dot detection circuit 26, the image signal processing circuit 22 uses a correction signal 26A that is input from the defect dot detection circuit 26 to correct the image signal 20A. The image signal processing circuit 22, for example, performs a correction for the image signal 20A to vary the luminescence using the correction signal 26A. It is to be noted that the correction of the image signal 20A by the use of the correction signal 26A is hereinafter described in details.

The data line driving circuit 23, for example, applies (writes) an analog signal voltage 23A (pulse based on the image signal), corresponding to the image signal 22A that is input from the image signal processing circuit 22, to the sub-pixel 13 to be selected via each of the data lines DTL depending on (in synchronization with) an input of the control signal 21A. For example, the data line driving circuit 23 is capable of outputting the signal voltage 23A and a constant voltage independent of the image signal.

The gate line driving circuit 24, for example, applies selection pulses sequentially to the plurality of gate lines WSL depending on (in synchronization with) an input of the control signal 21A, thereby selecting the plurality of display pixels 14 sequentially in a unit of each of the gate lines WSL. For example, the gate line driving circuit 24 is capable of outputting a voltage to be applied in turning on the writing transistor Tws, and a voltage to be applied in turning off the writing transistor Tws.

The drain line driving circuit 25, for example, outputs a predetermined voltage to a drain of the driving transistor Tdr on each pixel circuit 12 via each of the drain lines DSL depending on (in synchronization with) an input of the control signal 21A. For example, the drain line driving circuit 25 is capable of outputting a voltage to be applied in making the organic EL device 11 luminescent, and a voltage to be applied in making the organic EL device 11 nonluminescent.

Figure 4:
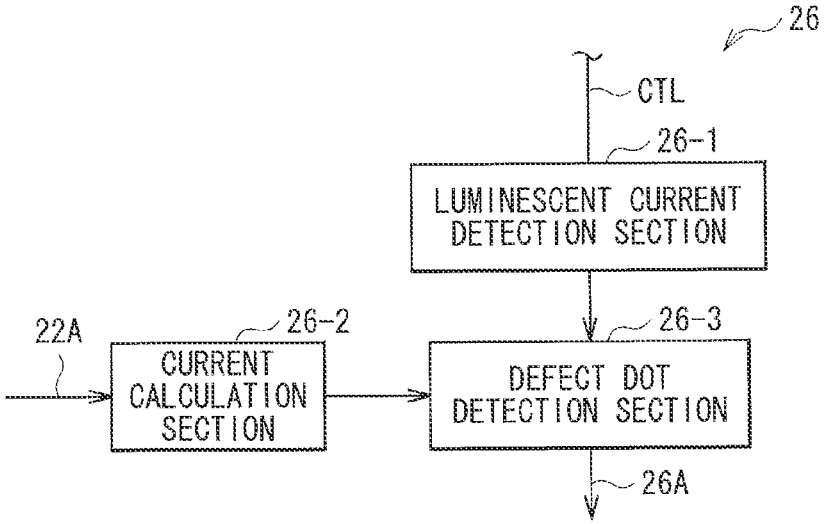
FIG. 4 is a schematic block diagram of a correction signal generation circuit illustrated in FIG. 1.

The defect dot detection circuit 26, for example, calculates the luminance of the organic EL device 11 from a current flowing through the cathode line CTL, and compares the luminance derived from the calculation (or a characteristic value corresponding to the luminance) with the luminance derived from the image signal 22A that is input from the image signal processing circuit 22 (or a characteristic value corresponding to the luminance), generating the correction signal 26A corresponding to the comparison result. FIG. 4 shows an example of a functional block for the defect dot detection circuit 26. The defect dot detection circuit 26 is composed of, for example, a luminescent current detection section 26-1, a current calculation section 26-2, and a defect dot detection section 26-3.

The luminescent current detection section 26-1 detects a current flowing through the cathode line CTL. The luminescent current detection section 26-1, for example, detects a current for each of the cathode lines CTL, being composed to include a plurality of current measuring circuits that are provided one-by-one for each of the cathode lines CTL. For example, the luminescent current detection section 26-1 outputs a value of the detected current (detection current) to the defect dot detection section 26-3. At this time, the luminescent current detection section 26-1, for example, outputs a value of the detection current for each of the cathode lines CTL. It is to be noted that the luminescent current detection section 26-1, for example, may output a characteristic signal (for example, a voltage) corresponding to a current flowing through the cathode line CTL to the defect dot detection section 26-3. At this time, the luminescent current detection section 26-1, for example, may output a characteristic signal (for example, a voltage) for each of the cathode lines CTL.

The current calculation section 26-2 predicts a current flowing through the cathode line CTL from the image signal 22A. The current calculation section 26-2, for example, predicts a current for each of the cathode lines CTL from the image signal 20A. When the luminescent current detection section 26-1 is configured to output a value of a detection current, the current calculation section 26-2 outputs a value of a predicted current derived from the image signal 22A. At this time, the current calculation section 26-2, for example, outputs a value of a predicted current derived from the image signal 22A for each of pixel rows. It is to be noted that when the luminescent current detection section 26-1 is configured to output the above-described characteristic signal, the current calculation section 26-2 may output a predicted signal (for example, a voltage) corresponding to a predicted current derived from the image signal 22A. At this time, the current calculation section 26-2, for example, may output a predicted signal (for example, a voltage) for each of pixel rows.

The defect dot detection section 26-3 detects the presence or absence of a defect dot by comparing an input signal from the luminescent current detection section 26-1 with an input signal from the current calculation section 26-2, and derives a position of a defect dot if a defect dot is present. The defect dot detection section 26-3, for example, compares a value of a detection current input from the luminescent current detection section 26-1 with a value of a predicted current input from the current calculation section 26-2 for each of the sub-pixels 13, and, when the comparison result satisfies a predetermined relationship, outputs positional information of that sub-pixel 13 to the image signal processing circuit 22 as the correction signal 26A.

It is to be noted that when a defect dot occurs due to an inter-electrode short-circuiting caused by introduction of any foreign material in a process for forming the organic EL device 11, the defect dot detection section 26-3, for example, compares a value of a detection current that is input from the luminescent current detection section 26-1 with a value of a predicted current that is input from the current calculation section 26-2 for each of the sub-pixels 13, and, if the value of the detection current is significantly greater than the value of the predicted current, may output positional information of that sub-pixel 13 to the image signal processing circuit 22 as the correction signal 26A.

It is to be noted that when a current value in the event of occurrence of a defect dot due to an inter-electrode short-circuiting is predictable in advance, the defect dot detection section 26-3 may not use an output from the current calculation section 26-2, and may compare a value of a detection current that is input from the luminescent current detection section 26-1 with a value of a threshold current that is prepared beforehand for each of the sub-pixels 13, and, if the value of the detection current is greater than the value of the threshold current, may output positional information of that sub-pixel 13 to the image signal processing circuit 22 as the correction signal 26A. In this case, it is possible to omit the current calculation section 26-2.

(Method of Correcting Defect Dot)

Next, the description is provided on a method of correcting a defect dot using the correction signal 26A. Upon reception of the correction signal 26A indicating positional information of a defect dot from the defect dot detection circuit 26 (that is, when the sub-pixel 13 of a defect dot is present), the image signal processing circuit 22 performs a correction for compensating a defect dot for the image signal 20A corresponding to the plurality of sub-pixels 13 adjacent or close to the sub-pixel 13 of a defect dot. For example, upon reception of the correction signal 26A indicating that a defect dot is present within a monochromatic display region from the defect dot detection circuit 26 in carrying out a monochromatic display using the plurality of sub-pixels 13 at a certain region, the image signal processing circuit 22 performs a correction for compensating a defect dot for the image signal 20A corresponding to the plurality of sub-pixels 13 adjacent or close to the sub-pixel 13 of a defect dot. The data line driving circuit 23 applies an analog signal voltage 23A (pulse) corresponding to the image signal 22A, that is input from the image signal processing circuit 22 and is compensated for correcting a defect dot, to the plurality of sub-pixels 13 adjacent or close to the sub-pixel 13 of a defect dot.

More specifically, upon reception of the correction signal 26A indicating positional information of a defect dot from the defect dot detection circuit 26, the image signal processing circuit 22 performs a correction for the image signal 20A corresponding to the sub-pixels 13 being corrected, to ensure that the total luminance of the plurality of sub-pixels 13 (sub-pixels 13 being corrected) which are adjacent or close to the sub-pixel 13 of a defect dot and to which compensated pulses for correcting a defect dot are applied attains a magnitude for correcting a defect dot. For example, upon reception of the correction signal 26A indicating that a defect dot is present within a monochromatic display region from the defect dot detection circuit 26 in carrying out a monochromatic display using the plurality of sub-pixels 13 at a certain region, the image signal processing circuit 22 performs a correction for the image signal 20A corresponding to the sub-pixels 13 being corrected, to ensure that the total luminance of the plurality of sub-pixels 13 (sub-pixels 13 being corrected) which are adjacent or close to the sub-pixel 13 of a defect dot and to which compensated pulses for correcting a defect dot are applied attains a magnitude for correcting a defect dot. Hereupon, it is preferable that a "magnitude for correcting a defect dot" be a magnitude same or almost same as the luminescence supposed to be obtained by the sub-pixel 13 of a defect dot at the time when this sub-pixel 13 is capable of emitting light.

Figure 5:
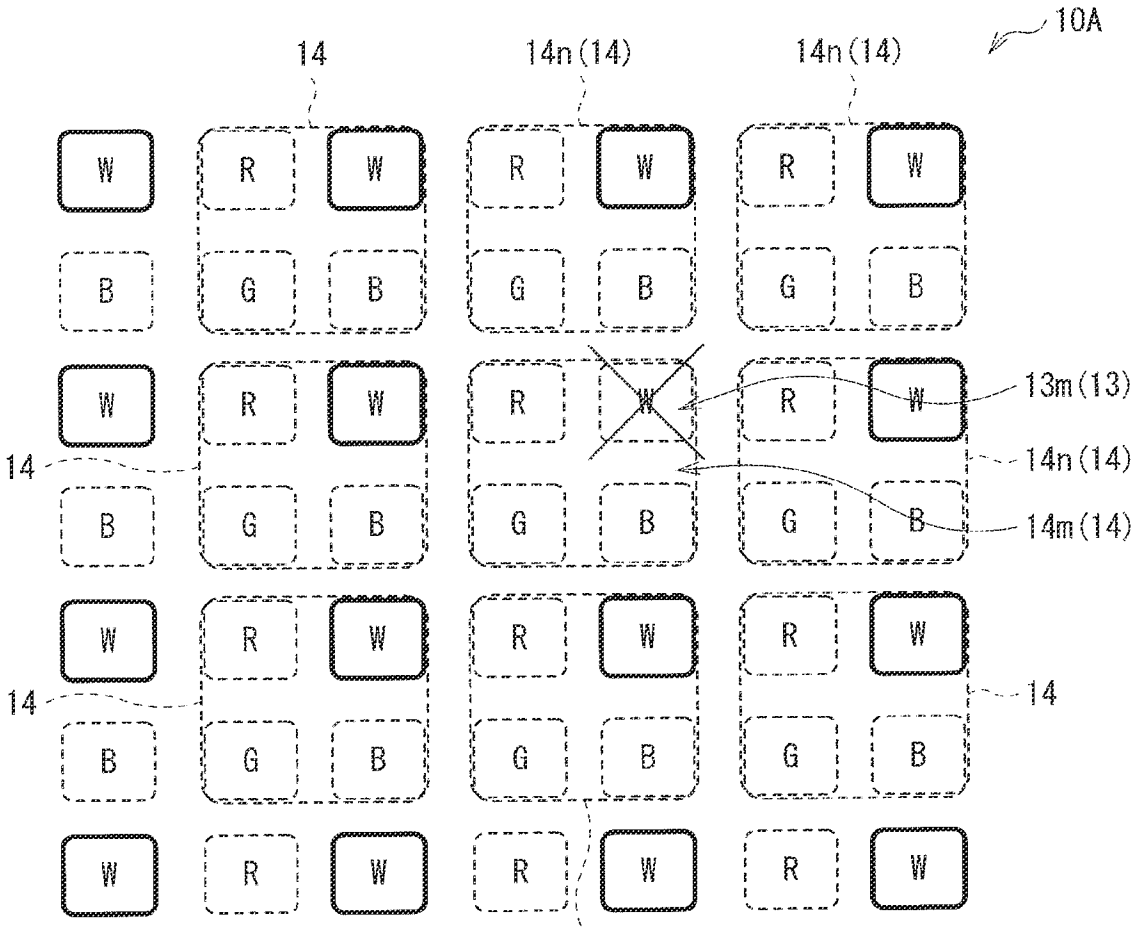
FIG. 5 is a schematic diagram showing how a white display is performed in a region including a defect dot.

FIG. 5 schematically shows a state where each of the sub-pixels 13W is luminescent at a display region including a defect dot when the defect dot is present, and the display region becomes a white display area. The sub-pixel 13 with a cross mark put thereon in FIG. 5 is equivalent to the sub-pixel 13 of a defect dot. Further, the sub-pixels 13 indicated with bold frames in FIG. 5 mean to be luminescent based on the signal voltage 23A applied from the data line driving circuit 23. Additionally, the sub-pixels 13 indicated with dashed frames in FIG. 5 mean to be nonluminescent based on the signal voltage 23A applied from the data line driving circuit 23. It is to be noted that, in the figures from FIG. 6 downward as well, a cross mark means a defect dot, and a bold frame means the luminescence, while a dashed frame means the nonluminescence.

Figure 6A:
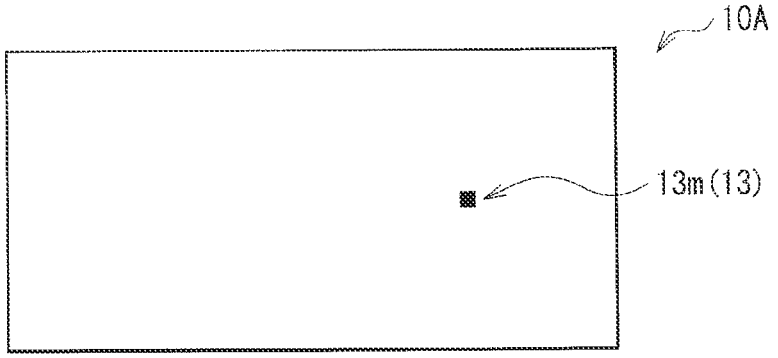
FIG. 6A is a diagram showing an example of a defect dot to be viewed when a monochromatic display is performed in a region including a defect dot.
Figure 6B:
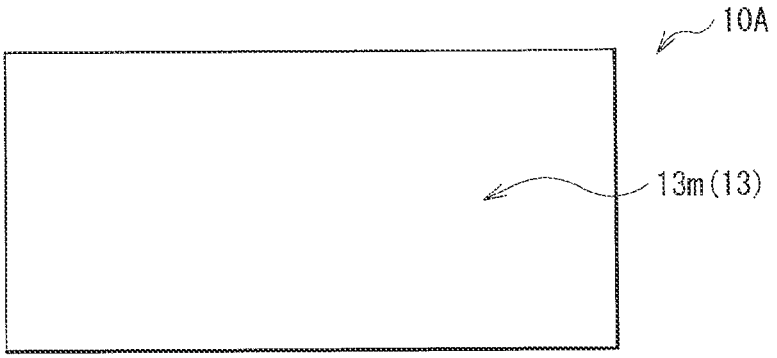
FIG. 6B is a schematic diagram showing a state where a defect dot is made invisible by a defect dot correction according to an embodiment of the present disclosure.

When a defect dot as shown in FIG. 5 occurs, a viewer sees a black dot as shown in FIG. 6A as a defect dot. At this time, upon reception of the correction signal 26A indicating positional information of a defect dot from the defect dot detection circuit 26, as shown in FIG. 7 to FIG. 13 for example, the image signal processing circuit 22 performs a correction for a defect dot for the image signal 20A corresponding to: the sub-pixels 13 included in the display pixel 14 (defect dot pixel 14*m*) containing the sub-pixel 13 (defect dot sub-pixel 13*m*) corresponding to the positional information; and the sub-pixel(s) 13 included in the display pixel(s) 14 (adjacent pixel(s) 14*n*) adjacent to the defect dot sub-pixel 13*m*. Correction for a defect dot makes a black dot invisible from a viewer as shown in FIG. 6B.

Figure 7:
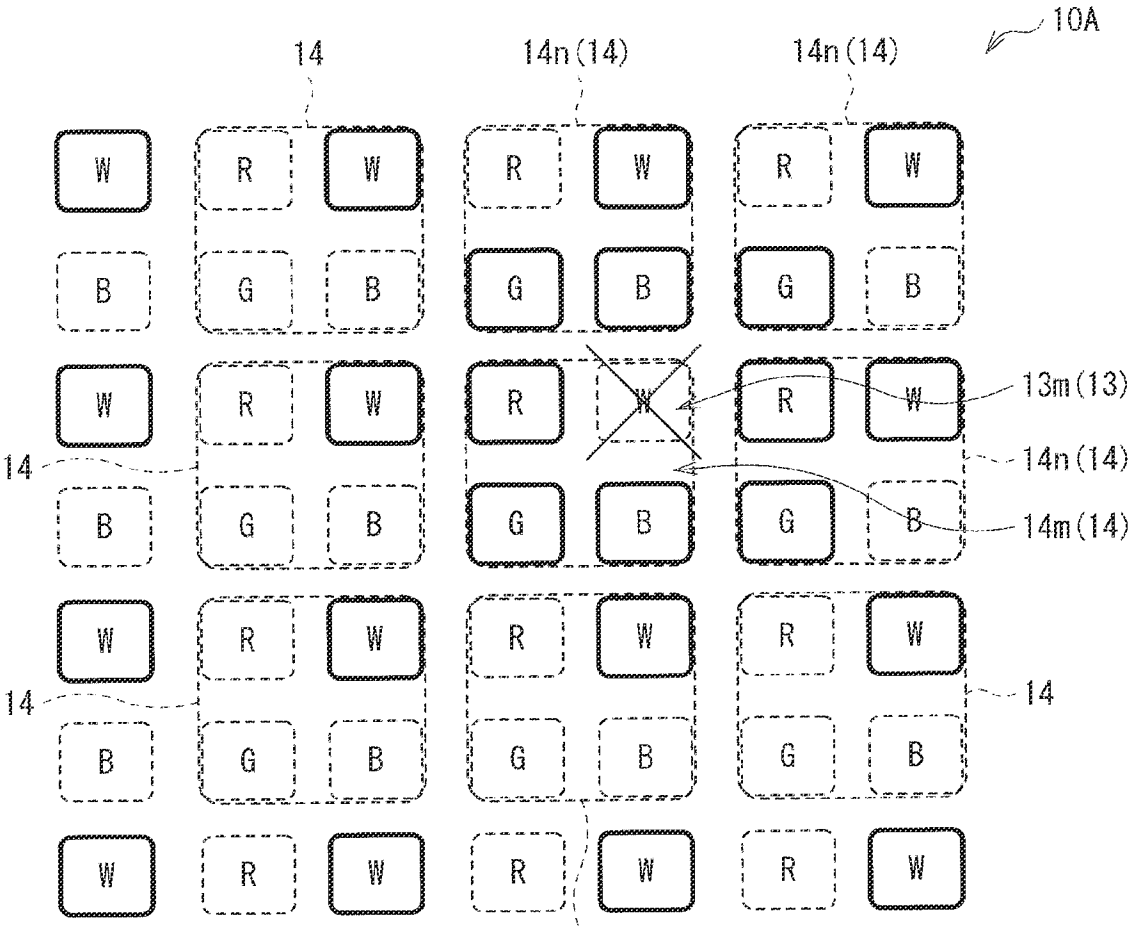
FIG. 7 is a schematic diagram showing as an example how a defect dot correction is carried out when a white display is performed in a region including a defect dot.

When a position of a defect dot that is indicated by the correction signal 26A is present within a region corresponding to a white display area, as shown in an example in FIG. 7, the image signal processing circuit 22 performs a correction for the image signal 20A corresponding to eight sub-pixels 13 surrounding the defect dot sub-pixel 13*m* to ensure that such eight sub-pixels 13 light up at luminance for correcting a defect dot. In concrete terms, when a position of a defect dot that is indicated by the correction signal 26A is present within a region corresponding to a white display area, as shown in an example in FIG. 7, the image signal processing circuit 22 performs a correction for the image signal 20A corresponding to eight sub-pixels 13 surrounding the defect dot sub-pixel 13*m* to ensure that total luminance of such eight sub-pixels 13 attains a magnitude for correcting a defect dot.

Meanwhile, eight sub-pixels 13 surrounding the defect dot sub-pixel 13*m* are composed of the sub-pixels 13R, 13G, and 13B that individually emit color light (red, green, and blue) included in the light of three primary colors, and more specifically, are composed of two sub-pixels 13R, four sub-pixels 13G, and two sub-pixels 13B. From a surrounding area of the defect dot sub-pixel 13*m*, therefore, color light (that is, white light) is generated that is derived by the additive color mixing of light emitted from eight sub-pixels 13 as described above. As a result, a defect dot is corrected using the white light emitted from a surrounding area of the defect dot sub-pixel 13*m*.

It is to be noted that, when a position of a defect dot that is indicated by the correction signal 26A is present within a region corresponding to a white display area, the image signal processing circuit 22 may perform a correction only for the image signal 20A corresponding to some of eight sub-pixels 13 surrounding the defect dot sub-pixel 13*m*.

Figure 8:
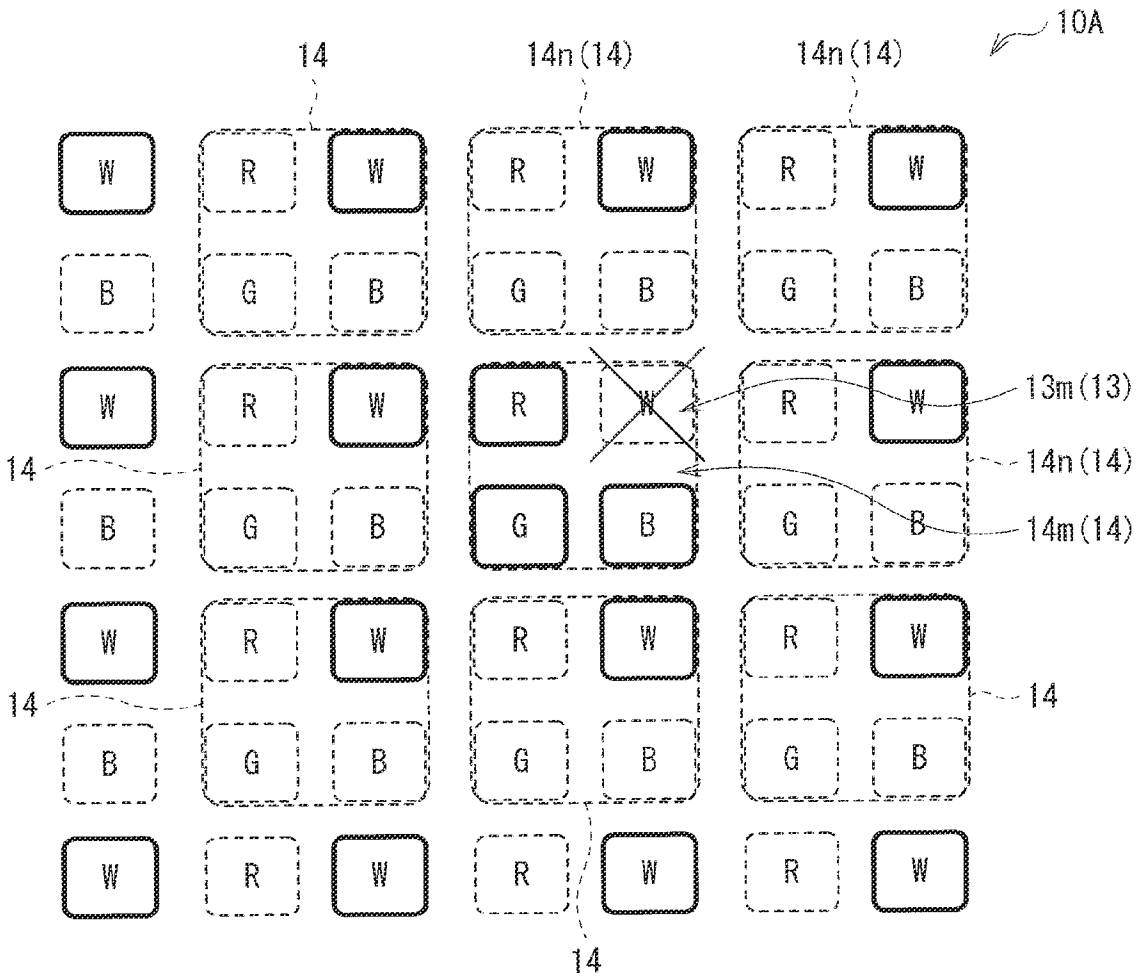
FIG. 8 is a diagram showing a first modification example for the defect dot correction illustrated in FIG. 7.
Figure 9:
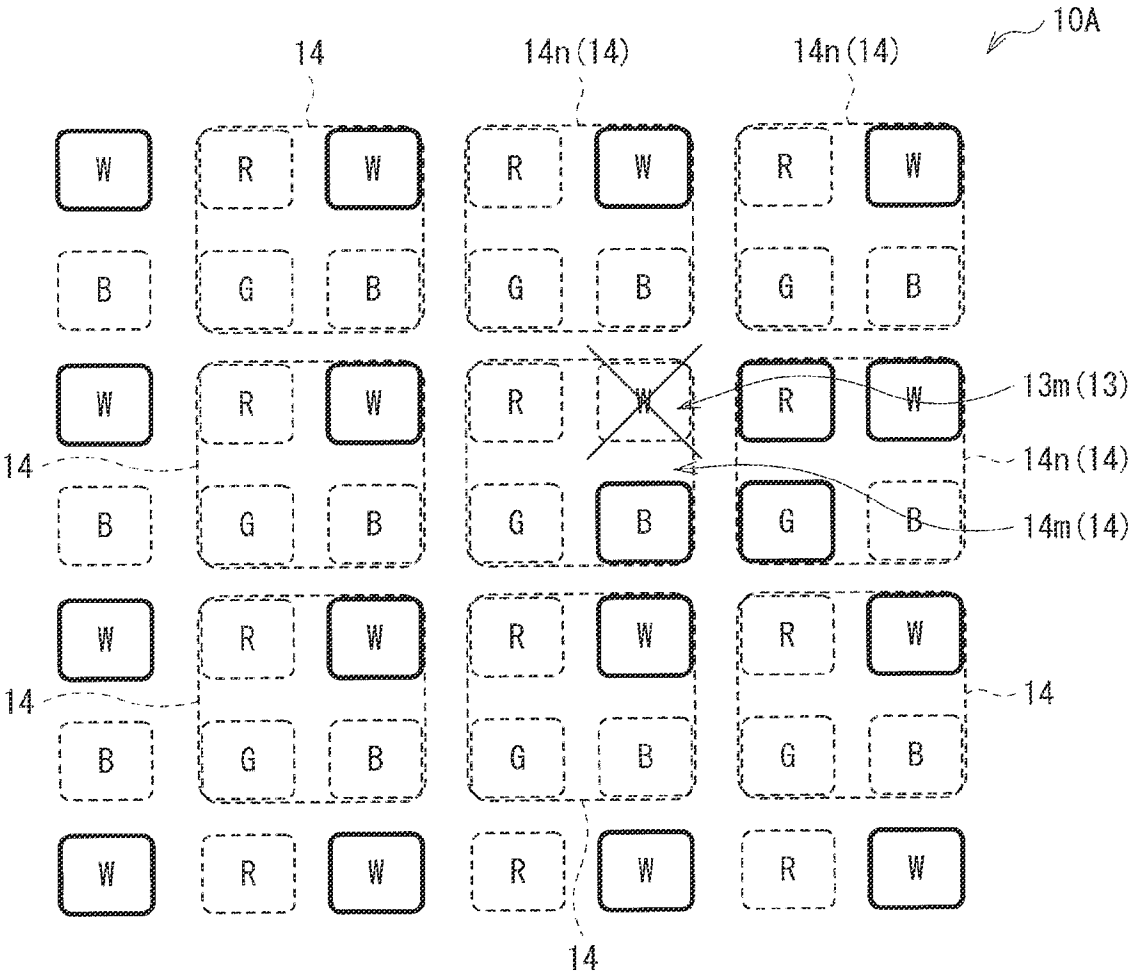
FIG. 9 is a diagram showing a second modification example for the defect dot correction illustrated in FIG. 7.
Figure 10:
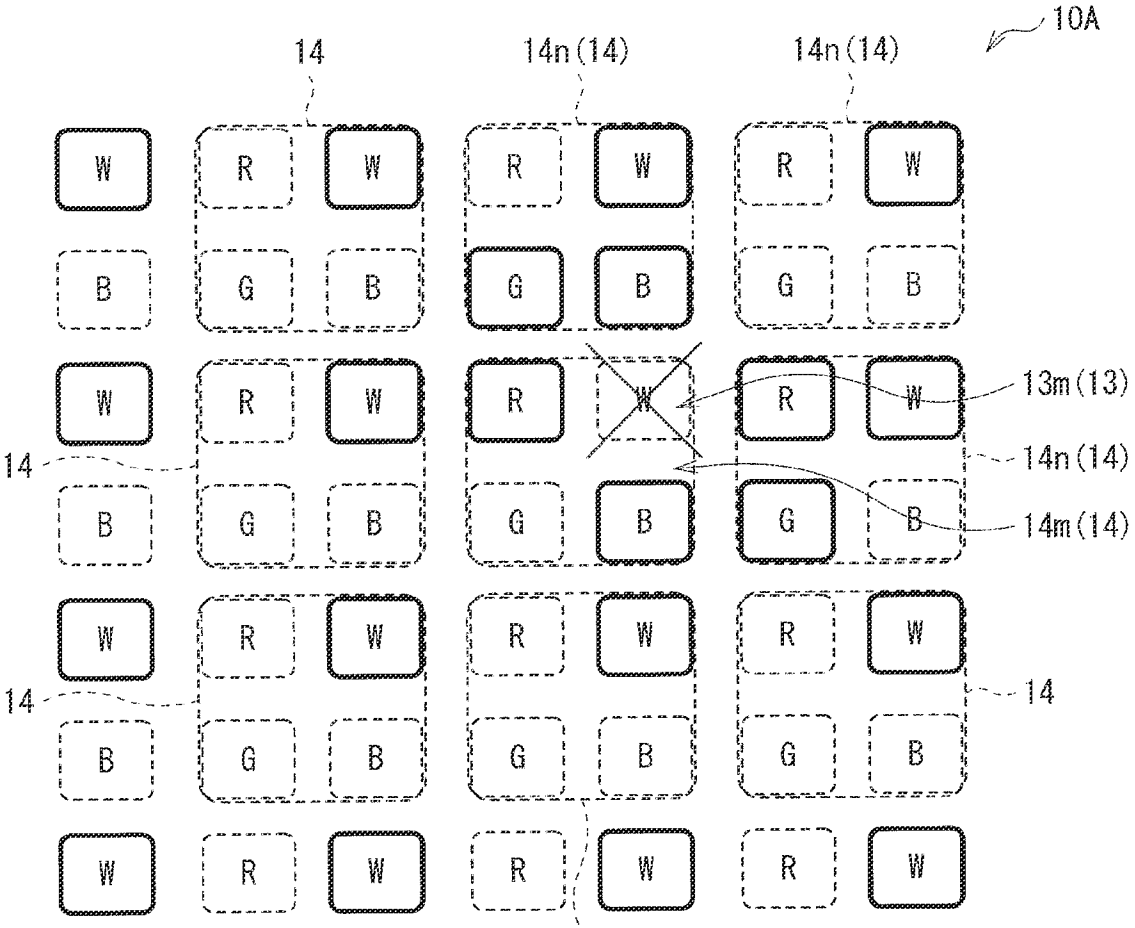
FIG. 10 is a diagram showing a third modification example for the defect dot correction illustrated in FIG. 7.
Figure 11:
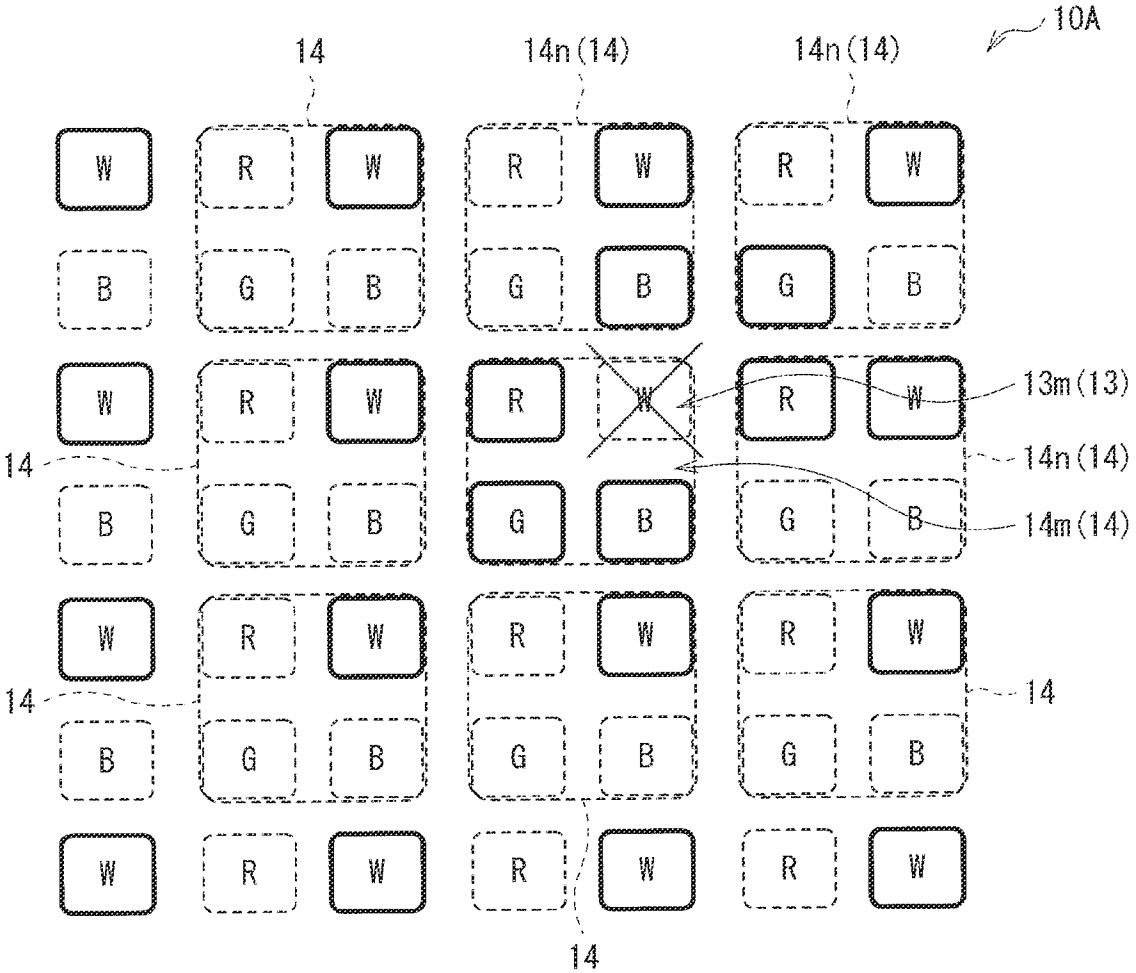
FIG. 11 is a diagram showing a fourth modification example for the defect dot correction illustrated in FIG. 7.
Figure 12:
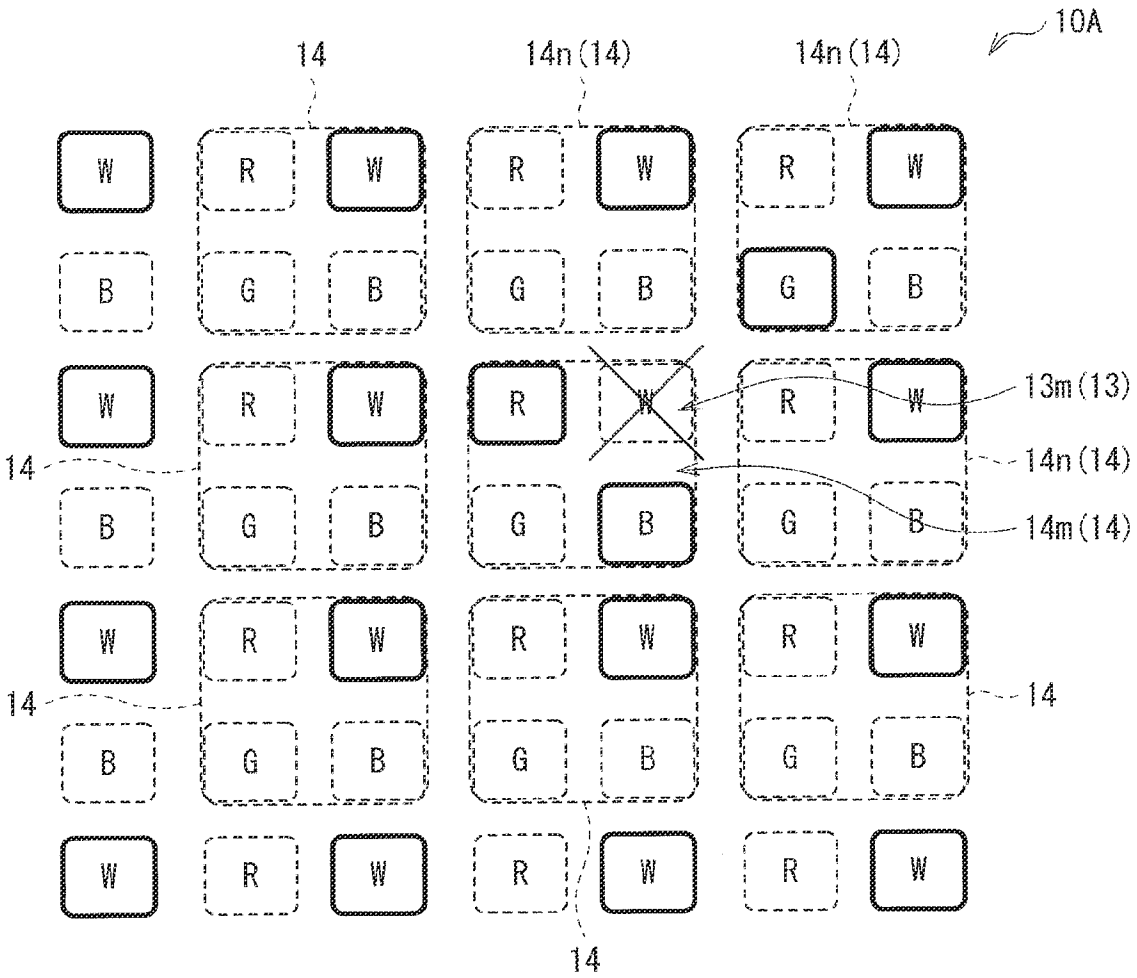
FIG. 12 is a diagram showing a fifth modification example for the defect dot correction illustrated in FIG. 7.
Figure 13:
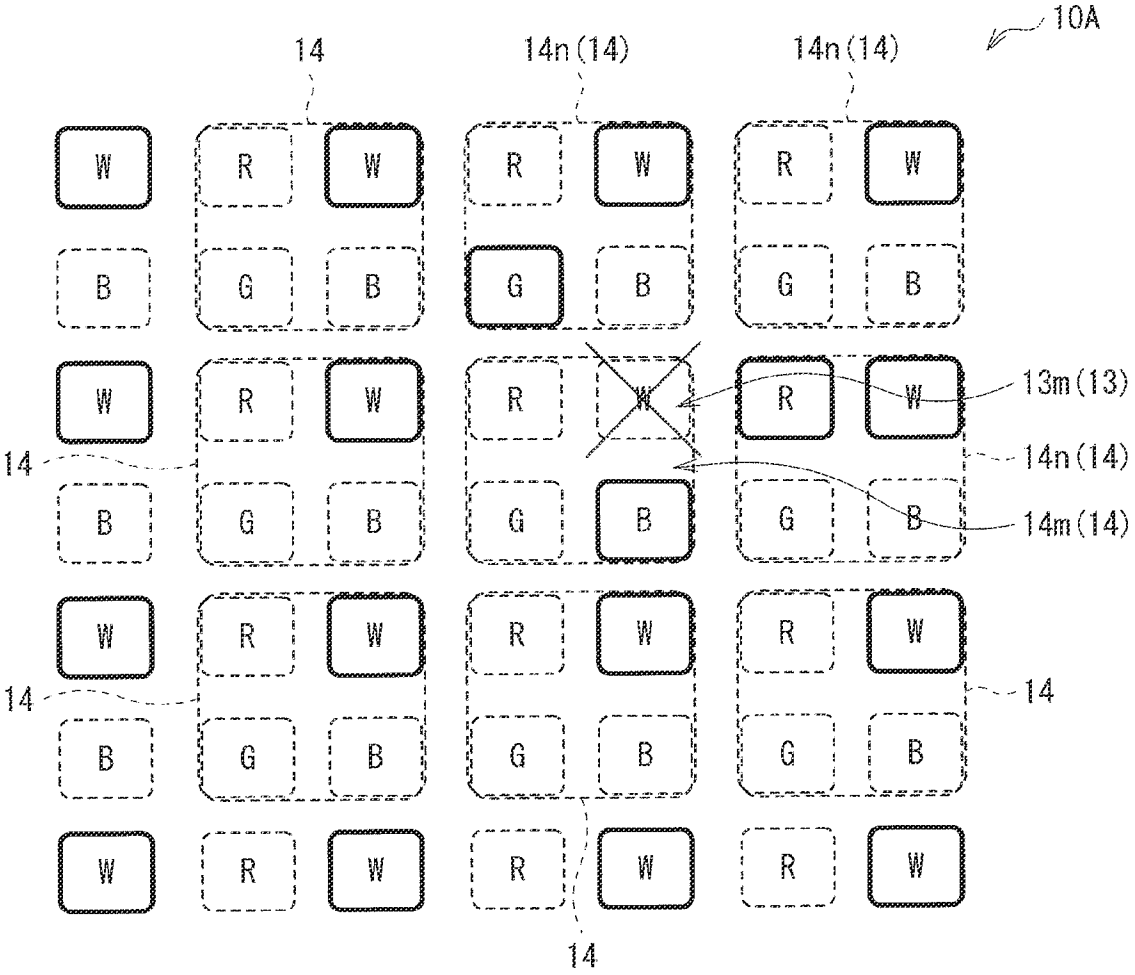
FIG. 13 is a diagram showing a sixth modification example for the defect dot correction illustrated in FIG. 7.

When a position of a defect dot that is indicated by the correction signal 26A is present within a region corresponding to a white display area, as shown in an example in FIG. 8, the image signal processing circuit 22 may perform a correction for the image signal 20A corresponding to three sub-pixels 13 (13R, 13G, and 13B) other than a defect dot that are included in a defect dot pixel 14*m* to ensure that such three sub-pixels 13 light up at luminance for correcting a defect dot. In concrete terms, when a position of a defect dot that is indicated by the correction signal 26A is present within a region corresponding to a white display area, as shown in an example in FIG. 8, the image signal processing circuit 22 may perform a correction for the image signal 20A corresponding to three sub-pixels 13 (13R, 13G, and 13B) other than a defect dot that are included in the defect dot pixel 14*m* to ensure that total luminance of such three sub-pixels 13 attains a magnitude for correcting a defect dot. It is to be noted that three sub-pixels 13 (13R, 13G, and 13B) to be corrected are sub-pixels that individually emit color light (red, green, and blue) included in the light of three primary colors.

When a position of a defect dot that is indicated by the correction signal 26A is present within a region corresponding to a white display area, as shown in FIG. 9 to FIG. 13 for example, the image signal processing circuit 22 may perform a correction for the image signal 20A corresponding to a set of RGB sub-pixels (13R, 13G, and 13B) or two sets of RGB sub-pixels (13R, 13G, and 13B) that are placed around the defect dot sub-pixel 13*m* to ensure that such a set of RGB sub-pixels or two sets of RGB sub-pixels light up at luminance for correcting a defect dot. In concrete terms, when a position of a defect dot that is indicated by the correction signal 26A is present within a region corresponding to a white display area, as shown in FIG. 9 to FIG. 13 for example, the image signal processing circuit 22 may perform a correction for the image signal 20A corresponding to a set of RGB sub-pixels (13R, 13G, and 13B) or two sets of RGB sub-pixels (13R, 13G, and 13B) that are placed around the defect dot sub-pixel 13*m* to ensure that total luminance of such a set of RGB sub-pixels or two sets of RGB sub-pixels attains a magnitude for correcting a defect dot. It is to be noted that a set of RGB sub-pixels (13R, 13G, and 13B) and two sets of RGB sub-pixels (13R, 13G, and 13B) to be corrected are sub-pixels that individually emit color light (red, green, and blue) included in the light of three primary colors.

Figure 14:
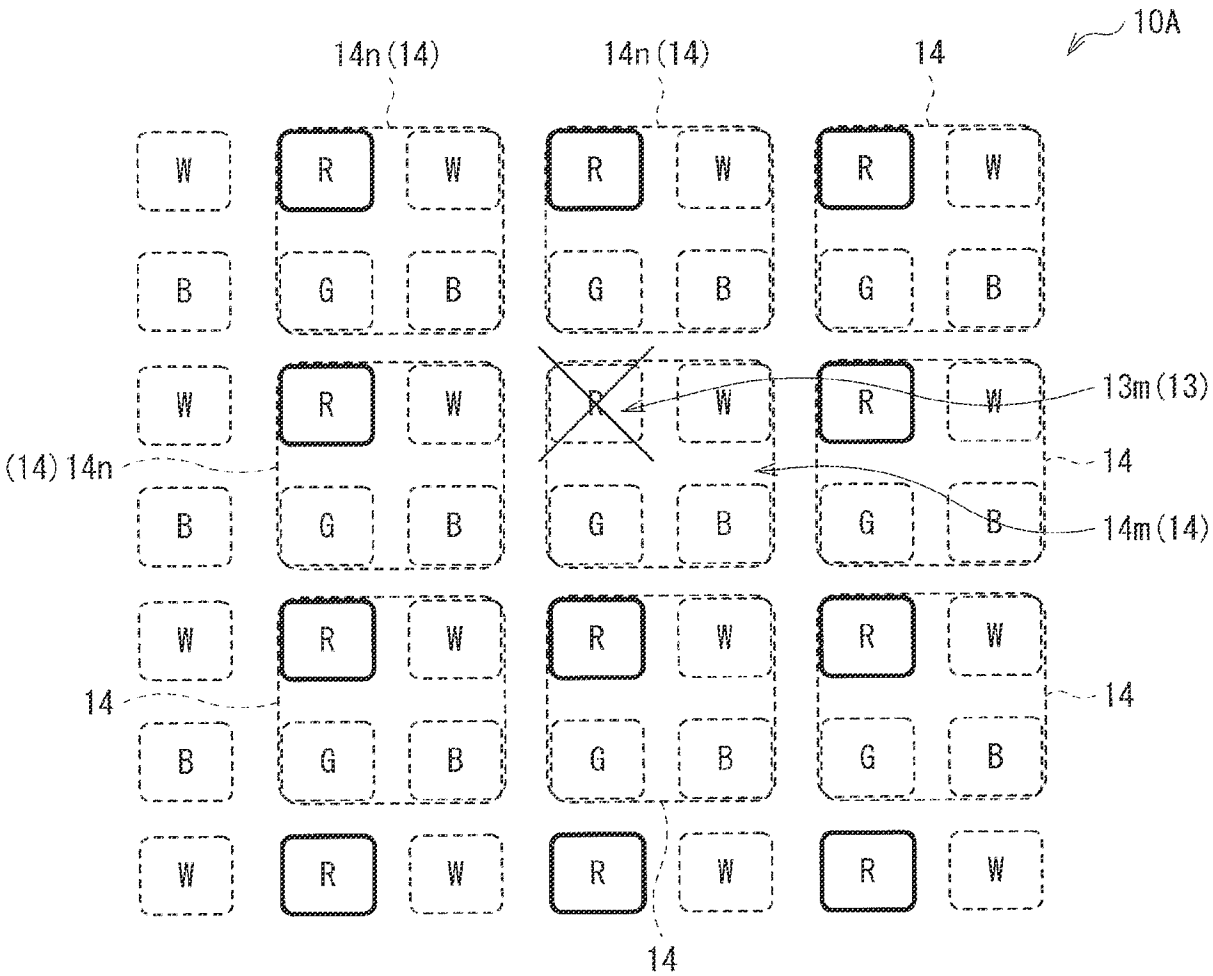
FIG. 14 is a schematic diagram showing how a red display is performed in a region including a defect dot.

FIG. 14 schematically shows a state where each of the sub-pixels 13R is luminescent at a display region including a defect dot when the defect dot is present, and the display region becomes a red display area. When a defect dot as shown in FIG. 14 occurs, a viewer sees a black dot as shown in FIG. 6A as a defect dot. At this time, upon reception of the correction signal 26A indicating positional information of a defect dot from the defect dot detection circuit 26, as shown in an example in FIG. 15, the image signal processing circuit 22 performs a correction for a defect dot for the image signal 20A corresponding to: the sub-pixel 13W included in the defect dot pixel 14*m*; and the sub-pixel 13W that is included in three display pixels 14 (adjacent pixels 14*n*) that are adjacent to the defect dot sub-pixel 13*m* and that is adjacent to the defect dot sub-pixel 13*m*. Correction for a defect dot makes a black dot invisible from a viewer as shown in FIG. 6B. It is to be noted that two sub-pixels 13W to be corrected are sub-pixels that emit color light (white light) derived from the additive color mixing.

Figure 15:
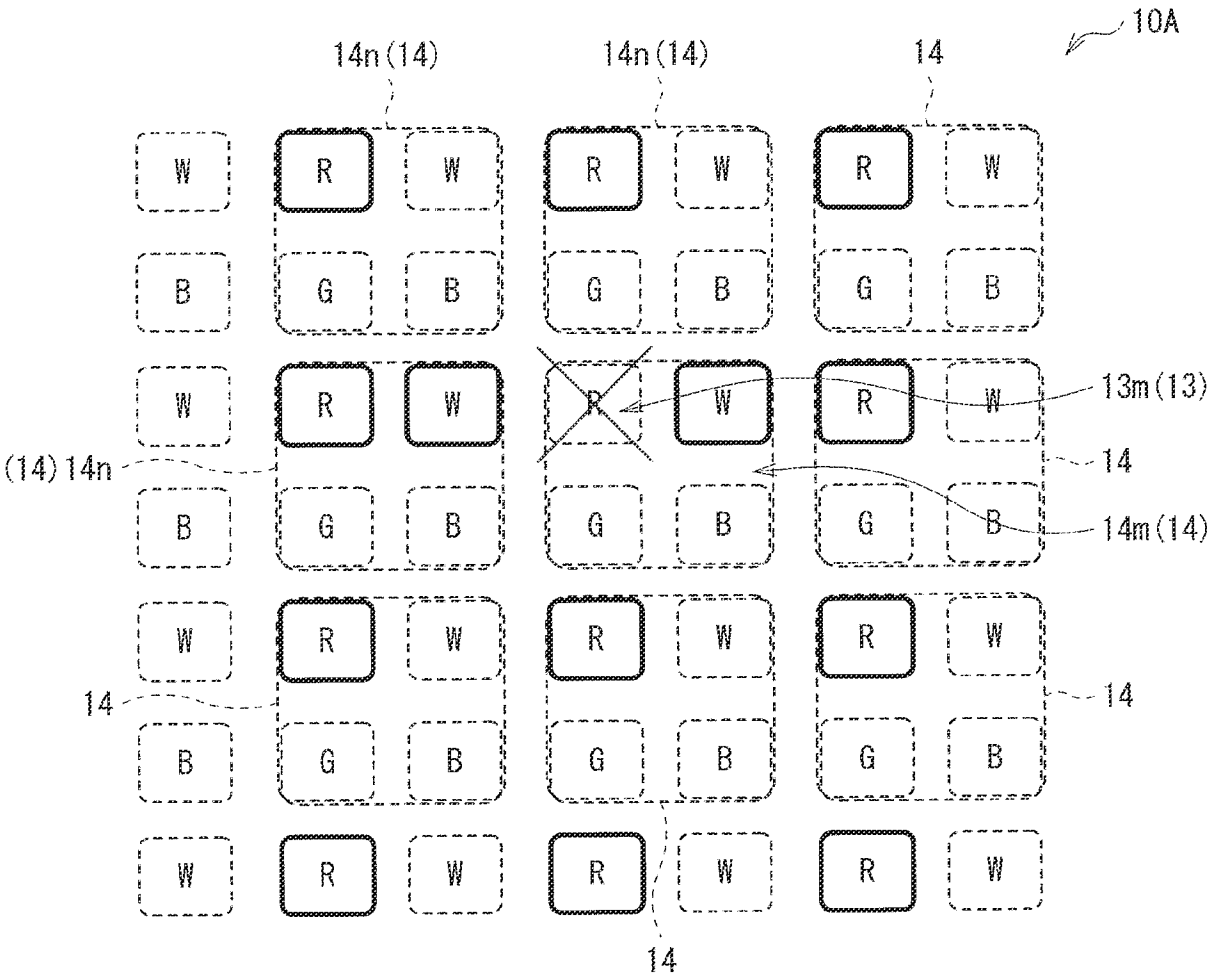
FIG. 15 is a schematic diagram showing as an example how a defect dot correction is carried out when a red display is performed in a region including a defect dot.

When a position of a defect dot that is indicated by the correction signal 26A is present within a region corresponding to a red display area, as shown in an example in FIG. 15, the image signal processing circuit 22 performs a correction for the image signal 20A corresponding to two sub-pixels 13W that are adjacent to the defect dot sub-pixel 13*m* to ensure that such two sub-pixels 13W light up at luminance for correcting a defect dot. In concrete terms, when a position of a defect dot that is indicated by the correction signal 26A is present within a region corresponding to a red display area, for example, the image signal processing circuit 22 performs a correction for the image signal 20A corresponding to two sub-pixels 13W that are adjacent to the defect dot sub-pixel 13*m* to ensure that total luminance of such two sub-pixels 13W attains a magnitude for correcting a defect dot. It is to be noted that the white light is color light derived from the additive color mixing of every color light of three primary colors, and thus a defect dot is corrected using the white light emitted from a surround area of the defect dot sub-pixel 13*m*.

Figure 16:
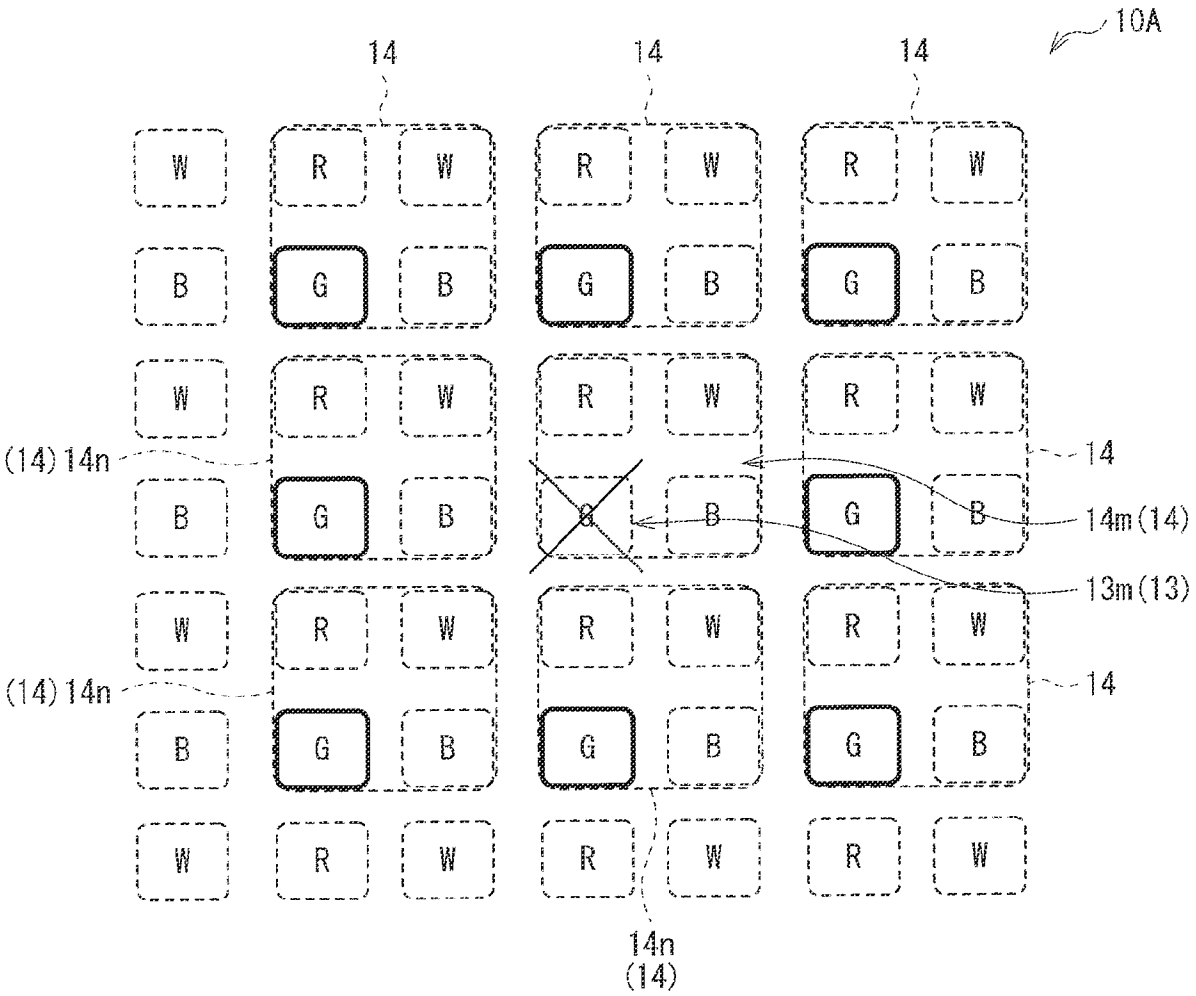
FIG. 16 is a schematic diagram showing how a green display is performed in a region including a defect dot.

FIG. 16 schematically shows a state where each of the sub-pixels 13G is luminescent at a display region including a defect dot when the defect dot is present, and the display region becomes a green display area. When a defect dot as shown in FIG. 16 occurs, a viewer sees a black dot as shown in FIG. 6A as a defect dot. At this time, upon reception of the correction signal 26A indicating positional information of a defect dot from the defect dot detection circuit 26, as shown in an example in FIG. 17, the image signal processing circuit 22 performs a correction for a defect dot for the image signal 20A corresponding to: the sub-pixel 13W included in the defect dot pixel 14*m*; and the sub-pixels 13W each included in three display pixels 14 (adjacent pixels 14*n*) that are adjacent to the defect dot sub-pixel 13*m*. Correction for a defect dot makes a black dot invisible from a viewer as shown in FIG. 6B. It is to be noted that four sub-pixels 13W to be corrected are sub-pixels that emit color light (white light) derived from the additive color mixing.

Figure 17:
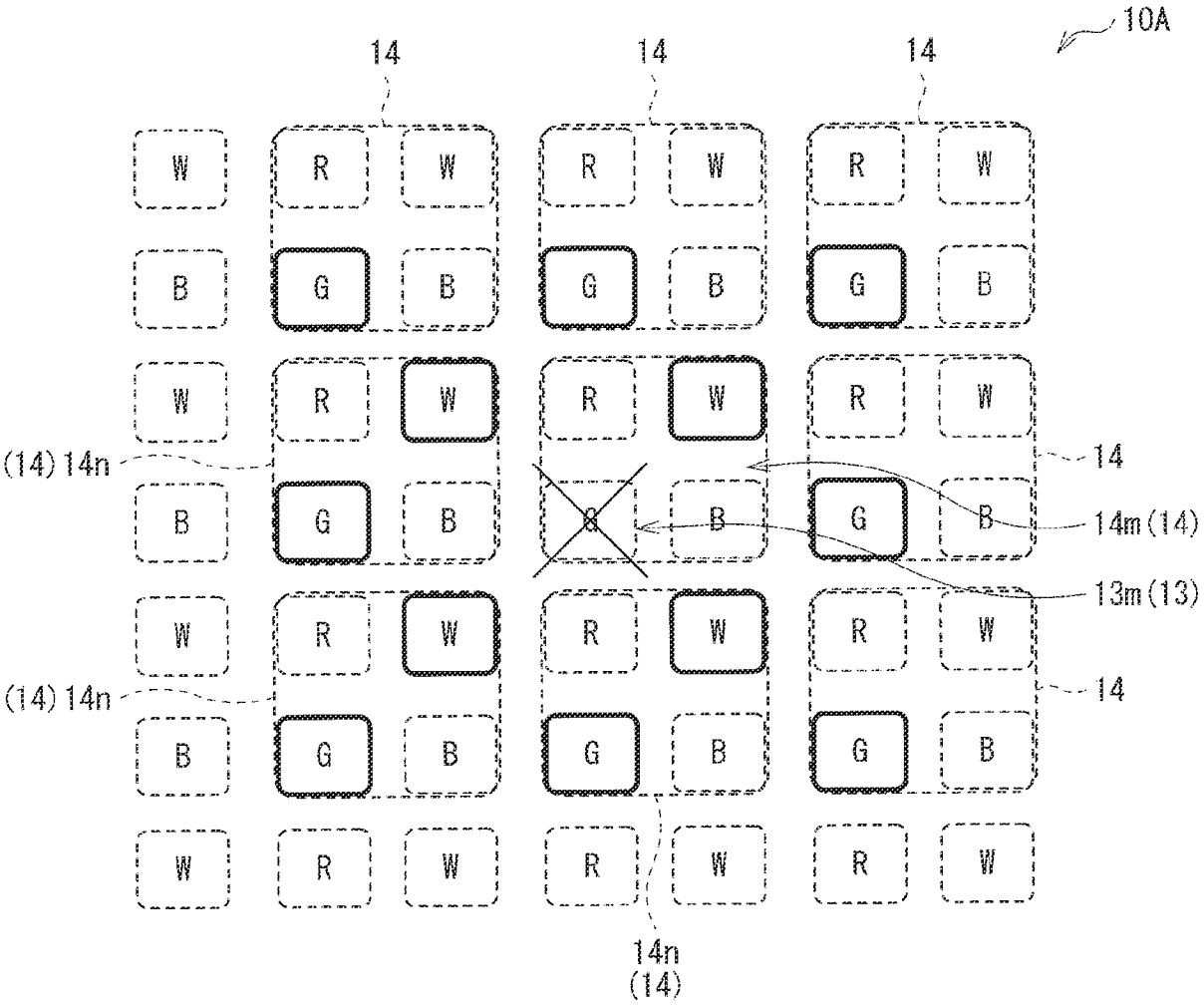
FIG. 17 is a schematic diagram showing as an example how a defect dot correction is carried out when a green display is performed in a region including a defect dot.

When a position of a defect dot that is indicated by the correction signal 26A is present within a region corresponding to a green display area, as shown in an example in FIG. 17, the image signal processing circuit 22 performs a correction for the image signal 20A corresponding to four sub-pixels 13W that are adjacent to the defect dot sub-pixel 13*m* to ensure that such four sub-pixels 13W light up at luminance for correcting a defect dot. In concrete terms, when a position of a defect dot that is indicated by the correction signal 26A is present within a region corresponding to a green display area, for example, the image signal processing circuit 22 performs a correction for the image signal 20A corresponding to four sub-pixels 13W that are adjacent to the defect dot sub-pixel 13*m* to ensure that total luminance of such four sub-pixels 13W attains a magnitude for correcting a defect dot. It is to be noted that the white light is color light derived from the additive color mixing of every color light of three primary colors, and thus a defect dot is corrected using the white light emitted from a surround area of the defect dot sub-pixel 13*m*.

Figure 18:
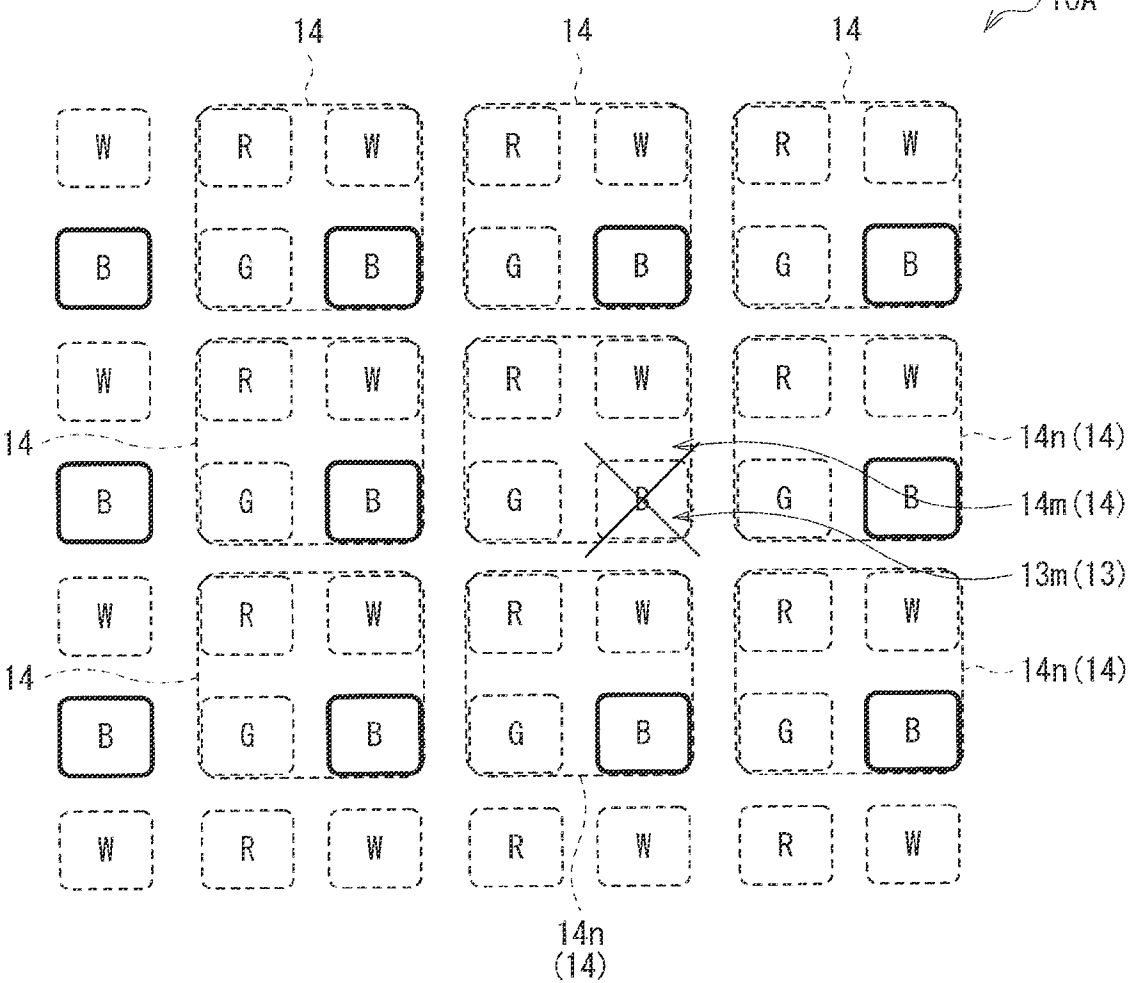
FIG. 18 is a schematic diagram showing how a blue display is performed in a region including a defect dot.

FIG. 18 schematically shows a state where each of the sub-pixels 13B is luminescent at a display region including a defect dot when the defect dot is present, and the display region becomes a blue display area. When a defect dot as shown in FIG. 18 occurs, a viewer sees a black dot as shown in FIG. 6A as a defect dot. At this time, upon reception of the correction signal 26A indicating positional information of a defect dot from the defect dot detection circuit 26, as shown in an example in FIG. 19, the image signal processing circuit 22 performs a correction for a defect dot for the image signal 20A corresponding to: the sub-pixel 13W included in the defect dot pixel 14*m*; and the sub-pixel 13W that is adjacent to the defect dot sub-pixel 13*m*. Correction for a defect dot makes a black dot invisible from a viewer as shown in FIG. 6B. It is to be noted that two sub-pixels 13W to be corrected are sub-pixels that emit color light (white light) derived from the additive color mixing.

Figure 19:
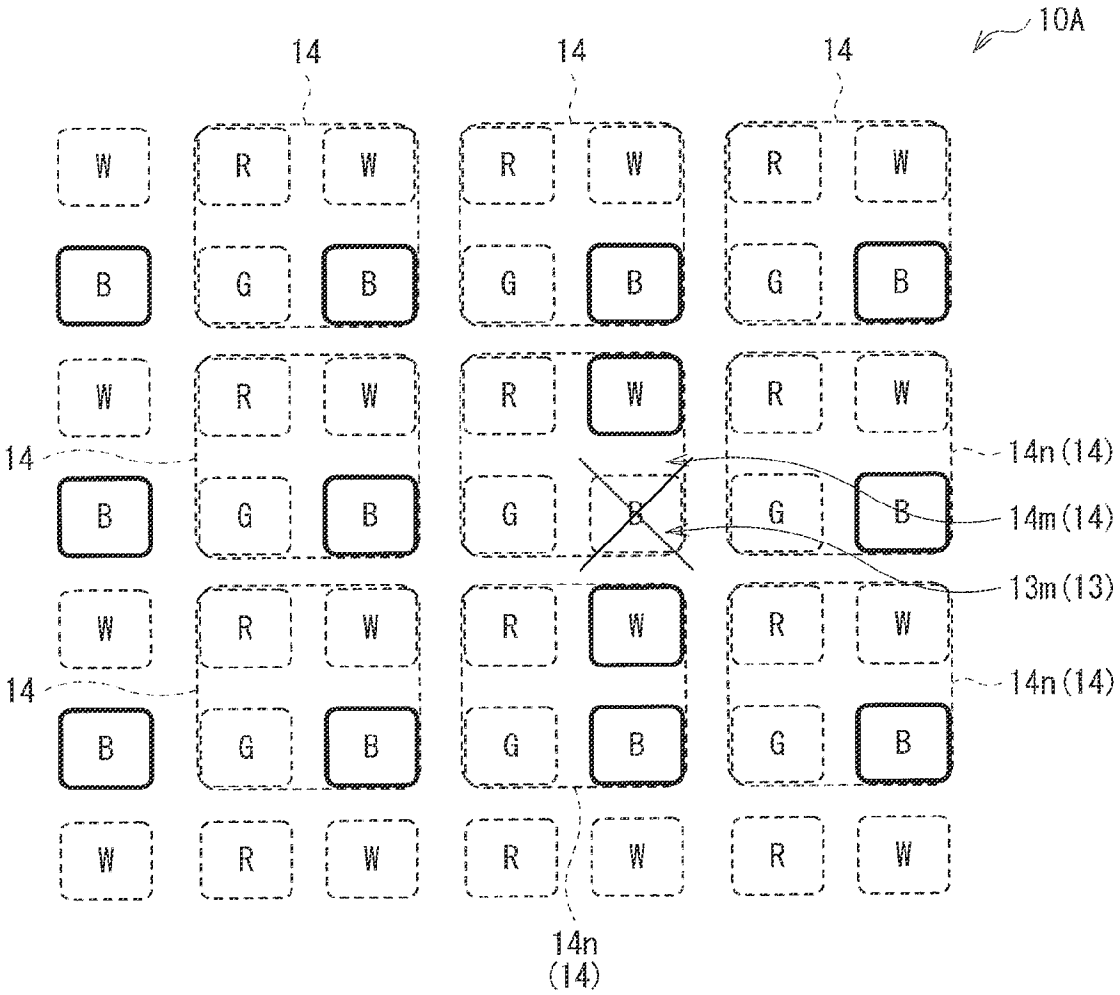
FIG. 19 is a schematic diagram showing as an example how a defect dot correction is carried out when a blue display is performed in a region including a defect dot.

When a position of a defect dot that is indicated by the correction signal 26A is present within a region corresponding to a blue display area, as shown in an example in FIG. 19, the image signal processing circuit 22 performs a correction for the image signal 20A corresponding to two sub-pixels 13W that are adjacent to the defect dot sub-pixel 13*m* to ensure that such two sub-pixels 13W light up at luminance for correcting a defect dot. In concrete terms, when a position of a defect dot that is indicated by the correction signal 26A is present within a region corresponding to a blue display area, for example, the image signal processing circuit 22 performs a correction for the image signal 20A corresponding to two sub-pixels 13W that are adjacent to the defect dot sub-pixel 13*m* to ensure that total luminance of such two sub-pixels 13W attains a magnitude for correcting a defect dot. It is to be noted that the white light is color light derived from the additive color mixing of every color light of three primary colors, and thus a defect dot is corrected using the white light emitted from a surround area of the defect dot sub-pixel 13*m*.

[Operation]

Next, the description is provided on an example of operation for the display unit 1 according to this embodiment of the present disclosure.

On the display unit 1, the signal voltage 23A corresponding to the image signal 20A is applied to each of the data lines DTL by the data line driving circuit 23, and selection pulses in accordance with the control signal 21A are applied sequentially to the plurality of gate lines WSL and drain lines DSL by the gate line driving circuit 24 and the drain line driving circuit 25. This performs on/off control of the pixel circuit 12 in each of the sub-pixels 13 to inject a drive current to the organic EL device 11 in each of the sub-pixels 13. Consequently, hole and electron are recombined to produce the light emission, and the resultant light is taken out to the outside. As a result, an image is displayed at the display region 10A on the display panel 10.

[Advantageous Effects]

Next, the description is provided on advantageous effects of the display unit 1 according to this embodiment of the present disclosure. In this embodiment of the present disclosure, four types of sub-pixels 13 (13R, 13G, 13B, and 13W) that are different from one another in luminescent colors are provided for each of the display pixels 14. When there exists the sub-pixel 13 of a defect dot, this allows a defect dot to be made less visible by applying a compensated pulse for correcting a defect dot to the plurality of sub-pixels 13 adjacent or close to that sub-pixel 13. That is, in this embodiment of the present disclosure, the necessity of modifying the pixel circuit 12 from the existing configuration is eliminated, and a disadvantage that the luminance around a defect dot is only modulated to make a defect dot highly visible as an opposite effect is also avoided. This makes it possible to perform correction for a defect dot without complicating the pixel circuit 12.

2. Second Embodiment

[Configuration]

Figure 20:
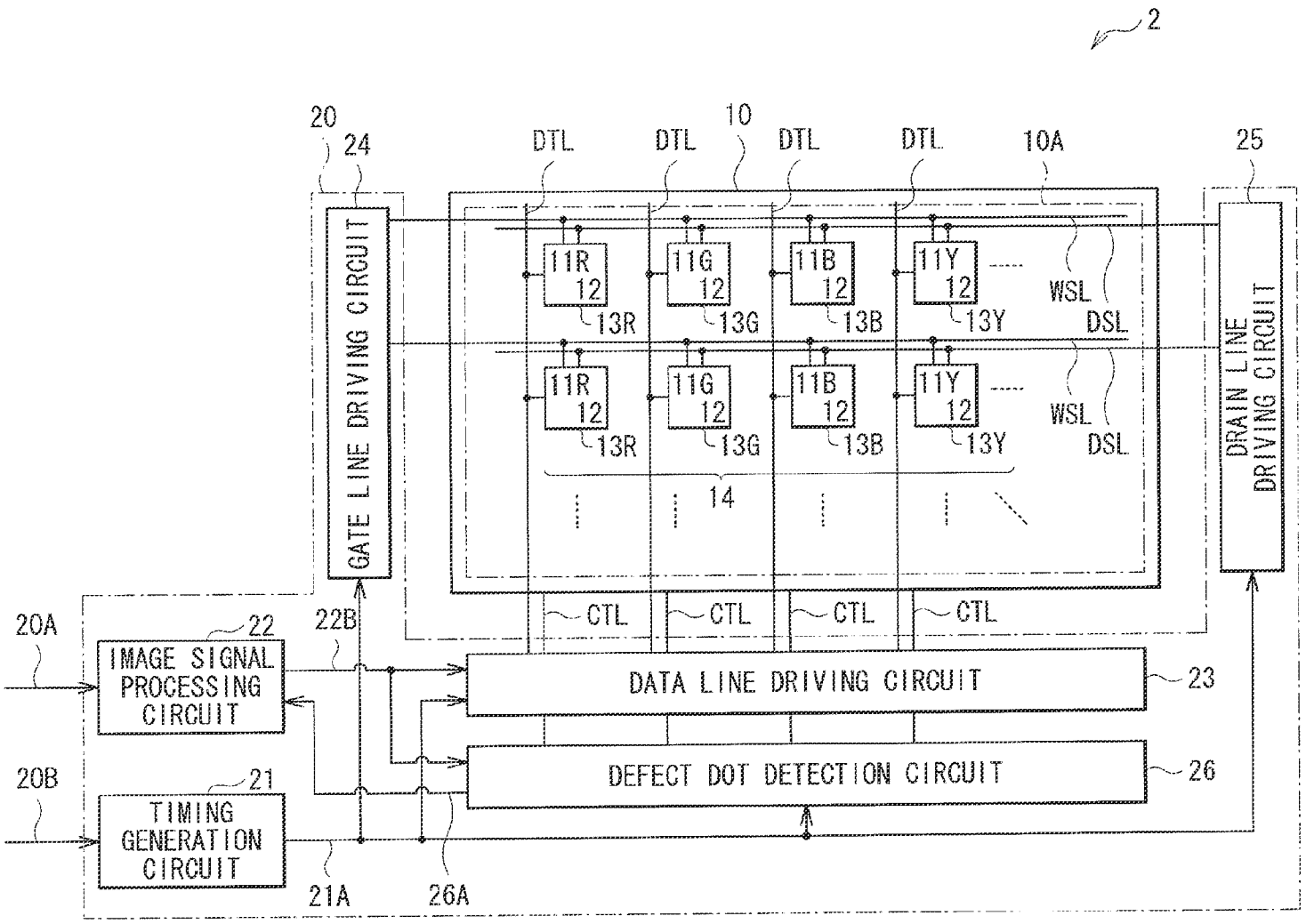
FIG. 20 is a schematic block diagram of a display unit according to a second embodiment of the present disclosure.
Figure 21:
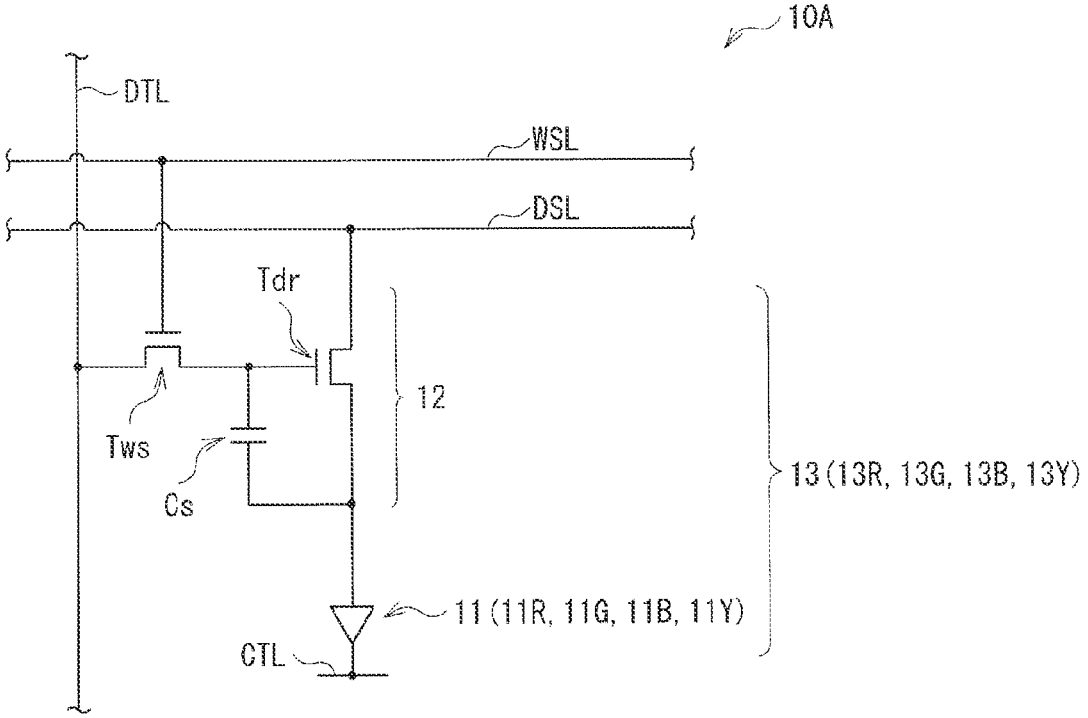
FIG. 21 is a circuit diagram of a sub-pixel illustrated in FIG. 20.
Figure 22:
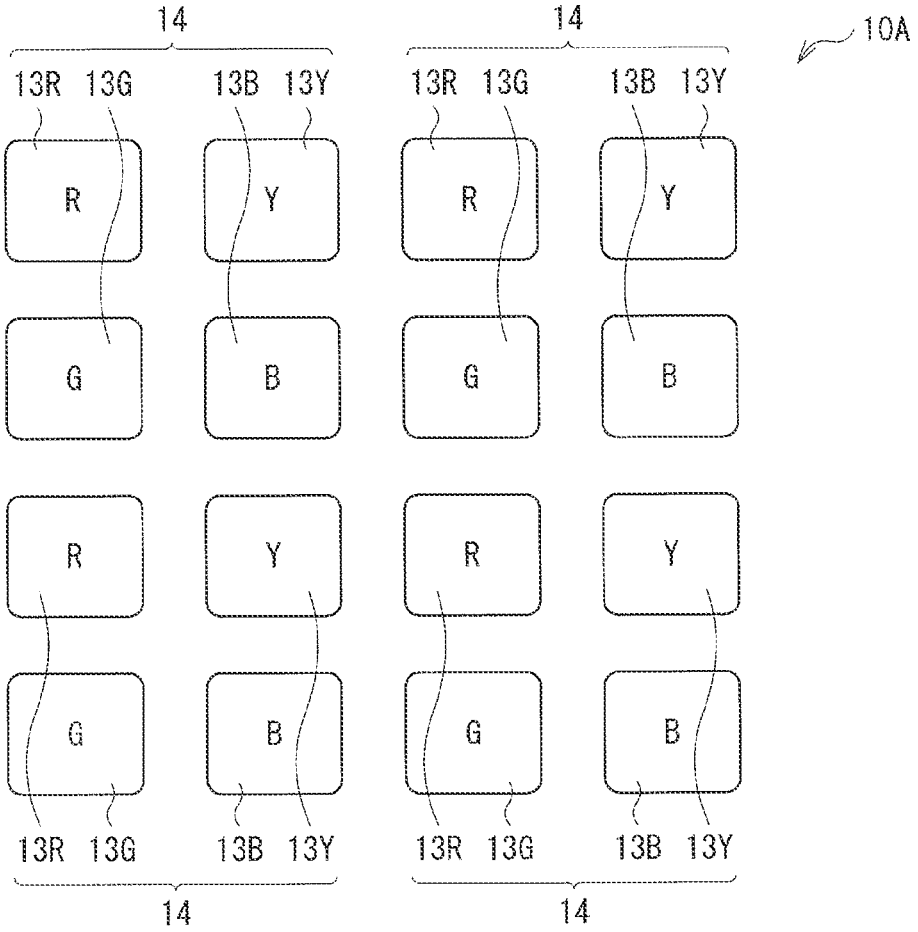
FIG. 22 is a diagram showing an example of layout for the sub-pixel illustrated in FIG. 20.

FIG. 20 shows an example of an overall configuration for a display unit 2 according to a second embodiment of the present disclosure. FIG. 21 shows an example of circuit configuration for a sub-pixel 13 on the display unit 2. FIG. 22 shows an example of layout for a display region 10A on the display unit 2. On the display unit 2, as four types of sub-pixels, each of display pixels 14 has three sub-pixels 13R, 13G, and 13B (first sub-pixels) that emit light of three primary colors individually, as well as a sub-pixel 13Y (second sub-pixel) that emits color light obtained by additive color mixing. In other words, for the display unit 2, the sub-pixel 13W on the display unit 1 is replaced with the sub-pixel 13Y. It is to be noted that differences with the first embodiment are mainly described hereinafter, and the descriptions on the points in common with the first embodiment are omitted as appropriate.

The sub-pixel 13Y is a sub-pixel emitting yellow light that is derived by the additive color mixing of red light and green light among the light of three primary colors. In this embodiment of the present disclosure, the sub-pixels 13R, 13G, 13B, and 13Y are hereinafter collectively referred to as the sub-pixel 13. The sub-pixel 13Y has an organic EL device 11Y emitting yellow light as the organic EL device 11.

(Method of Correcting Defect Dot)

Next, the description is provided on a method of correcting a defect dot using the correction signal 26A. Upon reception of the correction signal 26A indicating positional information of a defect dot from the defect dot detection circuit 26, the image signal processing circuit 22 performs a correction for compensating a defect dot for the image signal 20A corresponding to the plurality of sub-pixels 13 adjacent or close to the sub-pixel 13 of a defect dot. For example, upon reception of the correction signal 26A indicating that a defect dot is present within a monochromatic display region from the defect dot detection circuit 26 in carrying out a monochromatic display using the plurality of sub-pixels 13 at a certain region, the image signal processing circuit 22 performs a correction for compensating a defect dot for the image signal 20A corresponding to the plurality of sub-pixels 13 adjacent or close to the sub-pixel 13 of a defect dot. The data line driving circuit 23 applies the analog signal voltage 23A (pulse) corresponding to the image signal 22A, that is input from the image signal processing circuit 22 and is compensated for correcting a defect dot, to the plurality of sub-pixels 13 adjacent or close to the sub-pixel 13 of a defect dot.

More specifically, upon reception of the correction signal 26A indicating positional information of a defect dot from the defect dot detection circuit 26, the image signal processing circuit 22 performs a correction for the image signal 20A corresponding to the sub-pixels 13 being corrected, to ensure that the total luminance of the plurality of sub-pixels 13 (sub-pixels 13 being corrected) which are adjacent or close to the sub-pixel 13 of a defect dot and to which compensated pulses for correcting a defect dot are applied attains a magnitude for correcting a defect dot. For example, upon reception of the correction signal 26A indicating that a defect dot is present within a monochromatic display region from the defect dot detection circuit 26 in carrying out a monochromatic display using the plurality of sub-pixels 13 at a certain region, the image signal processing circuit 22 performs a correction for the image signal 20A corresponding to the sub-pixels 13 being corrected, to ensure that the total luminance of the plurality of sub-pixels 13 (sub-pixels 13 being corrected) which are adjacent or close to the sub-pixel 13 of a defect dot and to which compensated pulses for correcting a defect dot are applied attains a magnitude for correcting a defect dot. Hereupon, it is preferable that a "magnitude for correcting a defect dot" be a magnitude same or almost same as the luminescence supposed to be obtained by the sub-pixel 13 of a defect dot at the time when this sub-pixel 13 is capable of emitting light.

Figure 23:
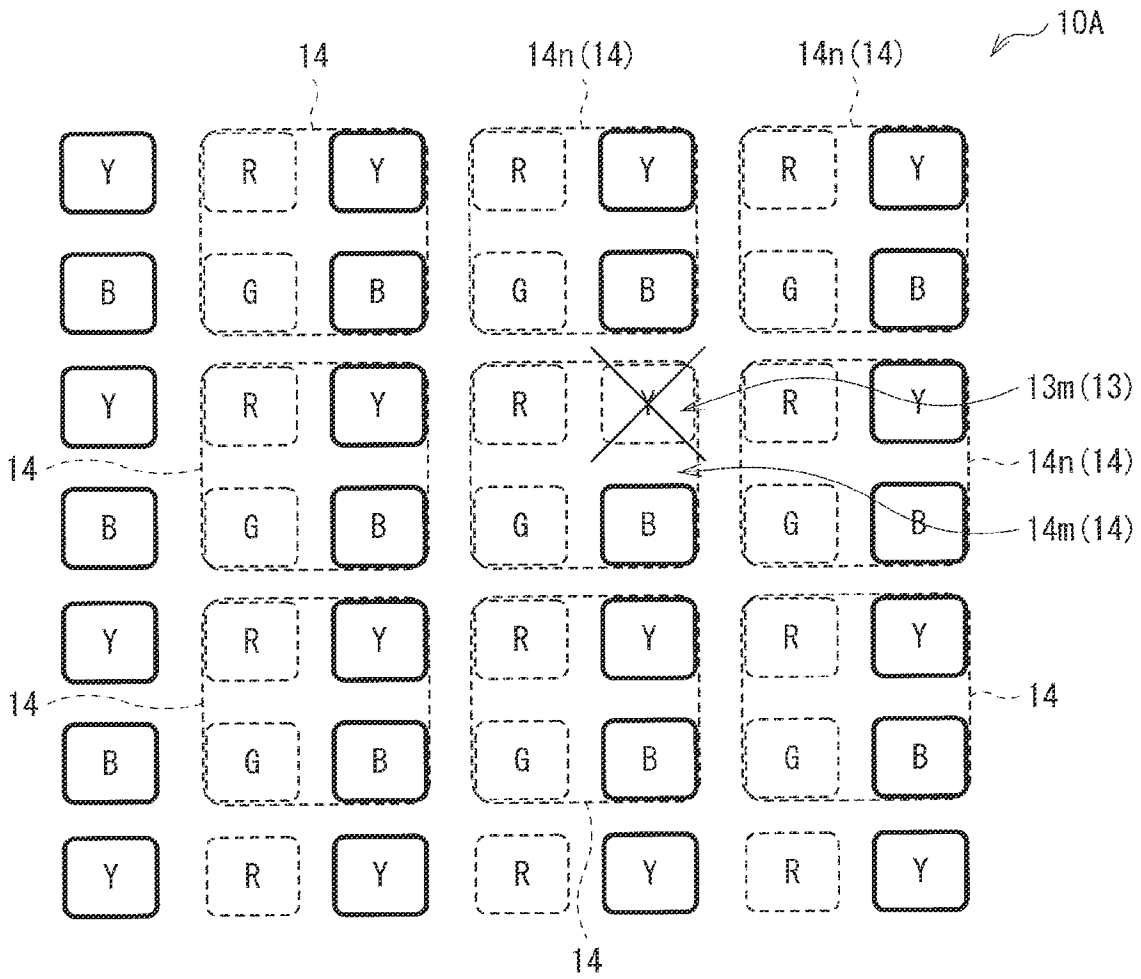
FIG. 23 is a schematic diagram showing how a white display is performed in a region including a defect dot.

FIG. 23 schematically shows a state where each of the sub-pixels 13B and the sub-pixels 13Y is luminescent at a display region including a defect dot when the defect dot is present, and the display region becomes a white display area. When a defect dot as shown in FIG. 23 occurs, a viewer sees a black dot as shown in FIG. 6A as a defect dot. At this time, upon reception of the correction signal 26A indicating positional information of a defect dot from the defect dot detection circuit 26, as shown in an example in FIG. 24, the image signal processing circuit 22 performs a correction for a defect dot for the image signal 20A corresponding to: the sub-pixels 13 included in the display pixel 14 (defect dot pixel 14*m*) containing the sub-pixel 13 (defect dot sub-pixel 13*m*) corresponding to the positional information; and the sub-pixel(s) 13 included in the display pixel(s) 14 (adjacent pixel(s) 14*n*) adjacent to the defect dot sub-pixel 13*m*. Correction for a defect dot makes a black dot invisible from a viewer as shown in FIG. 6B.

Figure 24:
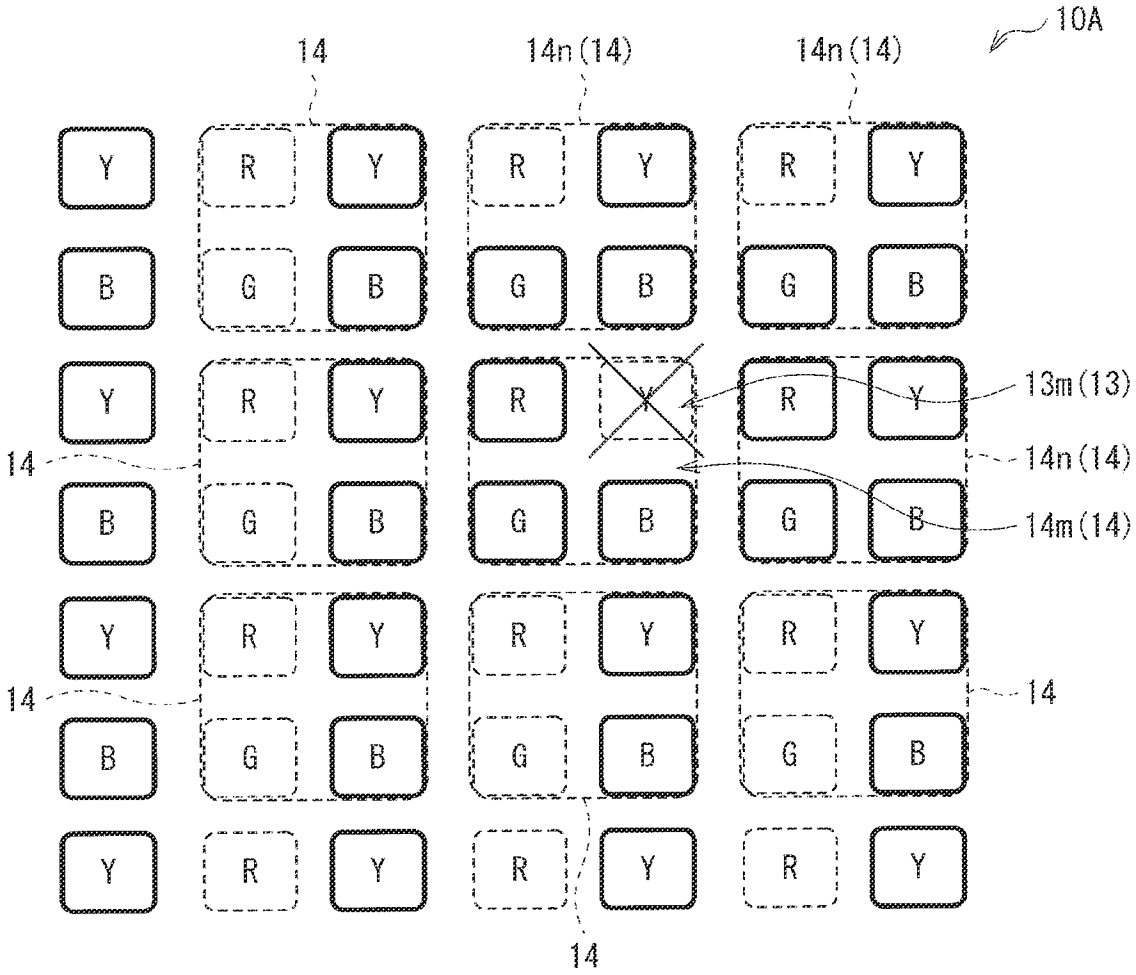
FIG. 24 is a schematic diagram showing as an example how a defect dot correction is carried out when a white display is performed in a region including a defect dot.

When a position of a defect dot that is indicated by the correction signal 26A is present within a region corresponding to a white display area, as shown in an example in FIG. 24, the image signal processing circuit 22 performs a correction for the image signal 20A corresponding to eight sub-pixels 13 surrounding the defect dot sub-pixel 13*m* to ensure that such eight sub-pixels 13 light up at luminance for correcting a defect dot. In concrete terms, when a position of a defect dot that is indicated by the correction signal 26A is present within a region corresponding to a white display area, as shown in an example in FIG. 24, the image signal processing circuit 22 performs a correction for the image signal 20A corresponding to eight sub-pixels 13 surrounding the defect dot sub-pixel 13*m* to ensure that total luminance of such eight sub-pixels 13 attains a magnitude for correcting a defect dot.

Meanwhile, eight sub-pixels 13 surrounding the defect dot sub-pixel 13*m* are composed of the sub-pixels 13R, 13G, and 13B that individually emit color light (red, green, and blue) included in the light of three primary colors, and more specifically, are composed of two sub-pixels 13R, four sub-pixels 13G, and two sub-pixels 13B. From a surrounding area of the defect dot sub-pixel 13*m*, therefore, color light (that is, white light) is generated that is derived by the additive color mixing of light emitted from eight sub-pixels 13 as described above. As a result, a defect dot is corrected using the white light emitted from a surrounding area of the defect dot sub-pixel 13*m*.

It is to be noted that, when a position of a defect dot that is indicated by the correction signal 26A is present within a region corresponding to a white display area, the image signal processing circuit 22 may perform a correction only for the image signal 20A corresponding to some of eight sub-pixels 13 surrounding the defect dot sub-pixel 13*m*, in a manner similar to that of each of the examples illustrated in FIGS. 8 to 13.

Figure 25:
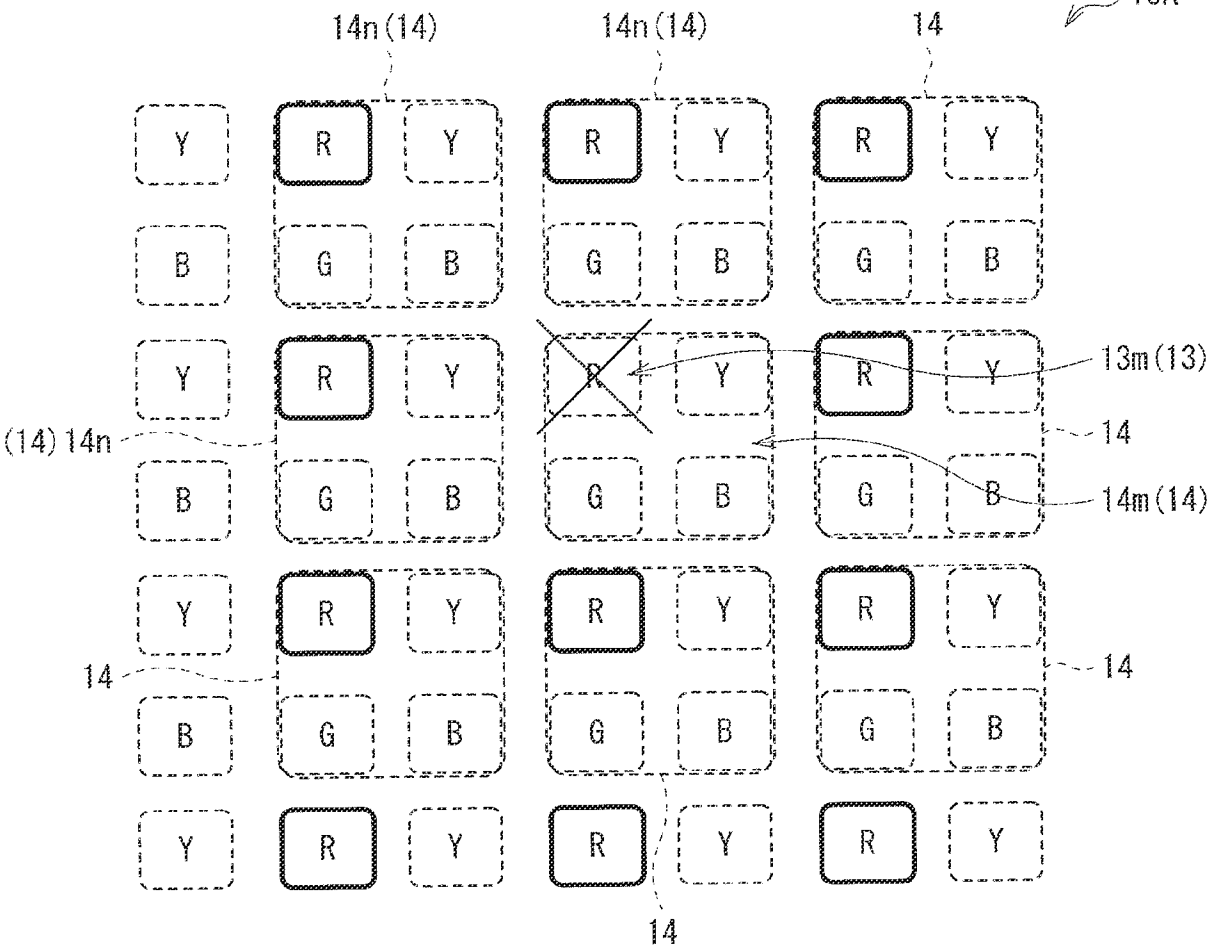
FIG. 25 is a schematic diagram showing how a red display is performed in a region including a defect dot.

FIG. 25 schematically shows a state where each of the sub-pixels 13R is luminescent at a display region including a defect dot when the defect dot is present, and the display region becomes a red display area. When a defect dot as shown in FIG. 25 occurs, a viewer sees a black dot as shown in FIG. 6A as a defect dot. At this time, upon reception of the correction signal 26A indicating positional information of a defect dot from the defect dot detection circuit 26, as shown in an example in FIG. 26, the image signal processing circuit 22 performs a correction for a defect dot for the image signal 20A corresponding to: the sub-pixel 13Y included in the defect dot pixel 14*m*; and the sub-pixel 13Y that is included in the adjacent pixel 14*n* and that is adjacent to the defect dot sub-pixel 13*m*. Correction for a defect dot makes a black dot invisible from a viewer as shown in FIG. 6B. It is to be noted that two sub-pixels 13Y to be corrected are sub-pixels that emit color light (yellow light) derived from the additive color mixing.

Figure 26:
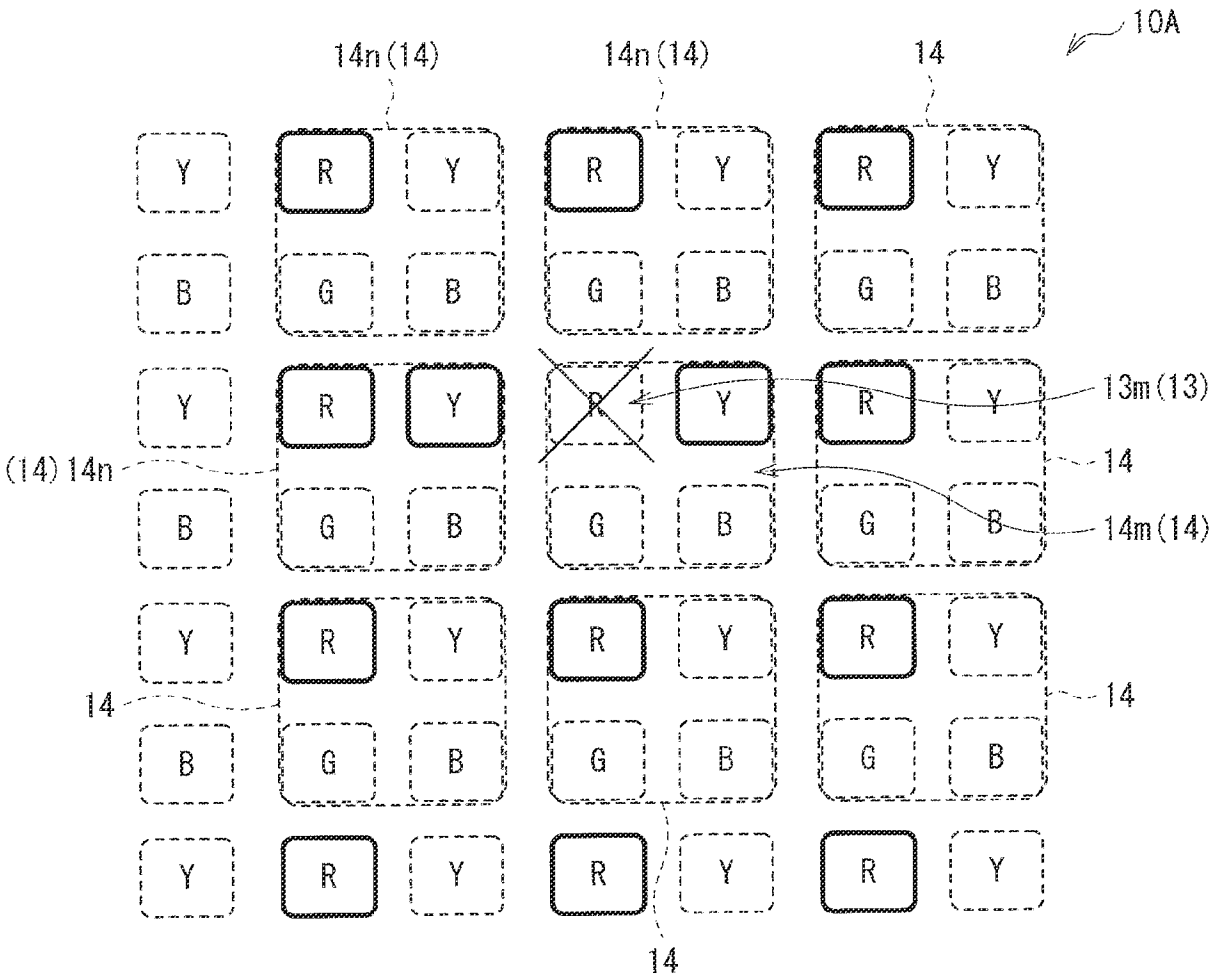
FIG. 26 is a schematic diagram showing as an example how a defect dot correction is carried out when a red display is performed in a region including a defect dot.

When a position of a defect dot that is indicated by the correction signal 26A is present within a region corresponding to a red display area, as shown in an example in FIG. 26, the image signal processing circuit 22 performs a correction for the image signal 20A corresponding to two sub-pixels 13Y that are adjacent to the defect dot sub-pixel 13*m* to ensure that such two sub-pixels 13Y light up at luminance for correcting a defect dot. In concrete terms, when a position of a defect dot that is indicated by the correction signal 26A is present within a region corresponding to a red display area, for example, the image signal processing circuit 22 performs a correction for the image signal 20A corresponding to two sub-pixels 13Y that are adjacent to the defect dot sub-pixel 13*m* to ensure that total luminance of such two sub-pixels 13Y attains a magnitude for correcting a defect dot. It is to be noted that the yellow light is color light derived from the additive color mixing of red light and green light among the light of three primary colors, and thus a defect dot is corrected using the yellow light emitted from a surround area of the defect dot sub-pixel 13*m*.

Figure 27:
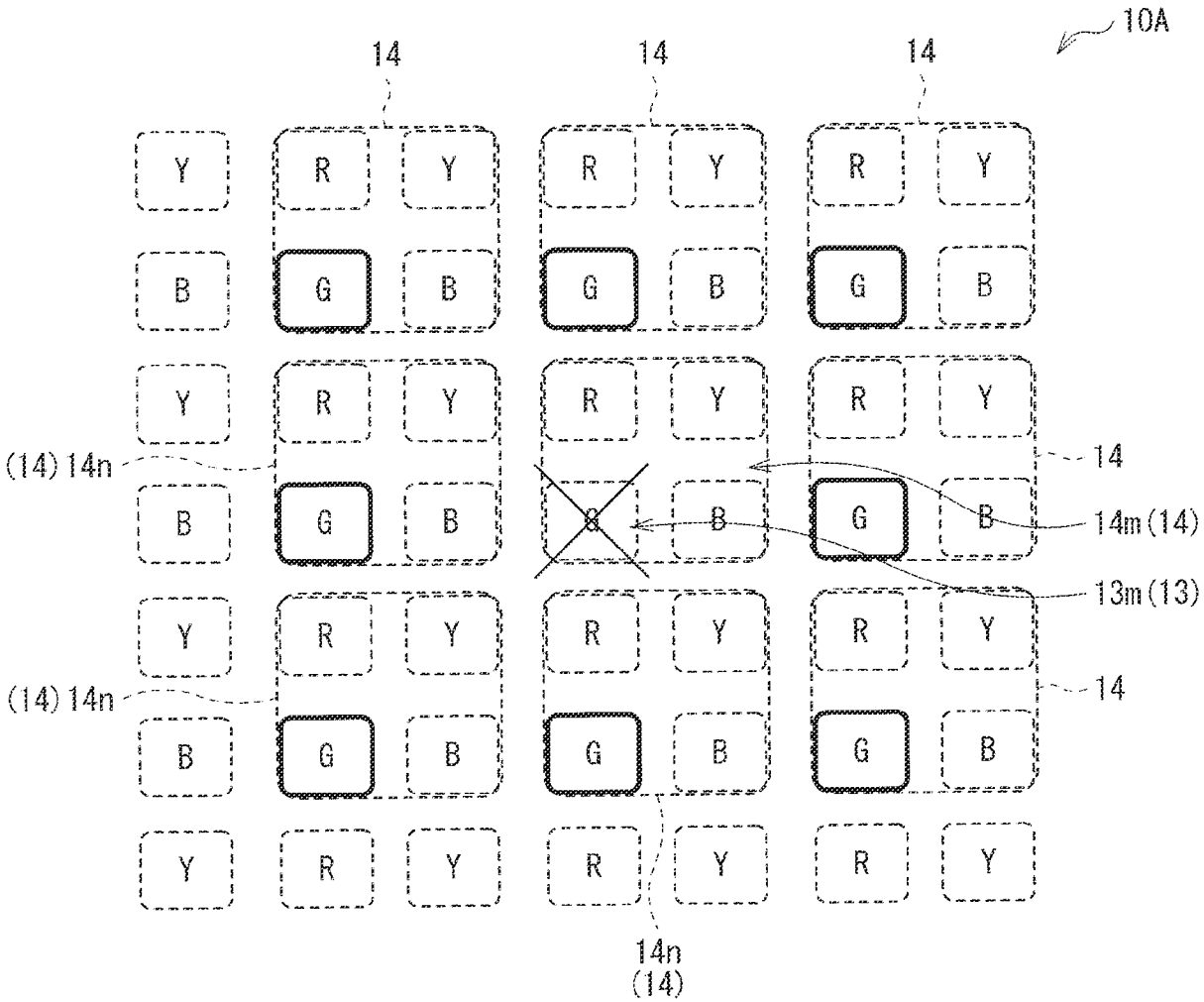
FIG. 27 is a schematic diagram showing how a green display is performed in a region including a defect dot.

FIG. 27 schematically shows a state where each of the sub-pixels 13G is luminescent at a display region including a defect dot when the defect dot is present, and the display region becomes a green display area. When a defect dot as shown in FIG. 27 occurs, a viewer sees a black dot as shown in FIG. 6A as a defect dot. At this time, upon reception of the correction signal 26A indicating positional information of a defect dot from the defect dot detection circuit 26, as shown in an example in FIG. 28, the image signal processing circuit 22 performs a correction for a defect dot for the image signal 20A corresponding to: the sub-pixel 13Y included in the defect dot pixel 14*m*; and the sub-pixels 13Y each included in three display pixels 14 (adjacent pixels 14*n*) that are adjacent to the defect dot sub-pixel 13*m*. Correction for a defect dot makes a black dot invisible from a viewer as shown in FIG. 6B. It is to be noted that four sub-pixels 13Y to be corrected are sub-pixels that emit color light (yellow light) derived from the additive color mixing.

Figure 28:
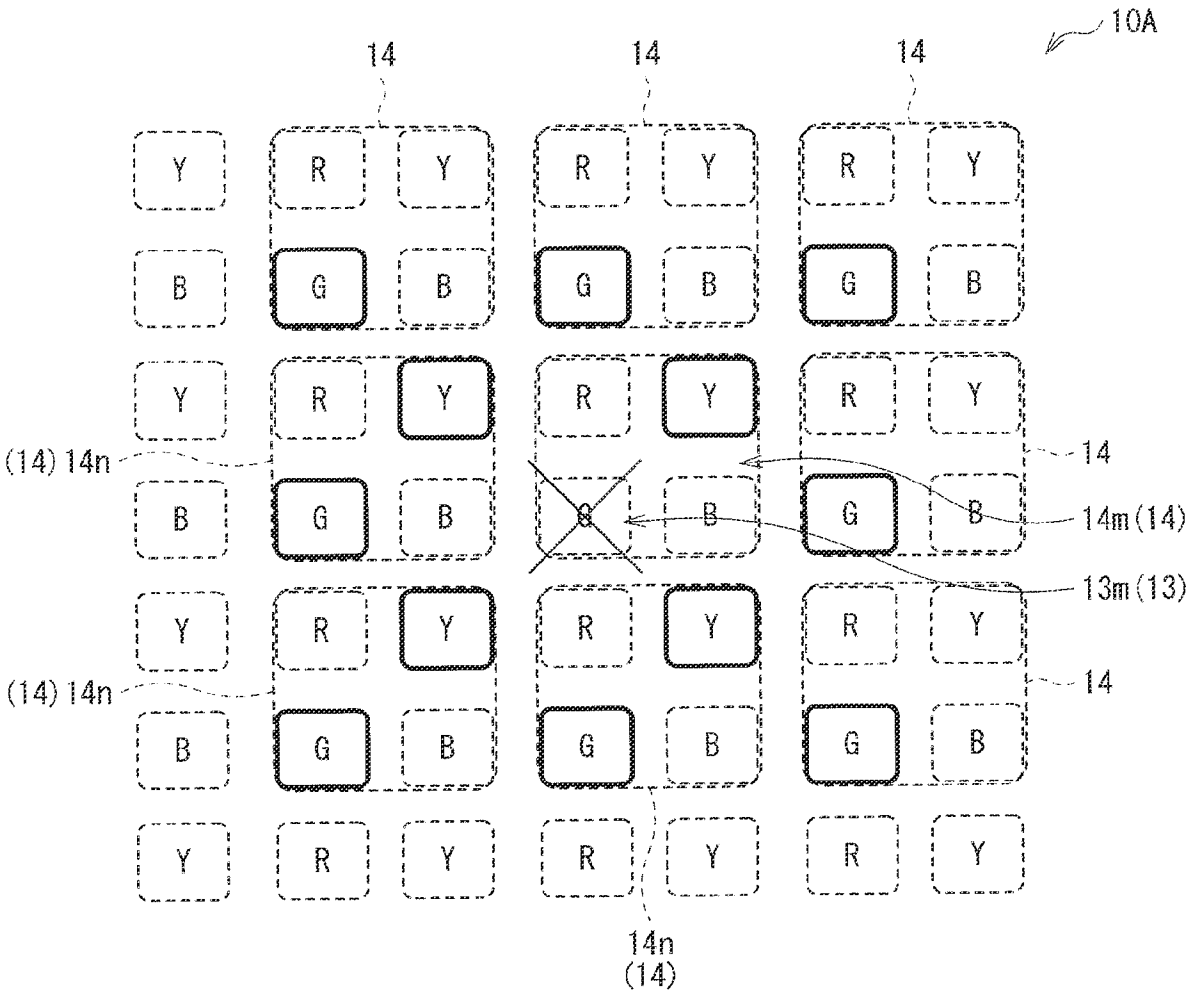
FIG. 28 is a schematic diagram showing as an example how a defect dot correction is carried out when a green display is performed in a region including a defect dot.

When a position of a defect dot that is indicated by the correction signal 26A is present within a region corresponding to a green display area, as shown in an example in FIG. 28, the image signal processing circuit 22 performs a correction for the image signal 20A corresponding to four sub-pixels 13Y that are adjacent to the defect dot sub-pixel 13*m* to ensure that such four sub-pixels 13Y light up at luminance for correcting a defect dot. In concrete terms, when a position of a defect dot that is indicated by the correction signal 26A is present within a region corresponding to a green display area, for example, the image signal processing circuit 22 performs a correction for the image signal 20A corresponding to four sub-pixels 13Y that are adjacent to the defect dot sub-pixel 13*m* to ensure that total luminance of such four sub-pixels 13Y attains a magnitude for correcting a defect dot. It is to be noted that the yellow light is color light derived from the additive color mixing of red light and green light among the light of three primary colors, and thus a defect dot is corrected using the yellow light emitted from a surround area of the defect dot sub-pixel 13*m*.

[Advantageous Effects]

Next, the description is provided on advantageous effects of the display unit 2 according to this embodiment of the present disclosure. In this embodiment of the present disclosure, four types of sub-pixels 13 (13R, 13G, 13B, and 13Y) that are different from one another in luminescent colors are provided for each of the display pixels 14. When there exists the sub-pixel 13 of a defect dot, this allows a defect dot to be made less visible by applying a compensated pulse for correcting a defect dot to the plurality of sub-pixels 13 adjacent or close to that sub-pixel 13. That is, in this embodiment of the present disclosure, the necessity of modifying the pixel circuit 12 from the existing configuration is eliminated, and a disadvantage that the luminance around a defect dot is only modulated to make a defect dot highly visible as an opposite effect is also avoided. This makes it possible to perform correction for a defect dot without complicating the pixel circuit 12.

3. Modification Examples

[First Modification Example]

Figure 29:
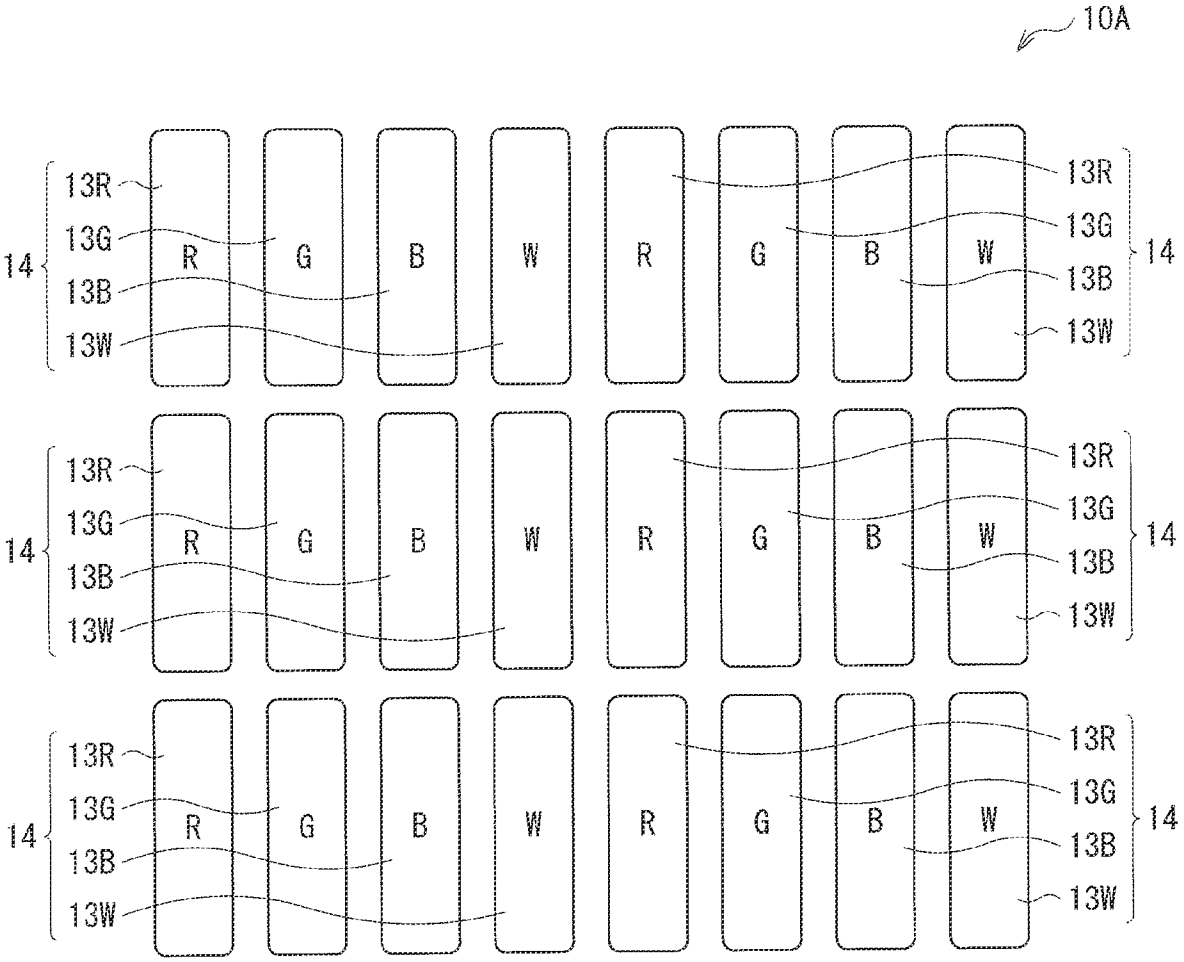
FIG. 29 is a diagram showing a modification example of layout for the sub-pixel illustrated in FIG. 1.

In the first embodiment of the present disclosure, the plurality of display pixels 14 included in the display panel 10 are arranged in a tiled array, although may be arranged in any other forms. For example, as shown in FIG. 29, the plurality of display pixels 14 may be arranged two-dimensionally in a row direction and a column direction, and the plurality of sub-pixels 13 may be arranged in a row direction in each of the display pixels 14. In other words, the plurality of sub-pixels 13 included in the display panel 10 may be arrayed in a stripe arrangement.

(Method of Correcting Defect Dot)

Next, the description is provided on a method of correcting a defect dot using the correction signal 26A. Upon reception of the correction signal 26A indicating positional information of a defect dot from the defect dot detection circuit 26 (that is, when the sub-pixel 13 of a defect dot is present), the image signal processing circuit 22 performs a correction for compensating a defect dot for the image signal 20A corresponding to the plurality of sub-pixels 13 that interpose the sub-pixel 13 of a defect dot therebetween in a row direction. For example, upon reception of the correction signal 26A indicating that a defect dot is present within a monochromatic display region from the defect dot detection circuit 26 in carrying out a monochromatic display using the plurality of sub-pixels 13 at a certain region, the image signal processing circuit 22 performs a correction for compensating a defect dot for the image signal 20A corresponding to the plurality of sub-pixels 13 that are adjacent or close to the sub-pixel 13 of a defect dot in a row direction. The data line driving circuit 23 applies the analog signal voltage 23A (pulse) corresponding to the image signal 22A, that is input from the image signal processing circuit 22 and is compensated for correcting a defect dot, to the plurality of sub-pixels 13 that are adjacent or close to the sub-pixel 13 of a defect dot in a row direction.

More specifically, upon reception of the correction signal 26A indicating positional information of a defect dot from the defect dot detection circuit 26, the image signal processing circuit 22 performs a correction for the image signal 20A corresponding to the sub-pixels 13 being corrected, to ensure that the total luminance of the plurality of sub-pixels 13 (sub-pixels 13 being corrected) which are adjacent or close to the sub-pixel 13 of a defect dot in a row direction and to which compensated pulses for correcting a defect dot are applied attains a magnitude for correcting a defect dot. For example, upon reception of the correction signal 26A indicating that a defect dot is present within a monochromatic display region from the defect dot detection circuit 26 in carrying out a monochromatic display using the plurality of sub-pixels 13 at a certain region, the image signal processing circuit 22 performs a correction for the image signal 20A corresponding to the sub-pixels 13 being corrected, to ensure that the total luminance of the plurality of sub-pixels 13 (sub-pixels 13 being corrected) which are adjacent or close to the sub-pixel 13 of a defect dot in a row direction and to which compensated pulses for correcting a defect dot are applied attains a magnitude for correcting a defect dot. Hereupon, it is preferable that a "magnitude for correcting a defect dot" be a magnitude same or almost same as the luminescence supposed to be obtained by the sub-pixel 13 of a defect dot at the time when this sub-pixel 13 is capable of emitting light.

Figure 30:
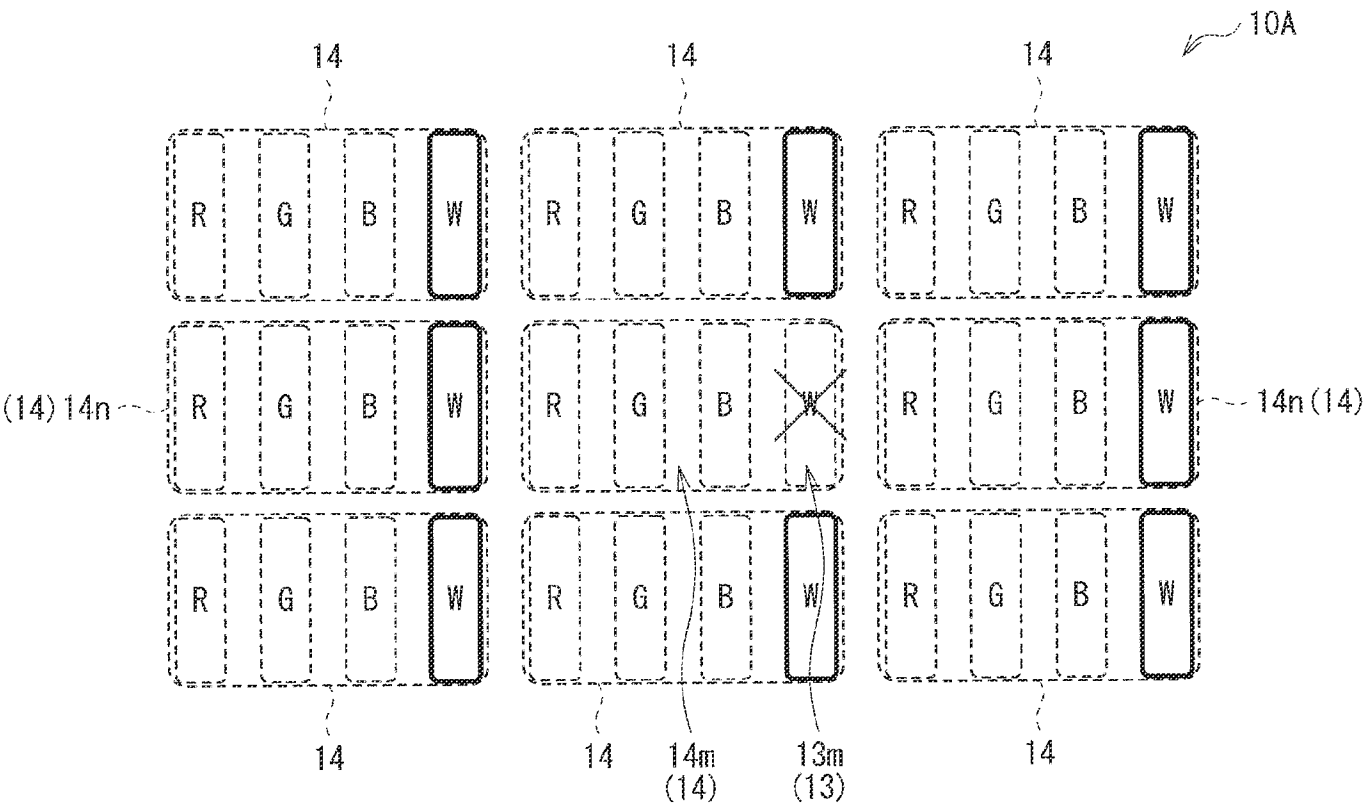
FIG. 30 is a schematic diagram showing how a white display is performed in a region including a defect dot.
Figure 31:
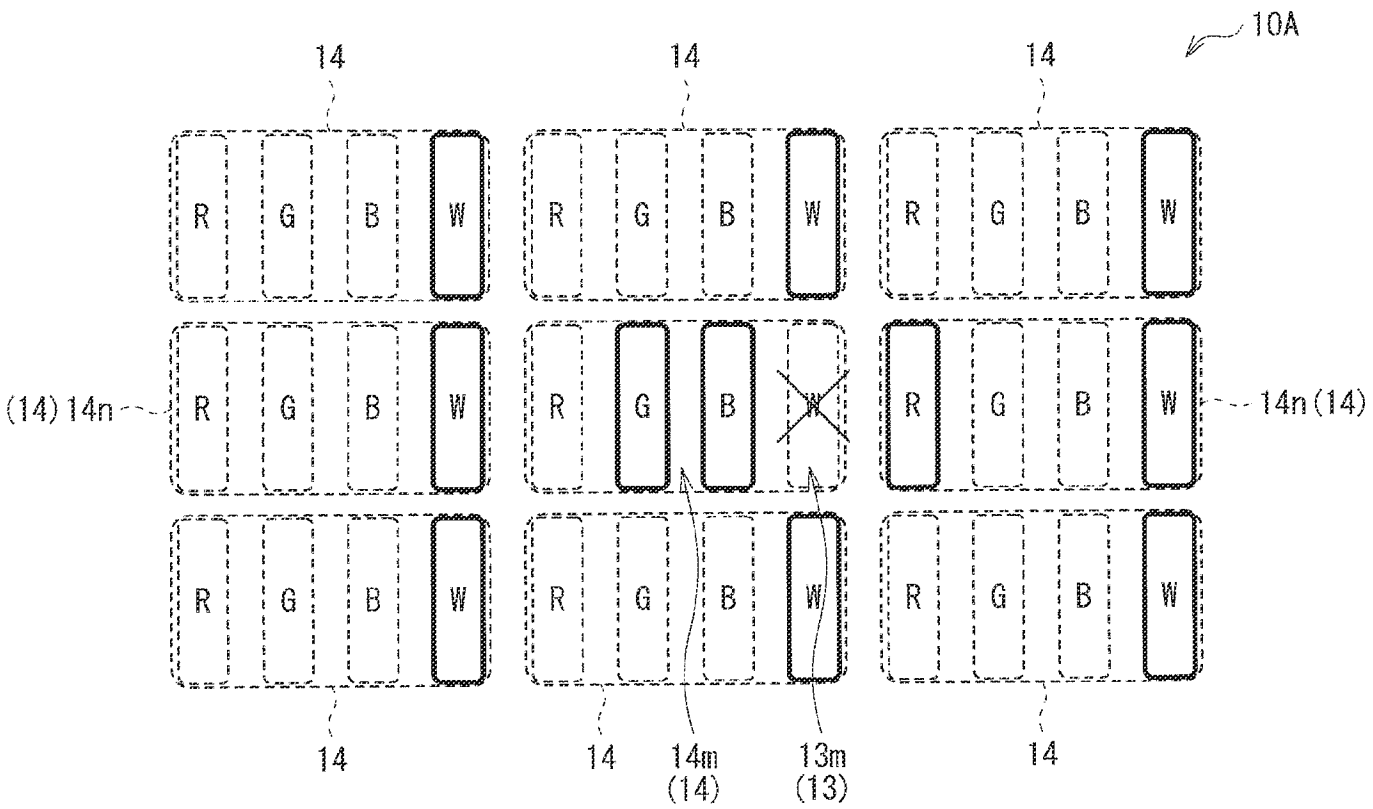
FIG. 31 is a schematic diagram showing as an example how a defect dot correction is carried out when a white display is performed in a region including a defect dot.
Figure 32:
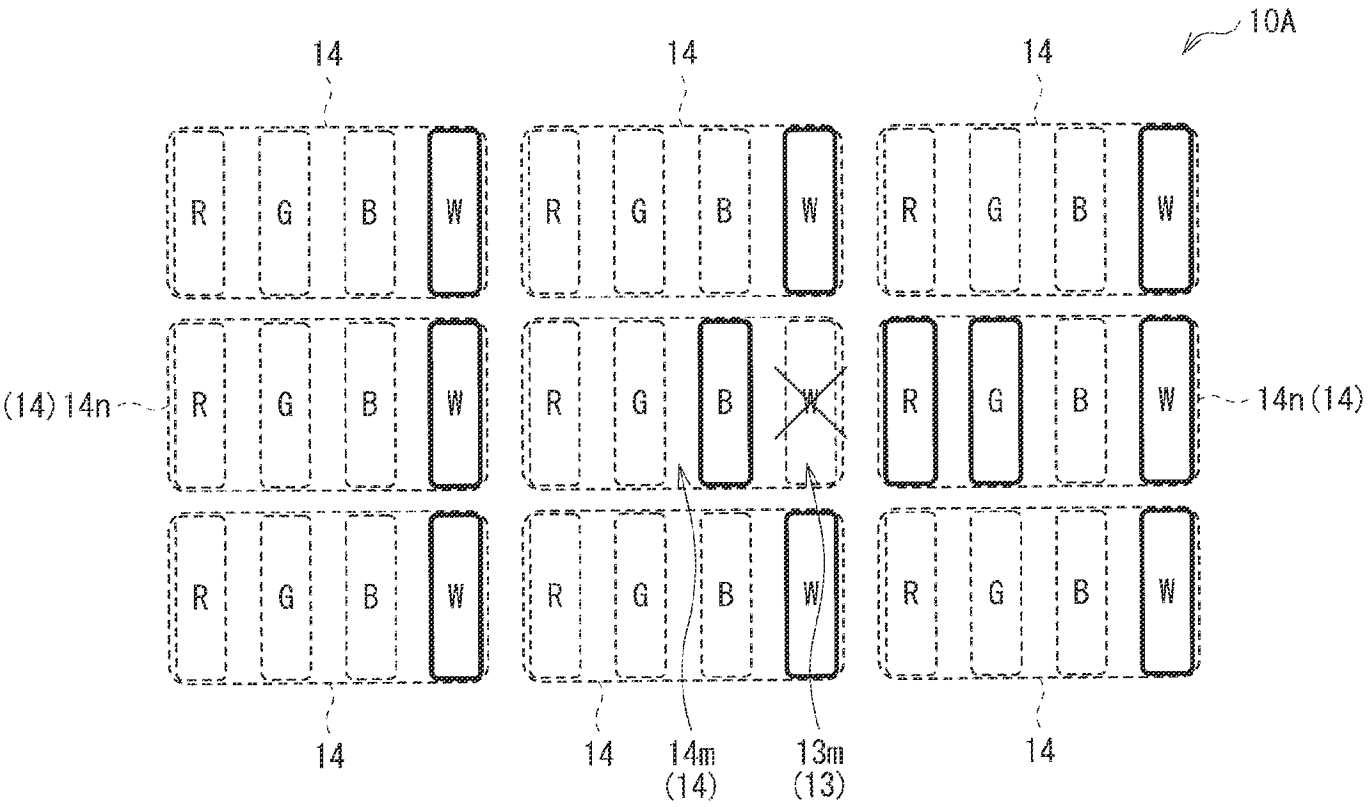
FIG. 32 is a schematic diagram showing as another example how a defect dot correction is carried out when a white display is performed in a region including a defect dot.

FIG. 30 schematically shows a state where each of the sub-pixels 13W is luminescent at a display region including a defect dot when the defect dot is present, and the display region becomes a white display area. When a defect dot as shown in FIG. 30 occurs, a viewer sees a black dot as shown in FIG. 6A as a defect dot. At this time, upon reception of the correction signal 26A indicating positional information of a defect dot from the defect dot detection circuit 26, as shown in FIG. 31 and FIG. 32 for example, the image signal processing circuit 22 performs a correction for a defect dot for the image signal 20A corresponding to: the sub-pixels 13 included in the display pixel 14 (defect dot pixel 14*m*) containing the sub-pixel 13 (defect dot sub-pixel 13*m*) corresponding to the positional information; and the sub-pixels 13 included in the display pixel 14 (adjacent pixel 14*n*) that is adjacent or close to the defect dot sub-pixel 13*m* in a row direction. Correction for a defect dot makes a black dot invisible from a viewer as shown in FIG. 6B.

When a position of a defect dot that is indicated by the correction signal 26A is present within a region corresponding to a white display area, as shown in FIG. 31 and FIG. 32 for example, the image signal processing circuit 22 performs a correction for the image signal 20A corresponding to three sub-pixels 13 that interpose the defect dot sub-pixel 13*m* therebetween in a row direction to ensure that such three sub-pixels 13 light up at luminance for correcting a defect dot. In concrete terms, when a position of a defect dot that is indicated by the correction signal 26A is present within a region corresponding to a white display area, as shown in FIG. 31 and FIG. 32 for example, the image signal processing circuit 22 performs a correction for the image signal 20A corresponding to three sub-pixels 13 that interpose the defect dot sub-pixel 13*m* therebetween in a row direction to ensure that total luminance of such three sub-pixels 13 attains a magnitude for correcting a defect dot.

Meanwhile, three sub-pixels 13 to be corrected are composed of the sub-pixels 13R, 13G, and 13B that individually emit color light (red, green, and blue) included in the light of three primary colors, and more specifically, are composed of one sub-pixel 13R, one sub-pixel 13G, and one sub-pixel 13B. From a surrounding area of the defect dot sub-pixel 13*m*, therefore, color light (that is, white light) is generated that is derived by the additive color mixing of light emitted from three sub-pixels 13 as described above. As a result, a defect dot is corrected using the white light emitted from a surrounding area of the defect dot sub-pixel 13*m*.

Figure 33:
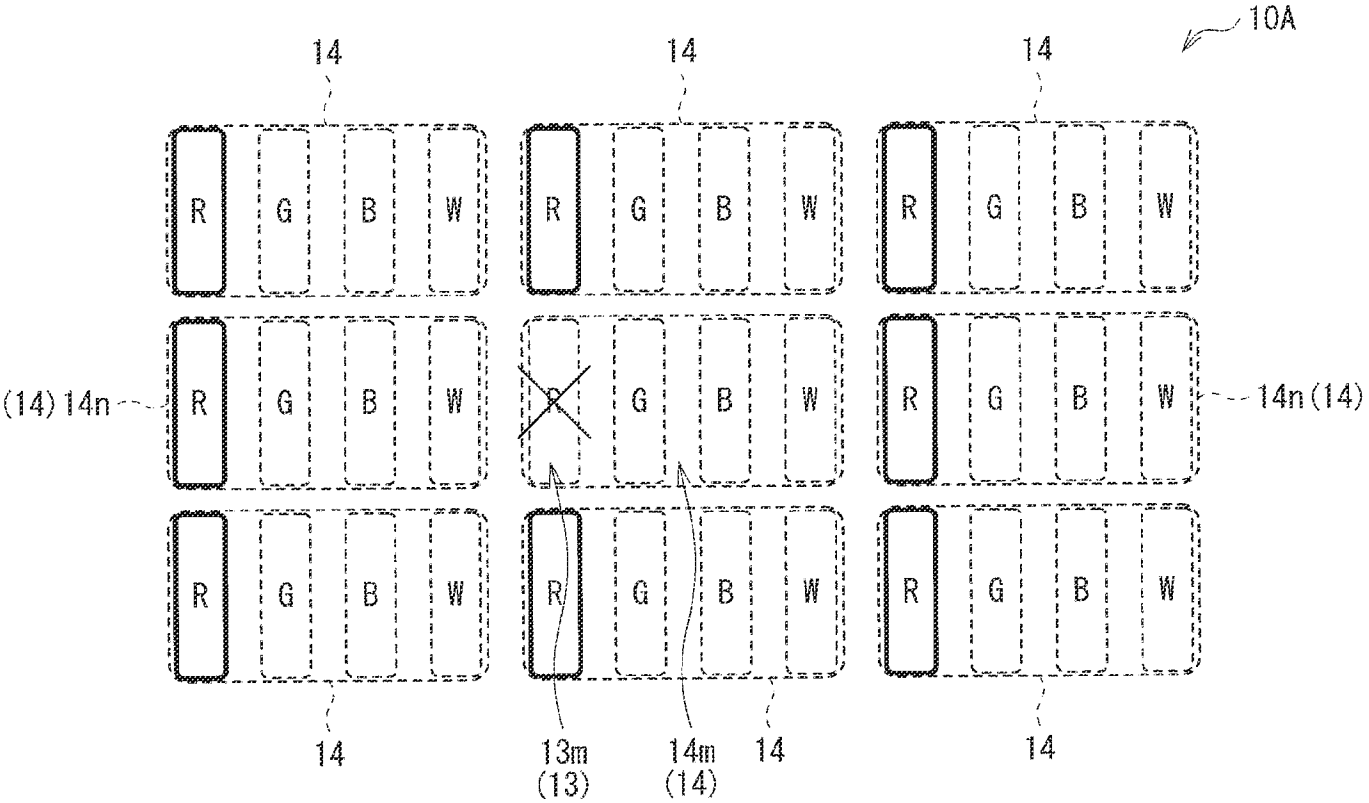
FIG. 33 is a schematic diagram showing how a red display is performed in a region including a defect dot.

FIG. 33 schematically shows a state where each of the sub-pixels 13R is luminescent at a display region including a defect dot when the defect dot is present, and the display region becomes a red display area. When a defect dot as shown in FIG. 33 occurs, a viewer sees a black dot as shown in FIG. 6A as a defect dot. At this time, upon reception of the correction signal 26A indicating positional information of a defect dot from the defect dot detection circuit 26, as shown in an example in FIG. 34, the image signal processing circuit 22 performs a correction for a defect dot for the image signal 20A corresponding to: the sub-pixel 13W included in the defect dot pixel 14*m*; and the sub-pixel 13W that is included in one display pixel 14 (adjacent pixel 14*n*) adjacent to the defect dot sub-pixel 13*m* in a row direction and that is adjacent to the defect dot sub-pixel 13*m*. Correction for a defect dot makes a black dot invisible from a viewer as shown in FIG. 6B. It is to be noted that two sub-pixels 13W to be corrected are sub-pixels that emit color light (white light) derived from the additive color mixing.

Figure 34:
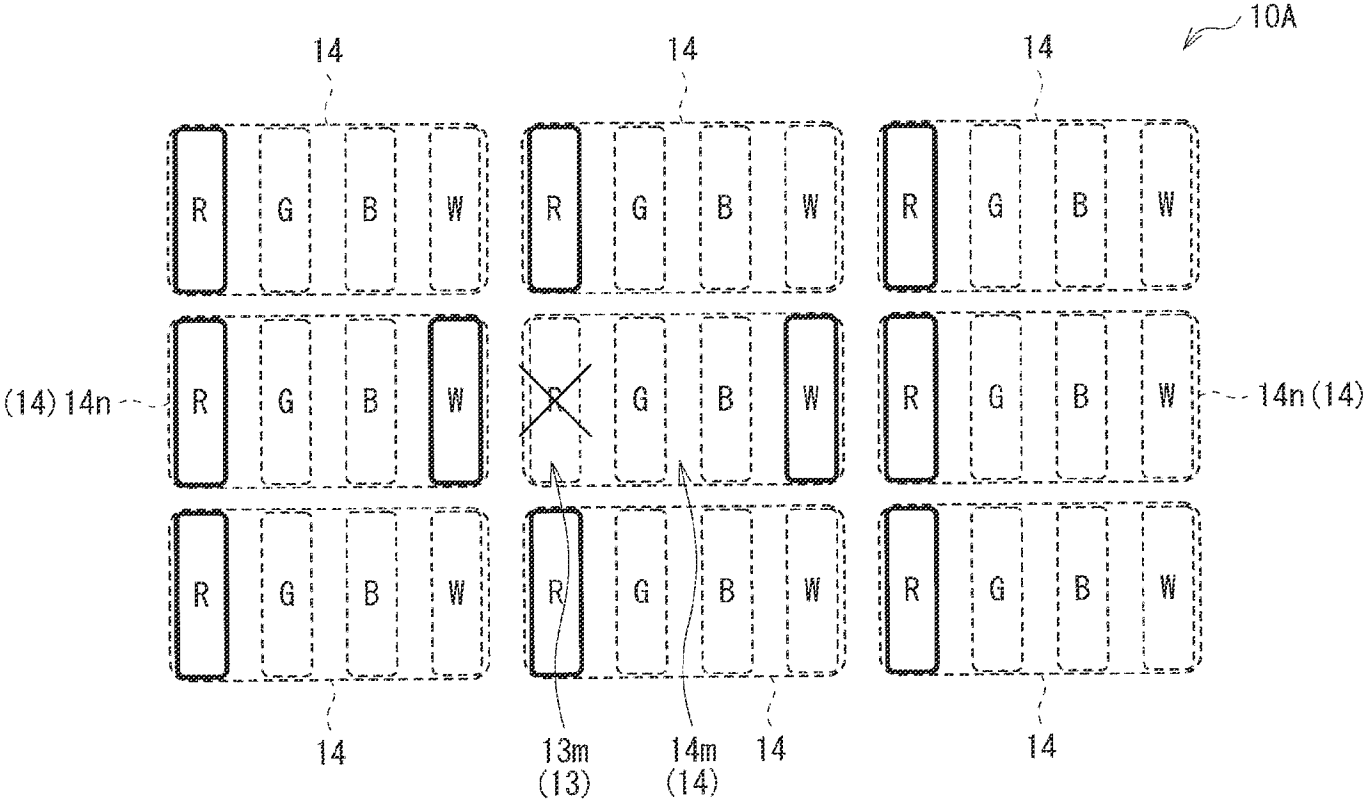
FIG. 34 is a schematic diagram showing as an example how a defect dot correction is carried out when a red display is performed in a region including a defect dot.

When a position of a defect dot that is indicated by the correction signal 26A is present within a region corresponding to a red display area, as shown in an example in FIG. 34, the image signal processing circuit 22 performs a correction for the image signal 20A corresponding to two sub-pixels 13W that interpose the defect dot sub-pixel 13*m* therebetween in a row direction to ensure that such two sub-pixels 13W light up at luminance for correcting a defect dot. In concrete terms, when a position of a defect dot that is indicated by the correction signal 26A is present within a region corresponding to a red display area, for example, the image signal processing circuit 22 performs a correction for the image signal 20A corresponding to two sub-pixels 13W that interpose the defect dot sub-pixel 13*m* therebetween in a row direction to ensure that total luminance of such two sub-pixels 13W attains a magnitude for correcting a defect dot. It is to be noted that the white light is color light derived from the additive color mixing of every light of three primary colors, and thus a defect dot is corrected using the white light emitted from a surround area of the defect dot sub-pixel 13*m*.

Figure 35:
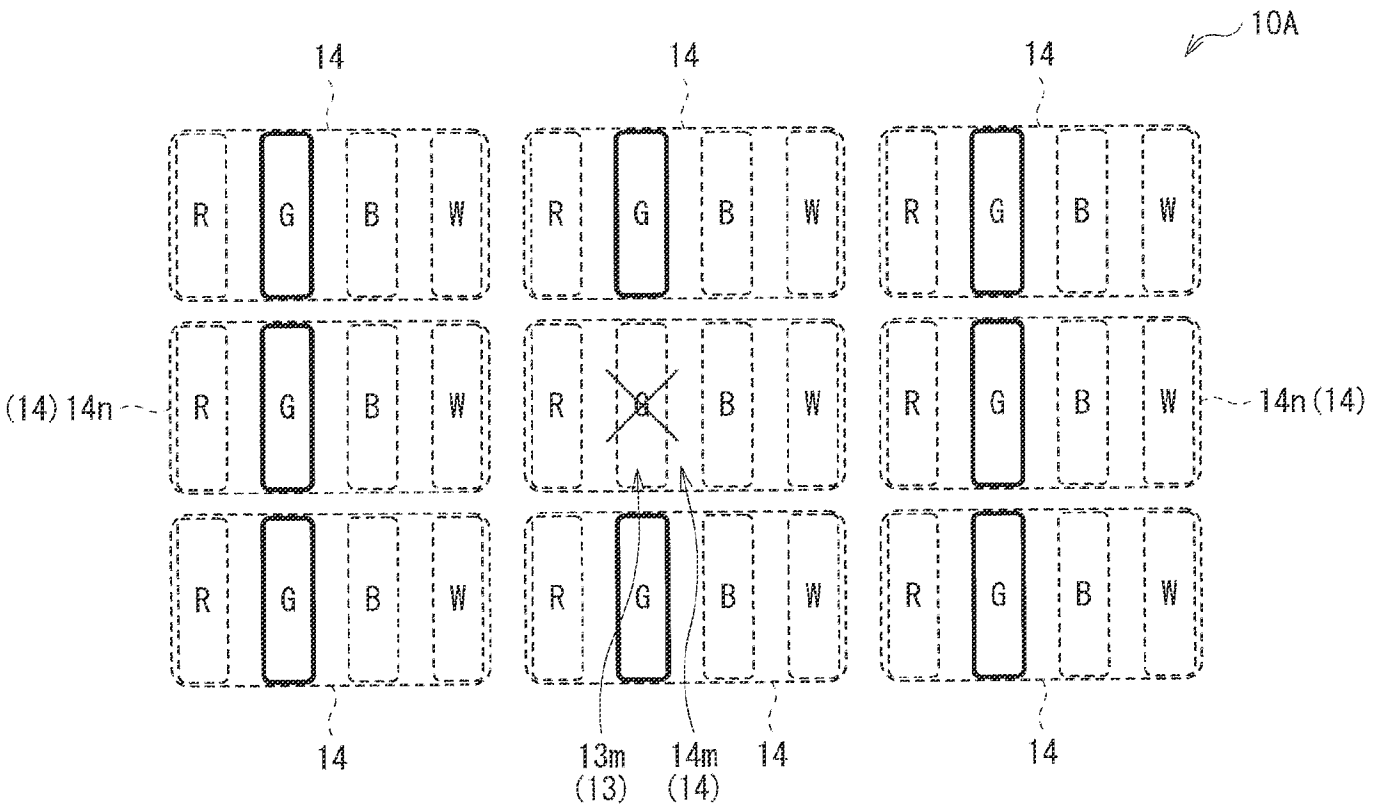
FIG. 35 is a schematic diagram showing how a green display is performed in a region including a defect dot.

FIG. 35 schematically shows a state where each of the sub-pixels 13G is luminescent at a display region including a defect dot when the defect dot is present, and the display region becomes a green display area. When a defect dot as shown in FIG. 35 occurs, a viewer sees a black dot as shown in FIG. 6A as a defect dot. At this time, upon reception of the correction signal 26A indicating positional information of a defect dot from the defect dot detection circuit 26, as shown in an example in FIG. 36, the image signal processing circuit 22 performs a correction for a defect dot for the image signal 20A corresponding to: the sub-pixel 13W included in the defect dot pixel 14*m*; and the sub-pixel 13W included in one display pixel 14 (adjacent pixel 14*n*) that is adjacent to the defect dot sub-pixel 13*m* in a row direction. Correction for a defect dot makes a black dot invisible from a viewer as shown in FIG. 6B. It is to be noted that two sub-pixels 13W to be corrected are sub-pixels that emit color light (white light) derived from the additive color mixing.

Figure 36:
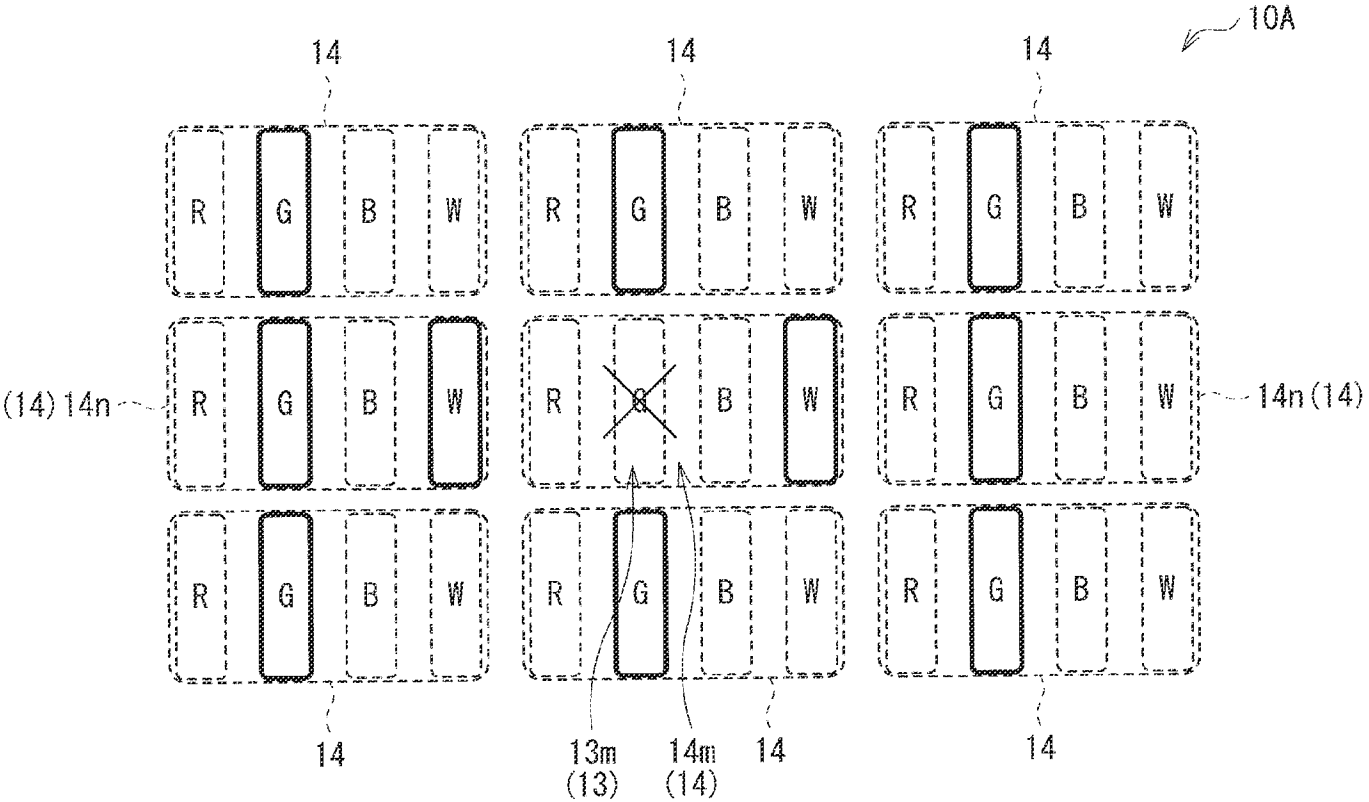
FIG. 36 is a schematic diagram showing as an example how a defect dot correction is carried out when a green display is performed in a region including a defect dot.

When a position of a defect dot that is indicated by the correction signal 26A is present within a region corresponding to a green display area, as shown in an example in FIG. 36, the image signal processing circuit 22 performs a correction for the image signal 20A corresponding to two sub-pixels 13W that interpose the defect dot sub-pixel 13*m* therebetween in a row direction to ensure that such two sub-pixels 13W light up at luminance for correcting a defect dot. In concrete terms, when a position of a defect dot that is indicated by the correction signal 26A is present within a region corresponding to a green display area, for example, the image signal processing circuit 22 performs a correction for the image signal 20A corresponding to two sub-pixels 13W that interpose the defect dot sub-pixel 13*m* therebetween in a row direction to ensure that total luminance of such two sub-pixels 13W attains a magnitude for correcting a defect dot. It is to be noted that the white light is color light derived from the additive color mixing of every light of three primary colors, and thus a defect dot is corrected using the white light emitted from a surround area of the defect dot sub-pixel 13*m*.

Figure 37:
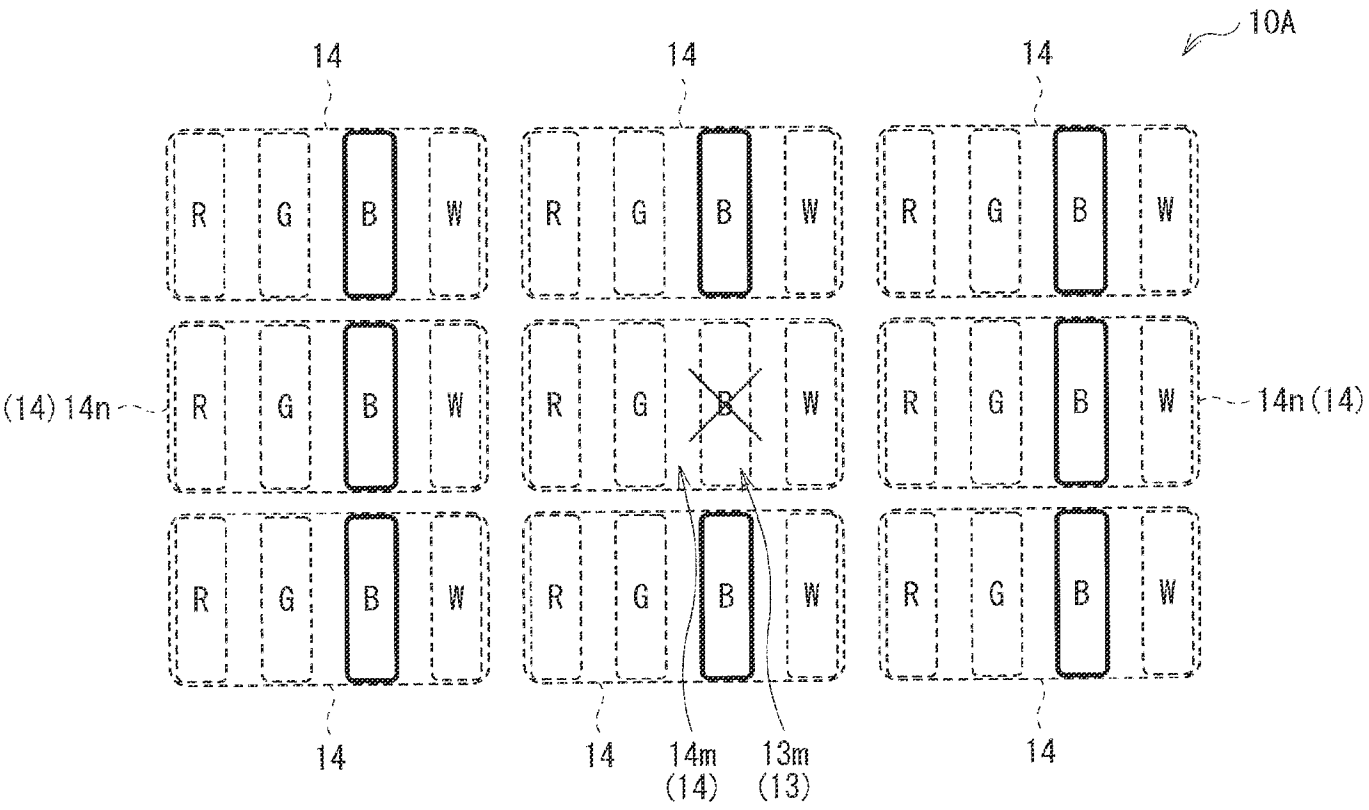
FIG. 37 is a schematic diagram showing how a blue display is performed in a region including a defect dot.

FIG. 37 schematically shows a state where each of the sub-pixels 13B is luminescent at a display region including a defect dot when the defect dot is present, and the display region becomes a blue display area. When a defect dot as shown in FIG. 37 occurs, a viewer sees a black dot as shown in FIG. 6A as a defect dot. At this time, upon reception of the correction signal 26A indicating positional information of a defect dot from the defect dot detection circuit 26, as shown in an example in FIG. 38, the image signal processing circuit 22 performs a correction for a defect dot for the image signal 20A corresponding to: the sub-pixel 13W included in the defect dot pixel 14*m*; and the sub-pixel 13W included in one display pixel 14 (adjacent pixel 14*n*) that is adjacent to the defect dot sub-pixel 13*m* in a row direction. Correction for a defect dot makes a black dot invisible from a viewer as shown in FIG. 6B. It is to be noted that two sub-pixels 13W to be corrected are sub-pixels that emit color light (white light) derived from the additive color mixing.

Figure 38:
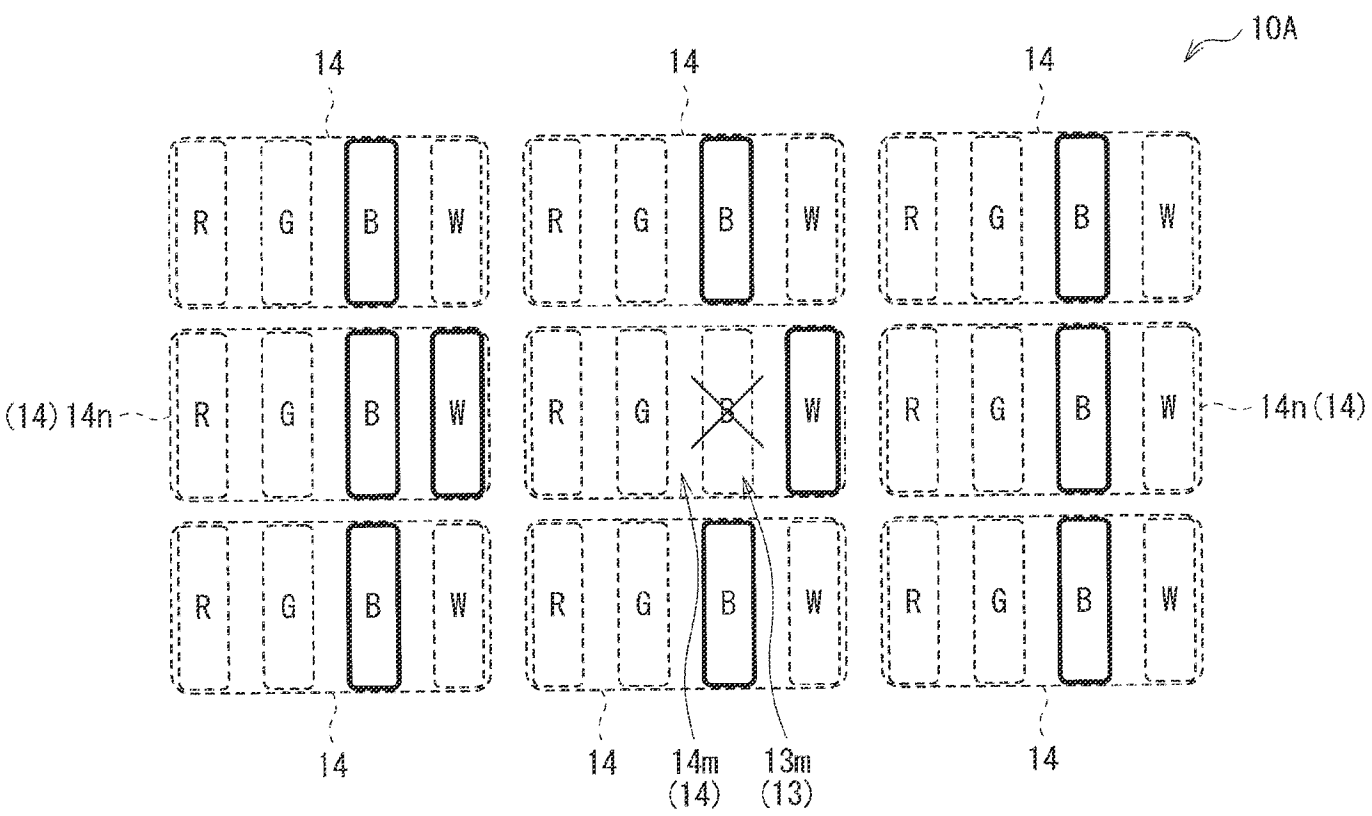
FIG. 38 is a schematic diagram showing as an example how a defect dot correction is carried out when a blue display is performed in a region including a defect dot.

When a position of a defect dot that is indicated by the correction signal 26A is present within a region corresponding to a blue display area, as shown in an example in FIG. 38, the image signal processing circuit 22 performs a correction for the image signal 20A corresponding to two sub-pixels 13W that interpose the defect dot sub-pixel 13*m* therebetween in a row direction to ensure that such two sub-pixels 13W light up at luminance for correcting a defect dot. In concrete terms, when a position of a defect dot that is indicated by the correction signal 26A is present within a region corresponding to a blue display area, for example, the image signal processing circuit 22 performs a correction for the image signal 20A corresponding to two sub-pixels 13W that interpose the defect dot sub-pixel 13*m* therebetween in a row direction to ensure that total luminance of such two sub-pixels 13W attains a magnitude for correcting a defect dot. It is to be noted that the white light is color light derived from the additive color mixing of every light of three primary colors, and thus a defect dot is corrected using the white light emitted from a surround area of the defect dot sub-pixel 13*m*.

[Advantageous Effects]

Next, the description is provided on advantageous effects of the display unit 2 according to this modification example. In this modification example, four types of sub-pixels 13 (13R, 13G, 13B, and 13W) that are different from one another in luminescent colors are provided for each of the display pixels 14. When there exists the sub-pixel 13 of a defect dot, this allows a defect dot to be made less visible by applying a compensated pulse for correcting a defect dot to the plurality of sub-pixels 13 that are adjacent or close to that sub-pixel 13 of a defect dot in a row direction. That is, in this modification example, the necessity of modifying the pixel circuit 12 from the existing configuration is eliminated, and a disadvantage that the luminance around a defect dot is only modulated to make a defect dot highly visible as an opposite effect is also avoided. This makes it possible to perform correction for a defect dot without complicating the pixel circuit 12.

[Second Modification Example]

Figure 39:
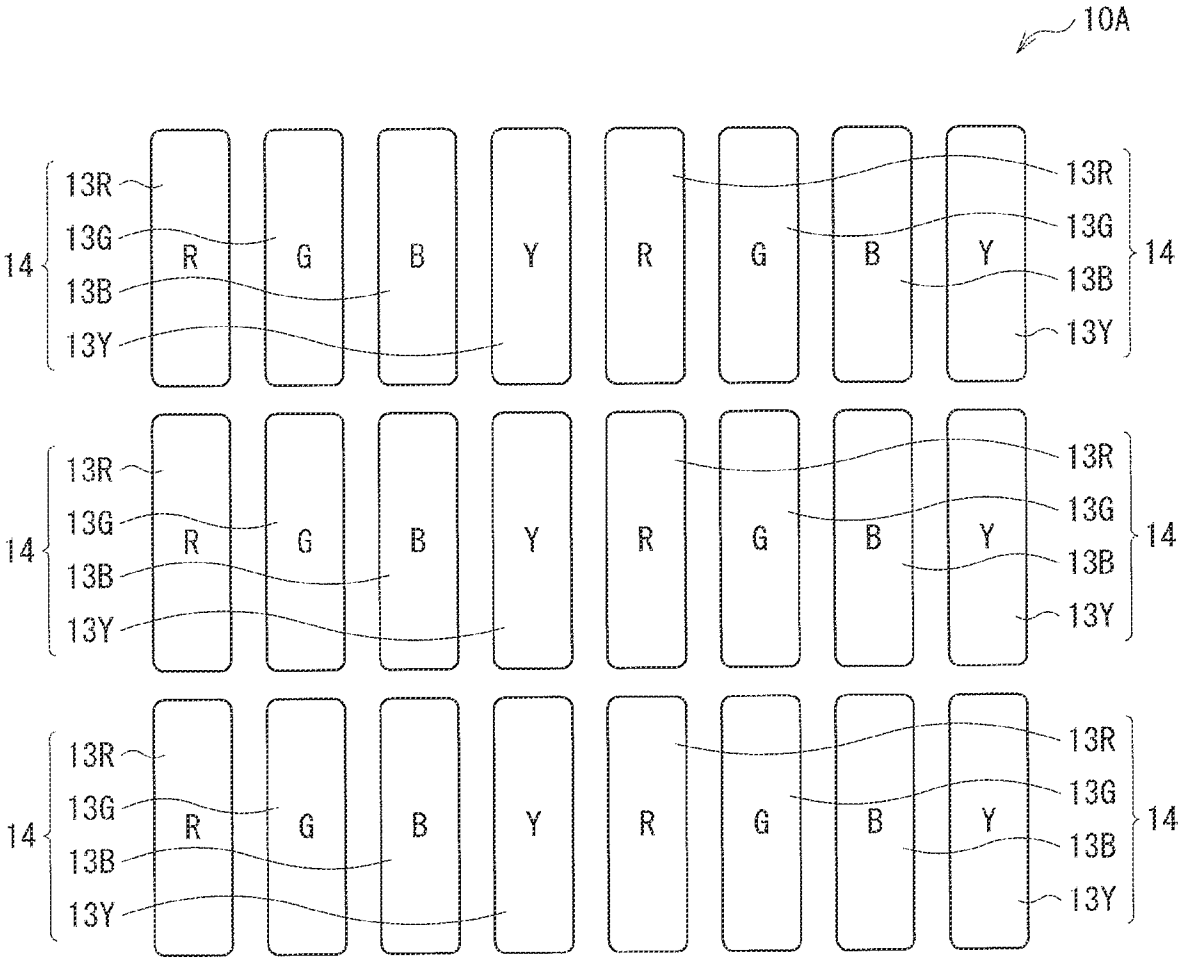
FIG. 39 is a diagram showing a modification example of layout for the sub-pixel illustrated in FIG. 20.

In the second embodiment of the present disclosure, the plurality of display pixels 14 included in the display panel 10 are arranged in a tiled array, although may be arranged in any other forms. As shown in an example in FIG. 39, the plurality of display pixels 14 may be arranged two-dimensionally in a row direction and a column direction, and the plurality of sub-pixels 13 may be arranged in a row direction in each of the display pixels 14. In other words, the plurality of sub-pixels 13 included in the display panel 10 may be arrayed in a stripe arrangement.

(Method of Correcting Defect Dot)

Next, the description is provided on a method of correcting a defect dot using the correction signal 26A. Upon reception of the correction signal 26A indicating positional information of a defect dot from the defect dot detection circuit 26 (that is, when the sub-pixel 13 of a defect dot is present), the image signal processing circuit 22 performs a correction for compensating a defect dot for the image signal 20A corresponding to the plurality of sub-pixels 13 that interpose the sub-pixel 13 of a defect dot therebetween in a row direction. For example, upon reception of the correction signal 26A indicating that a defect dot is present within a monochromatic display region from the defect dot detection circuit 26 in carrying out a monochromatic display using the plurality of sub-pixels 13 at a certain region, the image signal processing circuit 22 performs a correction for compensating a defect dot for the image signal 20A corresponding to the plurality of sub-pixels 13 that are adjacent or close to the sub-pixel 13 of a defect dot in a row direction. The data line driving circuit 23 applies the analog signal voltage 23A (pulse) corresponding to the image signal 22A, that is input from the image signal processing circuit 22 and is compensated for correcting a defect dot, to the plurality of sub-pixels 13 that are adjacent or close to the sub-pixel 13 of a defect dot in a row direction.

More specifically, upon reception of the correction signal 26A indicating positional information of a defect dot from the defect dot detection circuit 26, the image signal processing circuit 22 performs a correction for the image signal 20A corresponding to the sub-pixels 13 being corrected, to ensure that the total luminance of the plurality of sub-pixels 13 (sub-pixels 13 being corrected) which are adjacent or close to the sub-pixel 13 of a defect dot in a row direction and to which compensated pulses for correcting a defect dot are applied attains a magnitude for correcting a defect dot. For example, upon reception of the correction signal 26A indicating that a defect dot is present within a monochromatic display region from the defect dot detection circuit 26 in carrying out a monochromatic display using the plurality of sub-pixels 13 at a certain region, the image signal processing circuit 22 performs a correction for the image signal 20A corresponding to the sub-pixels 13 being corrected, to ensure that the total luminance of the plurality of sub-pixels 13 (sub-pixels 13 being corrected) which are adjacent or close to the sub-pixel 13 of a defect dot in a row direction and to which compensated pulses for correcting a defect dot are applied attains a magnitude for correcting a defect dot. Hereupon, it is preferable that a "magnitude for correcting a defect dot" be a magnitude same or almost same as the luminescence supposed to be obtained by the sub-pixel 13 of a defect dot at the time when this sub-pixel 13 is capable of emitting light.

Figure 40:
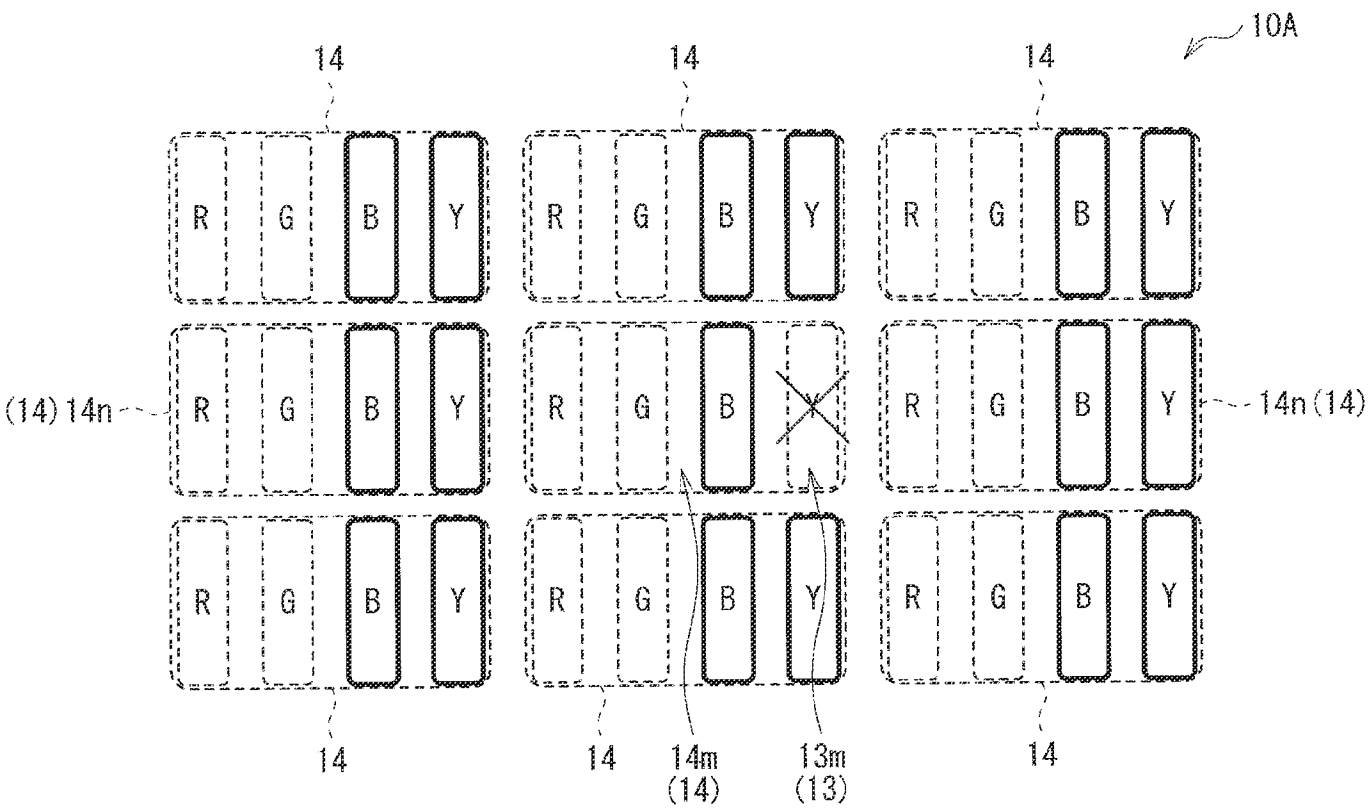
FIG. 40 is a schematic diagram showing how a white display is performed in a region including a defect dot.

FIG. 40 schematically shows a state where each of the sub-pixels 13B and the sub-pixels Y is luminescent at a display region including a defect dot when the defect dot is present, and the display region becomes a white display area. When a defect dot as shown in FIG. 40 occurs, a viewer sees a black dot as shown in FIG. 6A as a defect dot. At this time, upon reception of the correction signal 26A indicating positional information of a defect dot from the defect dot detection circuit 26, as shown in an example in FIG. 41, the image signal processing circuit 22 performs a correction for a defect dot for the image signal 20A corresponding to: the sub-pixels 13 included in the display pixel 14 (defect dot pixel 14*m*) containing the sub-pixel 13 (defect dot sub-pixel 13*m*) corresponding to the positional information; and the sub-pixels 13 included in the display pixel 14 (adjacent pixel 14*n*) that is adjacent or close to the defect dot sub-pixel 13*m* in a row direction. Correction for a defect dot makes a black dot invisible from a viewer as shown in FIG. 6B.

Figure 41:
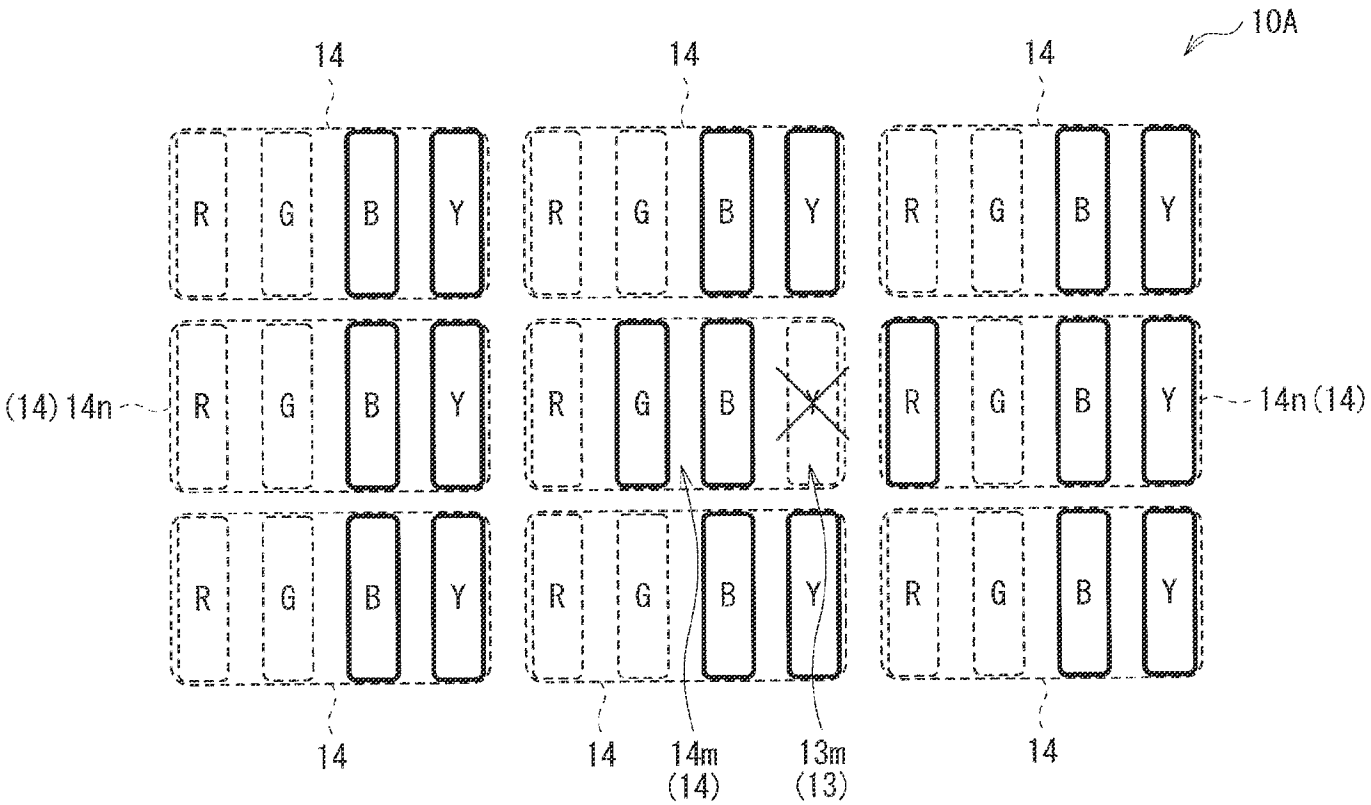
FIG. 41 is a schematic diagram showing as an example how a defect dot correction is carried out when a white display is performed in a region including a defect dot.

When a position of a defect dot that is indicated by the correction signal 26A is present within a region corresponding to a white display area, as shown in an example in FIG. 41, the image signal processing circuit 22 performs a correction for the image signal 20A corresponding to two sub-pixels 13 that interpose the defect dot sub-pixel 13*m* therebetween in a row direction to ensure that such two sub-pixels 13 light up at luminance for correcting a defect dot. In concrete terms, when a position of a defect dot that is indicated by the correction signal 26A is present within a region corresponding to a white display area, as shown in an example in FIG. 41, the image signal processing circuit 22 performs a correction for the image signal 20A corresponding to two sub-pixels 13 that interpose the defect dot sub-pixel 13*m* therebetween in a row direction to ensure that total luminance of such two sub-pixels 13 attains a magnitude for correcting a defect dot.

Meanwhile, two sub-pixels 13 to be corrected are composed of the sub-pixels 13R and 13G that individually emit color light (red and green) included in the light of three primary colors, and more specifically, are composed of one sub-pixel 13R and one sub-pixel 13G. From a surrounding area of the defect dot sub-pixel 13*m*, therefore, color light (that is, yellow light) is generated that is derived by the additive color mixing of light emitted from two sub-pixels 13 as described above. As a result, a defect dot is corrected using the yellow light emitted from a surrounding area of the defect dot sub-pixel 13*m*.

Figure 42:
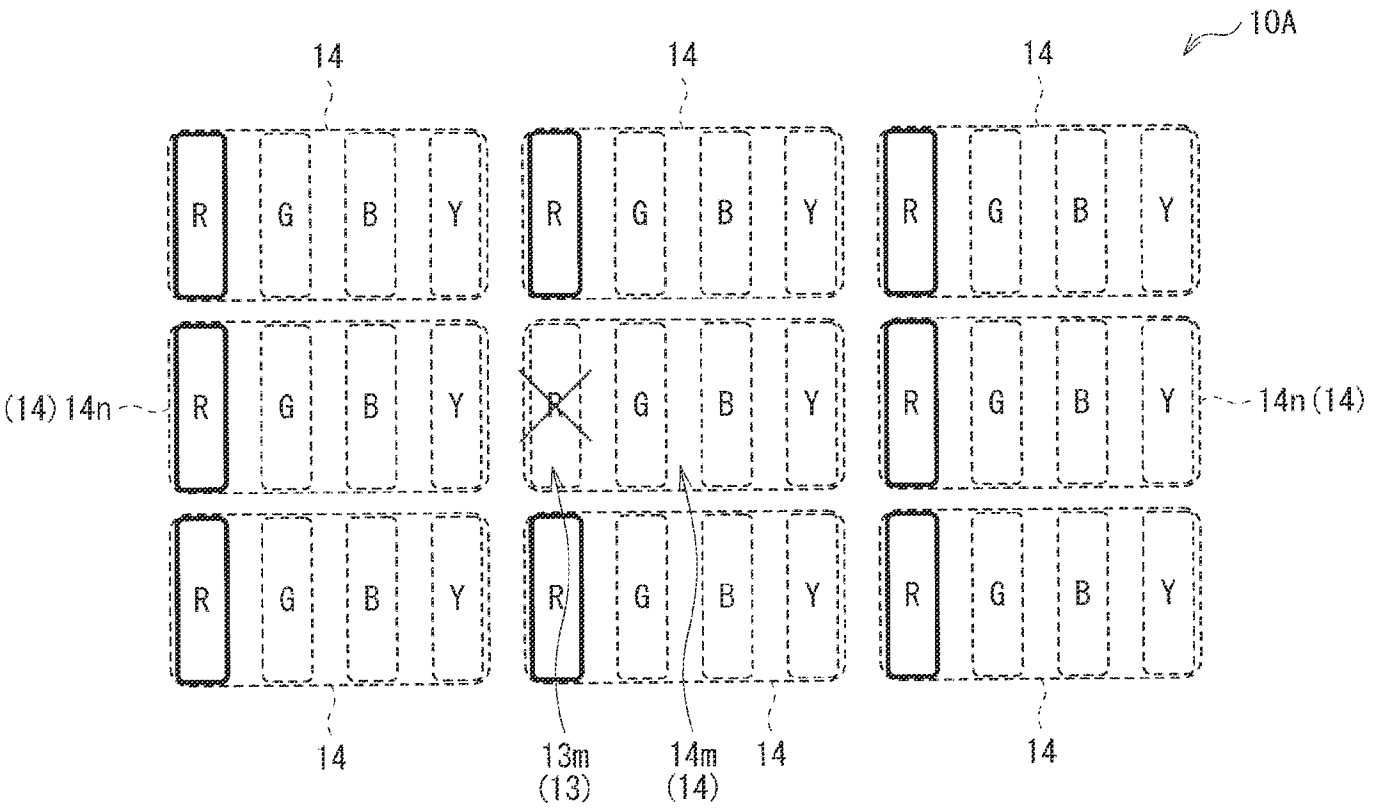
FIG. 42 is a schematic diagram showing how a red display is performed in a region including a defect dot.

FIG. 42 schematically shows a state where each of the sub-pixels 13R is luminescent at a display region including a defect dot when the defect dot is present, and the display region becomes a red display area. When a defect dot as shown in FIG. 42 occurs, a viewer sees a black dot as shown in FIG. 6A as a defect dot. At this time, upon reception of the correction signal 26A indicating positional information of a defect dot from the defect dot detection circuit 26, as shown in an example in FIG. 43, the image signal processing circuit 22 performs a correction for a defect dot for the image signal 20A corresponding to: the sub-pixel 13Y included in the defect dot pixel 14*m*; and the sub-pixel 13Y included in one display pixel 14 (adjacent pixel 14*n*) that is adjacent to the defect dot sub-pixel 13*m* in a row direction. Correction for a defect dot makes a black dot invisible from a viewer as shown in FIG. 6B. It is to be noted that two sub-pixels 13Y to be corrected are sub-pixels that emit color light (yellow light) derived from the additive color mixing.

Figure 43:
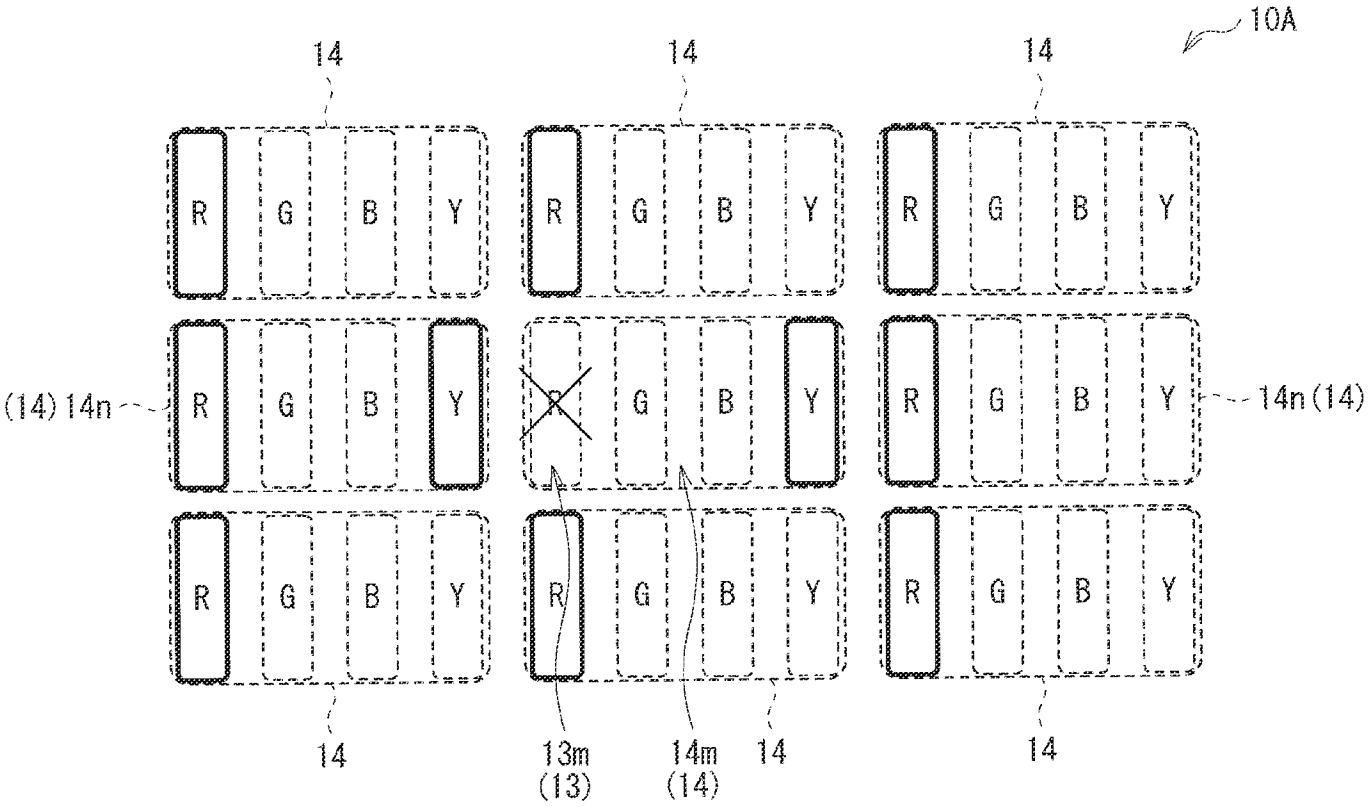
FIG. 43 is a schematic diagram showing as an example how a defect dot correction is carried out when a red display is performed in a region including a defect dot.

When a position of a defect dot that is indicated by the correction signal 26A is present within a region corresponding to a red display area, as shown in an example in FIG. 43, the image signal processing circuit 22 performs a correction for the image signal 20A corresponding to two sub-pixels 13Y that interpose the defect dot sub-pixel 13*m* therebetween in a row direction to ensure that such two sub-pixels 13Y light up at luminance for correcting a defect dot. In concrete terms, when a position of a defect dot that is indicated by the correction signal 26A is present within a region corresponding to a red display area, for example, the image signal processing circuit 22 performs a correction for the image signal 20A corresponding to two sub-pixels 13Y that interpose the defect dot sub-pixel 13*m* therebetween in a row direction to ensure that total luminance of such two sub-pixels 13Y attains a magnitude for correcting a defect dot. It is to be noted that the yellow light is color light derived from the additive color mixing of red light and green light among light of three primary colors, and thus a defect dot is corrected using the yellow light emitted from a surround area of the defect dot sub-pixel 13*m*.

Figure 44:
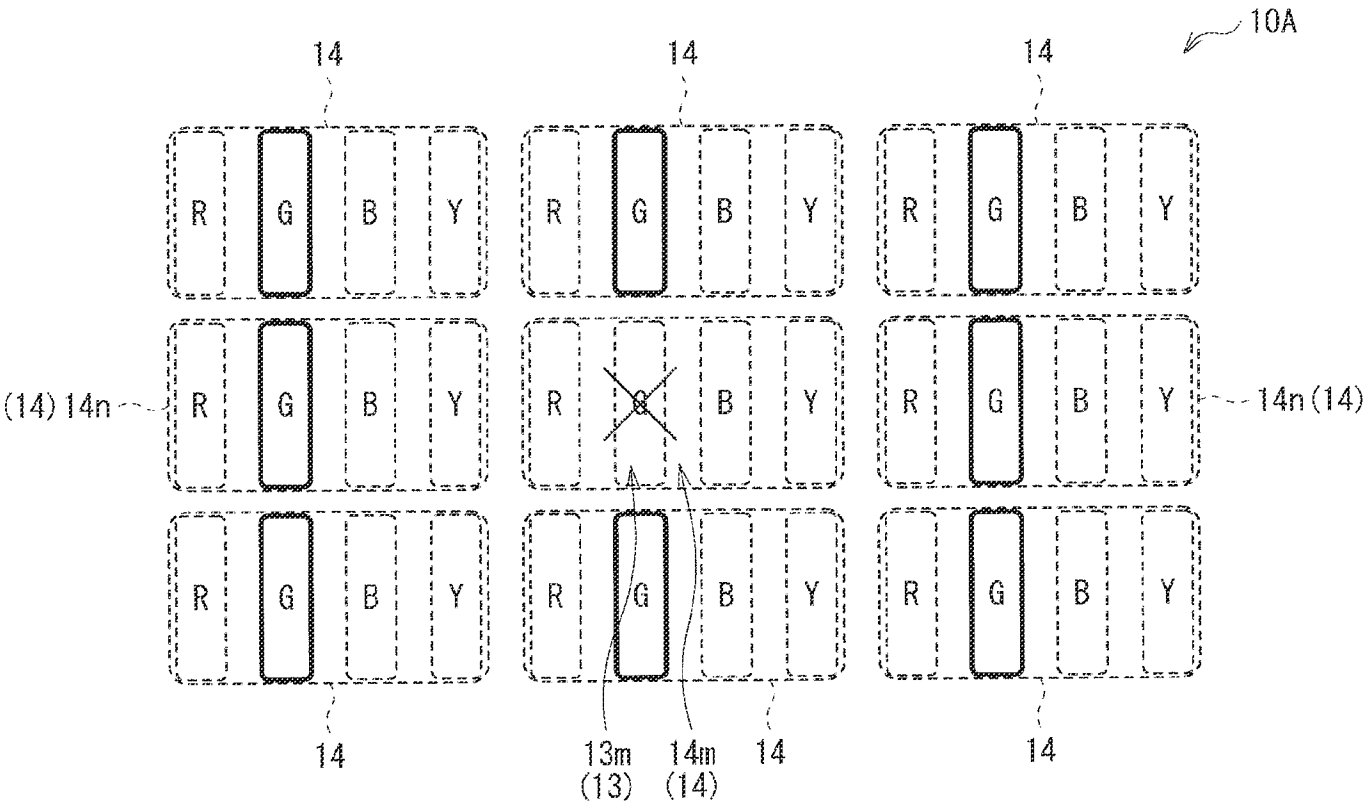
FIG. 44 is a schematic diagram showing how a green display is performed in a region including a defect dot.

FIG. 44 schematically shows a state where each of the sub-pixels 13G is luminescent at a display region including a defect dot when the defect dot is present, and the display region becomes a green display area. When a defect dot as shown in FIG. 44 occurs, a viewer sees a black dot as shown in FIG. 6A as a defect dot. At this time, upon reception of the correction signal 26A indicating positional information of a defect dot from the defect dot detection circuit 26, as shown in an example in FIG. 45, the image signal processing circuit 22 performs a correction for a defect dot for the image signal 20A corresponding to: the sub-pixel 13Y included in the defect dot pixel 14*m*; and the sub-pixel 13Y included in one display pixel 14 (adjacent pixel 14*n*) that is adjacent to the defect dot sub-pixel 13*m* in a row direction. Correction for a defect dot makes a black dot invisible from a viewer as shown in FIG. 6B. It is to be noted that two sub-pixels 13Y to be corrected are sub-pixels that emit color light (yellow light) derived from the additive color mixing.

Figure 45:
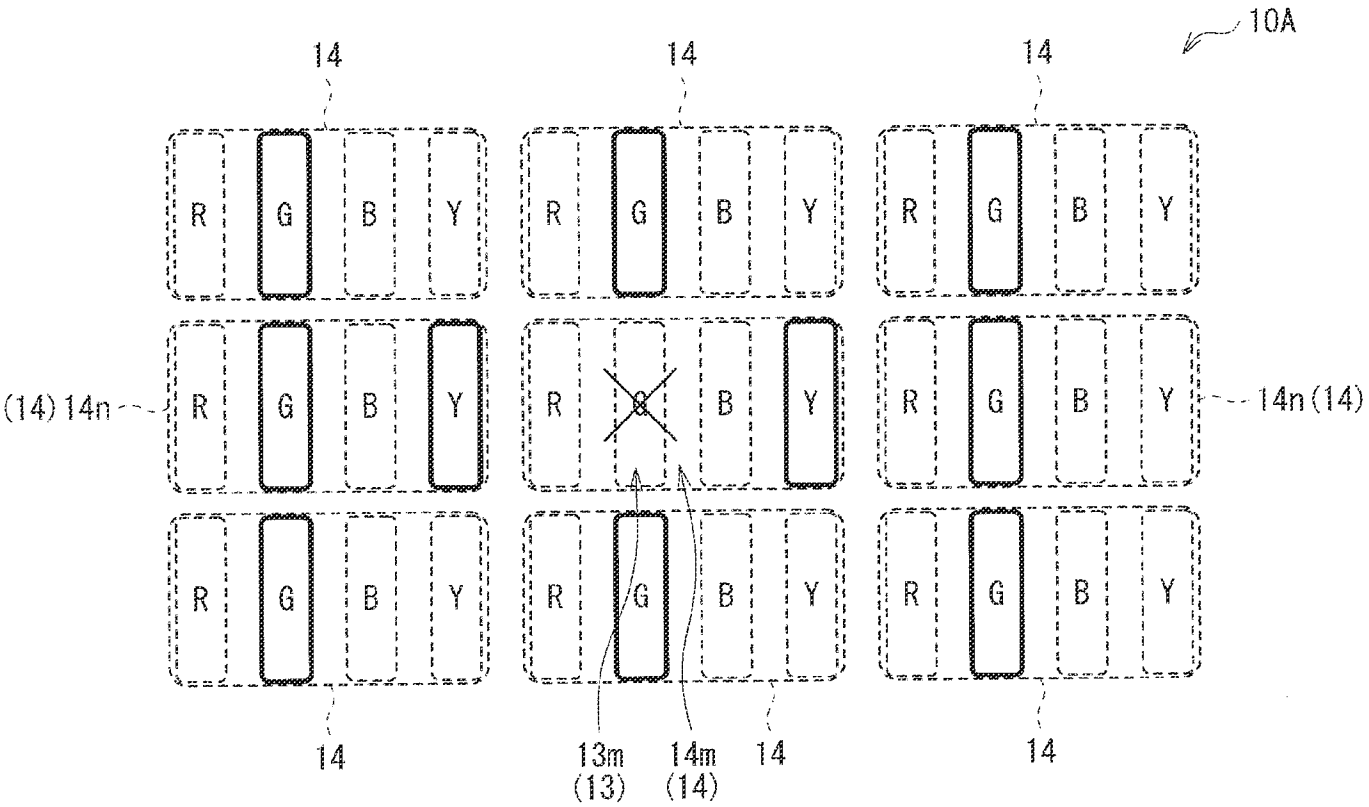
FIG. 45 is a schematic diagram showing as an example how a defect dot correction is carried out when a green display is performed in a region including a defect dot.

When a position of a defect dot that is indicated by the correction signal 26A is present within a region corresponding to a green display area, as shown in an example in FIG. 45, the image signal processing circuit 22 performs a correction for the image signal 20A corresponding to two sub-pixels 13Y that interpose the defect dot sub-pixel 13*m* therebetween in a row direction to ensure that such two sub-pixels 13Y light up at luminance for correcting a defect dot. In concrete terms, when a position of a defect dot that is indicated by the correction signal 26A is present within a region corresponding to a green display area, for example, the image signal processing circuit 22 performs a correction for the image signal 20A corresponding to two sub-pixels 13Y that interpose the defect dot sub-pixel 13*m* therebetween in a row direction to ensure that total luminance of such two sub-pixels 13Y attains a magnitude for correcting a defect dot. It is to be noted that the yellow light is color light derived from the additive color mixing of red light and green light among light of three primary colors, and thus a defect dot is corrected using the yellow light emitted from a surround area of the defect dot sub-pixel 13*m*.

[Advantageous Effects]

Next, the description is provided on advantageous effects of the display unit 2 according to this modification example. In this modification example, four types of sub-pixels 13 (13R, 13G, 13B, and 13Y) that are different from one another in luminescent colors are provided for each of the display pixels 14. When there exists the sub-pixel 13 of a defect dot, this allows a defect dot to be made less visible by applying a compensated pulse for correcting a defect dot to the plurality of sub-pixels 13 that are adjacent or close to that sub-pixel 13 of a defect dot in a row direction. That is, in this modification example, the necessity of modifying the pixel circuit 12 from the existing configuration is eliminated, and a disadvantage that the luminance around a defect dot is only modulated to make a defect dot highly visible as an opposite effect is also avoided. This makes it possible to perform correction for a defect dot without complicating the pixel circuit 12.

[Third Modification Example]

Figure 46:
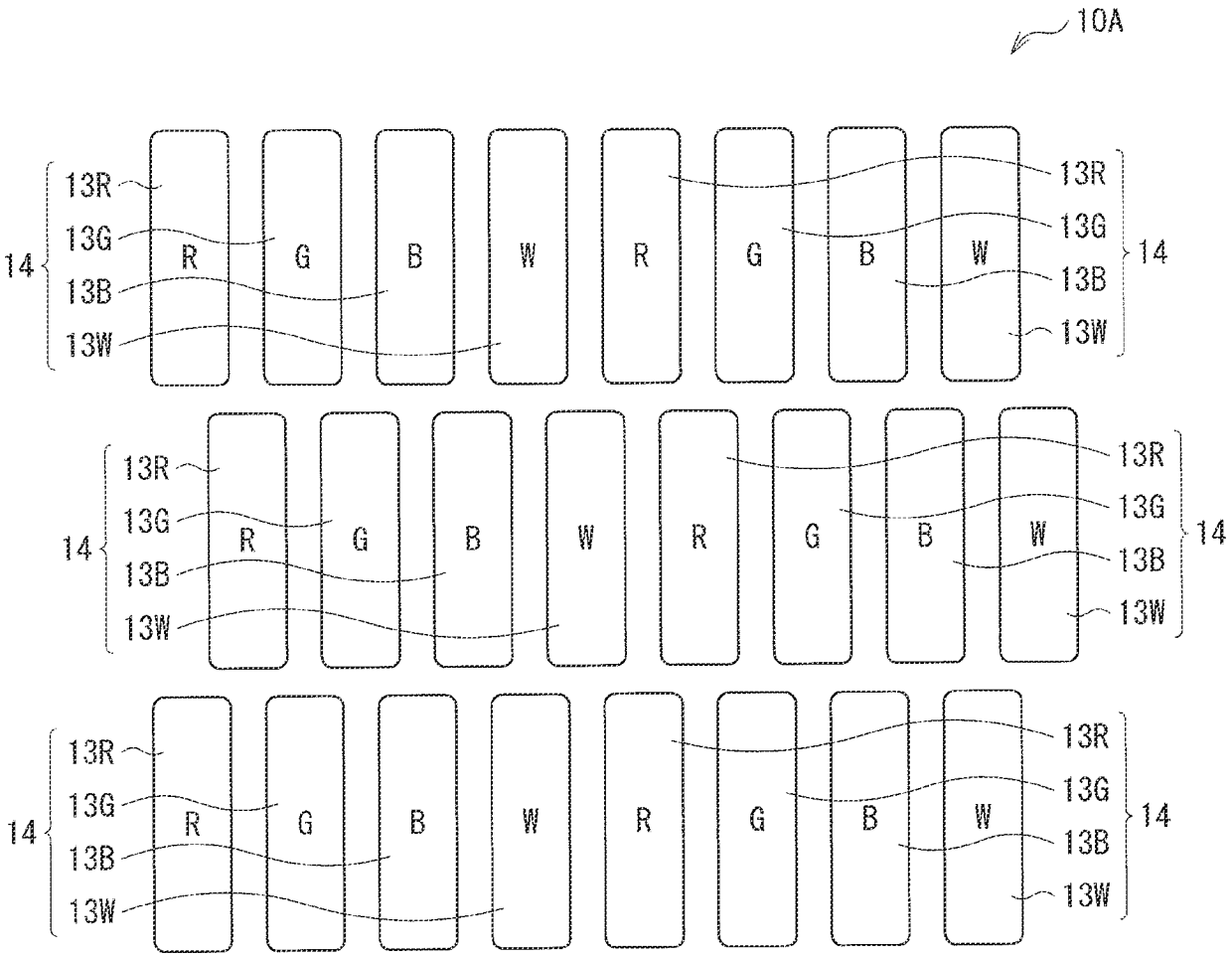
FIG. 46 is a diagram showing another modification example of layout for the sub-pixel illustrated in FIG. 1.
Figure 47:
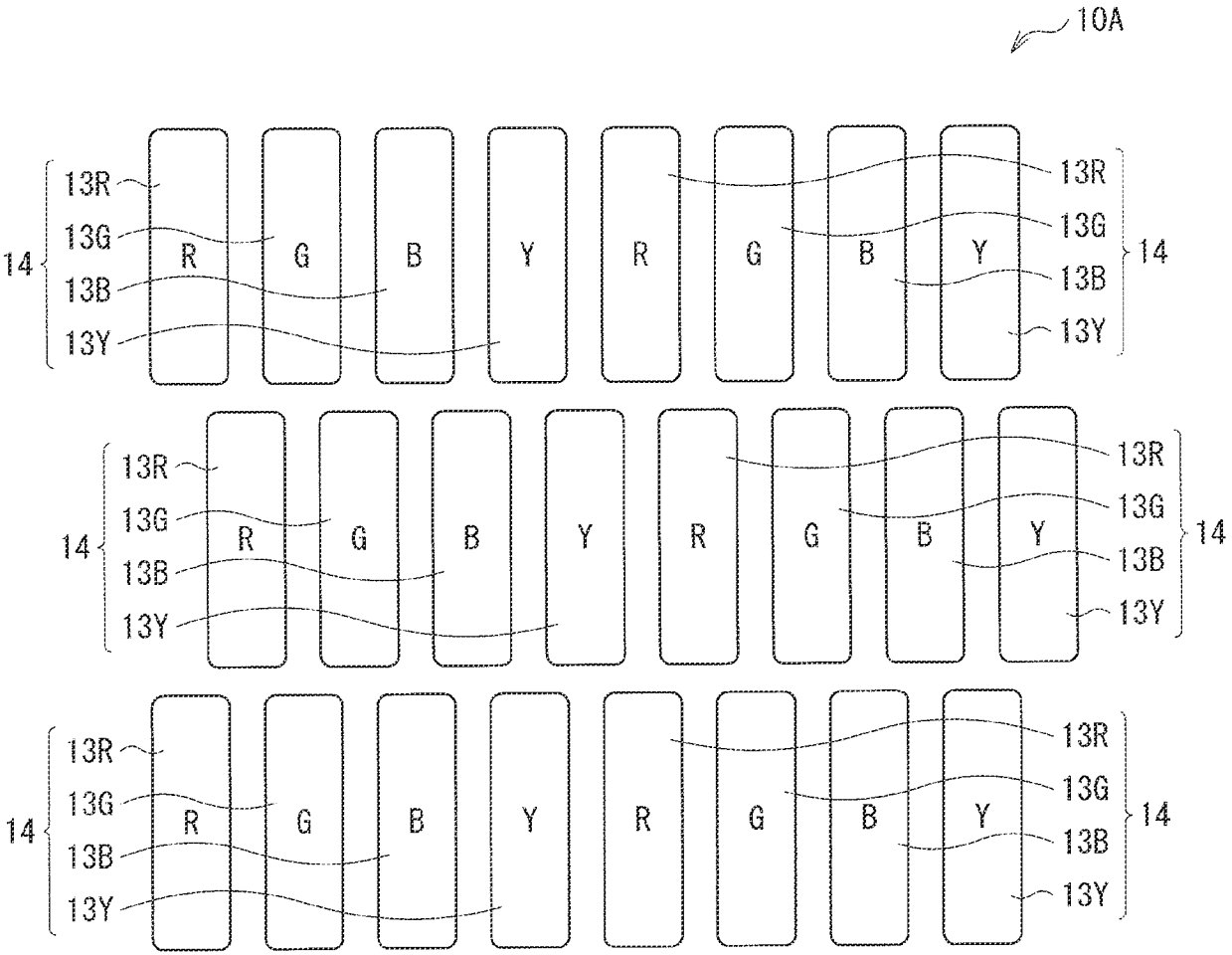
FIG. 47 is a diagram showing another modification example of layout for the sub-pixel illustrated in FIG. 19.

In the first modification and the second modification, the plurality of display pixels 14 included in the display panel 10 are arrayed in the stripe arrangement, although may be arrayed in a delta arrangement as shown in FIG. 46 and FIG. 47.

FIG. 48 summarizes various embodiments and modification examples as described above.

4. Module and Application Examples

Hereinafter, the description is provided on application examples of the display units 1 and 2 that are described in the above-mentioned embodiments of the present disclosure and modification examples thereof. The display units 1 and 2 are applicable to display units on electronic apparatuses in every field that display externally-input image signals or internally-generated image signals as images or video pictures, such as, but not limited to, a television receiver, a digital camera, a notebook personal computer, a mobile terminal including a cellular phone, and a video camera.

[Module]

Figure 49:
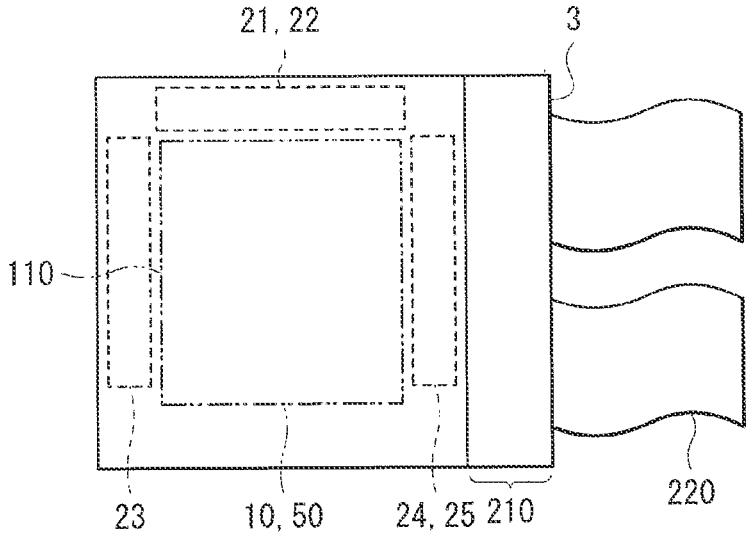
FIG. 49 is a top view showing a schematic structure of a module including the display unit according to any of the above-described embodiments of the present disclosure.

The display units 1 and 2 may be built into various electronic apparatuses in application examples 1 to 5 to be hereinafter described as a module shown in FIG. 49 for example. For example, this module has a region 210 exposed from a sealing substrate for sealing the display panel 10 at one side of a substrate, extending wiring of the timing generation circuit 21, the image signal processing circuit 22, the data line driving circuit 23, the gate line driving circuit 24, and the drain line driving circuit 25 to form external connection terminals (not shown in the figure) at this exposed region 210. An FPC (Flexible Printed Circuit) 220 for signal input/output may be provided for the external connection terminals.

[Application Example 1]

Figure 50:
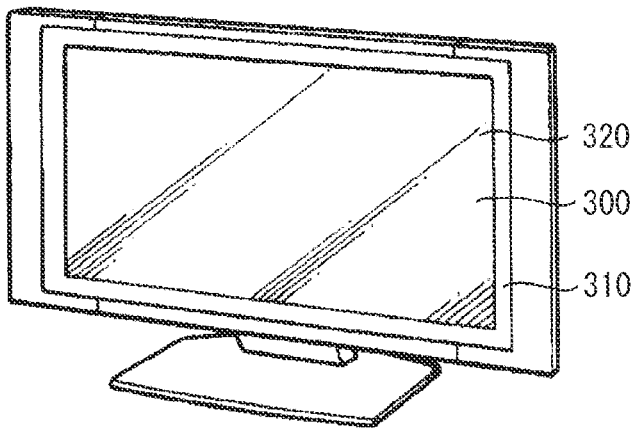
FIG. 50 is a perspective view showing an external appearance of an application example 1 for the display unit according to any of the above-described embodiments of the present disclosure.

FIG. 50 shows an external view of a television receiver to which the display units 1 and 2 are applicable. This television receiver has, for example, an image display screen section 300 including a front panel 310 and a filter glass 320, and the image display screen section 300 is composed of any of the display units 1 and 2.

[Application Example 2]

Figure 51A:
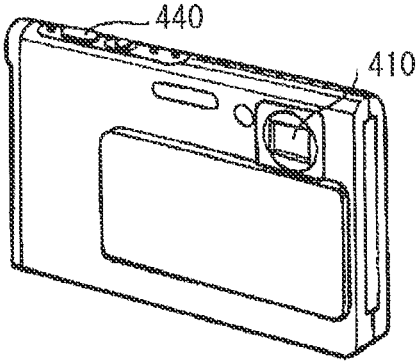
Figure 51B:
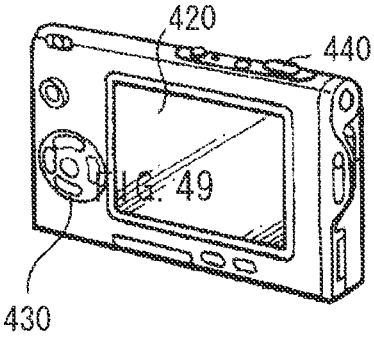
FIG. 51B is a perspective view showing an external appearance that is viewed from the rear side.

FIGS. 51A and 51B each show an external view of a digital camera to which the display units 1 and 2 are applicable. This digital camera has, for example, a light emitting section 410 for flashing, a display section 420, a menu switch 430, and a shutter button 440, and the display section 420 is composed of any of the display units 1 and 2.

[Application Example 3]

Figure 52:
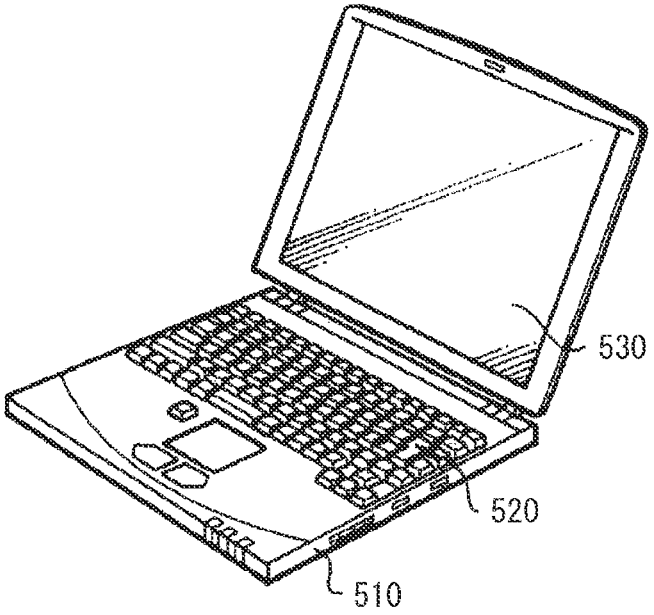
FIG. 52 is a perspective view showing an external appearance of an application example 3.

FIG. 52 shows an external view of a notebook personal computer to which the display units 1 and 2 are applicable. This notebook personal computer has, for example, a main body 510, a keyboard 520 for operation of entering characters and the like, and a display section 530 for image display, and the display section 530 is composed of any of the display units 1 and 2.

[Application Example 4]

Figure 53:
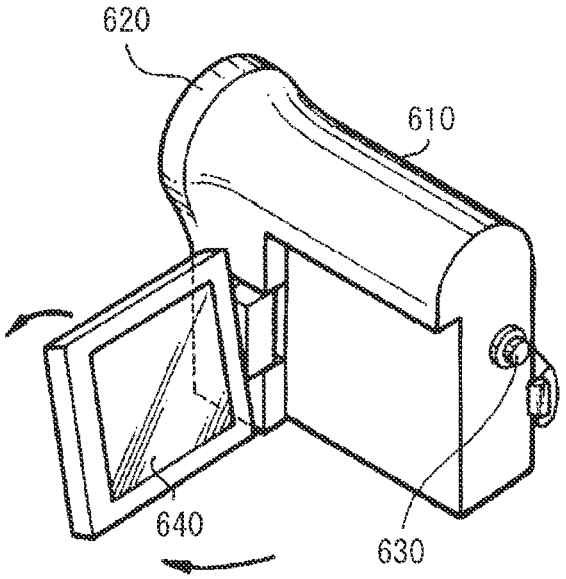
FIG. 53 is a perspective view showing an external appearance of an application example 4.
Figures 54A, 54B, 54C, 54D, 54E, 54F, 54G:
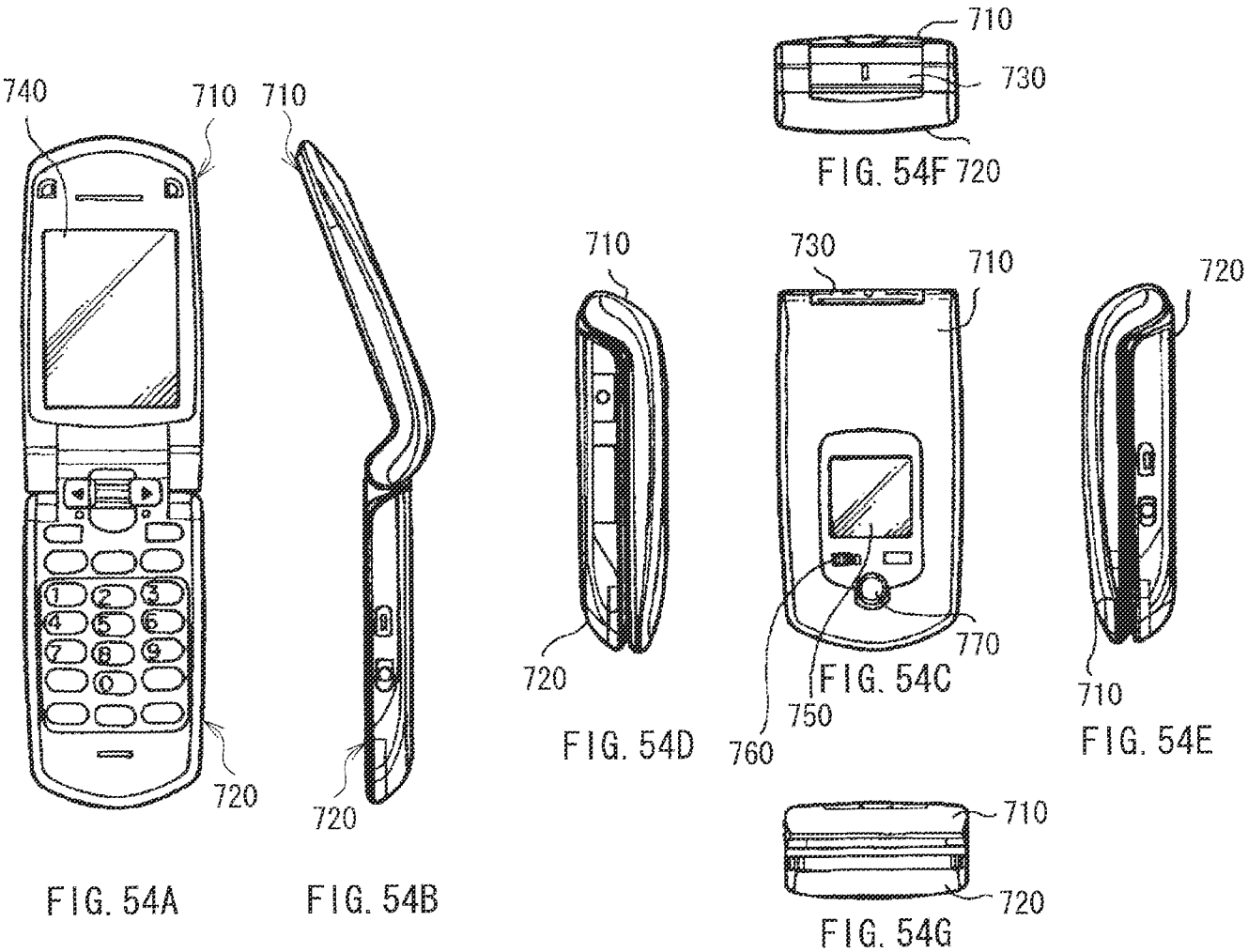
FIG. 54A is a front view of an application example 5 in an open state.
FIG. 54B is a side view thereof.
FIG. 54C is a front view in a closed state.
FIG. 54D is a left-side view.
FIG. 54E is a right-side view.
FIG. 54F is a top view.
FIG. 54G is a bottom view.

FIG. 53 shows an external view of a video camera to which the display units 1 and 2 are applicable. This video camera has, for example, a main body section 610, a lens 620 for shooting an image of a subject that is provided at the front lateral side of the main body section 610, a start/stop switch 630 for starting or stopping the shooting of the image of the subject, and a display section 640, and the display section 640 is composed of any of the display units 1 and 2.

[Application Example 5]

FIGS. 54A to 54G each show an external view of a cellular phone to which the display units 1 and 2 are applicable. For example, this cellular phone, which joins an upper chassis 710 and a lower chassis 720 with a coupling section (hinge section) 730, has a display 740, a sub-display 750, a picture light 760, and a camera 770. The display 740 or the sub-display 750 is composed of any of the display units 1 and 2.

The present technology is described with reference to the embodiments, modification examples, and application examples (hereinafter referred to as the "embodiments of the present disclosure and the like", although the present technology is not limited to the above-described embodiments of the present disclosure and the like, but different variations are available.

For example, in the above-described embodiments of the present disclosure and the like, a case where the display unit is an active matrix type is described, although a configuration of the pixel circuit 12 for active matrix drive is not limited to that described in the above-described embodiments of the present disclosure and the like, and a capacitor device and a transistor may be therefore added to the pixel circuit 12 as appropriate. In this case, in addition to the timing generation circuit 21, the image signal processing circuit 22, the data line driving circuit 23, the gate line driving circuit 24, the drain line driving circuit 25, and the defect dot detection circuit 26 that are described above, other necessary driving circuits may be added according to a change in the pixel circuit 12.

Further, in the above-described embodiments of the present disclosure and the like, a case where the driving circuit 20 performs analog driving of the display panel 10 is described, although the driving circuit 20 may perform digital driving of the display panel 10 alternatively. In this case, a gray-scale display may be carried out using the PWM. To that end, it is preferable that the image signal processing circuit 22 perform a predetermined correction for the image signal 20A, while performing the PWM for the corrected image signal to output the thus-obtained signal data (bit pulses) to the data line driving circuit 23. Further, it is preferable that, when a single corresponding scanning line is selected, each of the display pixels 11 be put in a luminescent state or a nonluminescent state depending on writing of signal data (bit pulses) provided to the corresponding data line, and thereafter continue a luminescent state or a nonluminescent state depending on writing even if the scanning line is deselected. For example, it is preferable that each of the display pixels 11 be a pixel with a built-in memory including an organic EL device.

Additionally, in the above-described embodiments of the present disclosure and the like, the timing generation circuit 21 and the image signal processing circuit 22 control driving of the data line driving circuit 23, the gate line driving circuit 24, the drain line driving circuit 25, and the defect dot detection circuit 26, although other circuits may carry out such a driving control alternatively. Further, control of the data line driving circuit 23, the gate line driving circuit 24, the drain line driving circuit 25, and the defect dot detection circuit 26 may be performed in either hardware (circuit) or software (program).

Further, in the above-described embodiments of the present disclosure and the like, the description is provided assuming that a source and a drain on the writing transistor Tws as well as a source and a drain on the driving transistor Tdr are fixed, although it goes without saying that a facing relation between a source and a drain may be often a reverse of the above description depending on a current-flowing direction.

Furthermore, in the above-described embodiments of the present disclosure and the like, the description is provided assuming that the writing transistor Tws and the driving transistor Tdr are formed of n-channel MOS type TFTs, although the writing transistor Tws or the driving transistor Tdr or both may be formed of p-channel MOS type TFTs. It is to be noted that, when the driving transistor Tdr is formed of a p-channel MOS type TFT, in the above-described embodiments of the present disclosure and the like, the anode 35A of the organic EL device 11 becomes a cathode, and the cathode 35B of the organic EL device 11 becomes an anode. Further, in the above-described embodiments of the present disclosure and the like, the writing transistor Tws and the driving transistor Tdr are not necessarily amorphous silicon type TFTs or micro-silicon type TFTs at any time, but may be alternatively low-temperature polysilicon type TFTs, for example.

Further, in the above-described embodiments of the present disclosure and the like, a case where each of the display pixels 14 has four types of sub-pixels 13 is described, although each of the display pixels 14 may have four or more types of sub-pixels 13.

Accordingly, it is possible to achieve at least the following configurations from the above-described example embodiments, the modification examples, the application examples, and the like of the disclosure.

(1) A display unit, including:

a display panel including, for each pixel, four or more types of sub-pixels that are different from one another in luminescent colors; and a driving circuit applying a pulse based on an image signal to each of the sub-pixels, and applying, when the sub-pixels include a sub-pixel of a defect dot, a compensated pulse configured to correct the defect dot to the sub-pixels that are adjacent or close to the sub-pixel of the defect dot.

(2) The display unit according to (1), wherein the compensated pulse is configured to allow a total luminance of the sub-pixels, adjacent or close to the sub-pixel of the defect dot and to which the compensated pulse is applied, to have a magnitude that corrects the defect dot.

(3) The display unit according to (2), wherein the compensated pulse is configured to allow the total luminance to be same or substantially same as a luminescence that is supposed to be obtained by the sub-pixel of the defect dot at the time when the sub-pixel of the defect dot emits light.

(4) The display unit according to any one of (1) to (3), wherein each of the pixels includes, as the four or more types of sub-pixels, three first sub-pixels and one or more second sub-pixels, the three first sub-pixels emitting light of respective three primary colors, and the one or more second sub-pixels emitting color light obtained by additive color mixing.

(5) The display unit according to (4), wherein the driving circuit applies the compensated pulse to the second sub-pixels that are adjacent or close to the sub-pixel of the defect dot, in carrying out a monochromatic display using the first sub-pixels in a region that includes the defect dot.

(6) The display unit according to (4), wherein the driving circuit applies the compensated pulse to the first sub-pixels that are adjacent or close to the sub-pixel of the defect dot, in carrying out a monochromatic display using the one or more second sub-pixels in a region that includes the defect dot.

(7) The display unit according to (4), wherein the driving circuit applies, in carrying out a monochromatic display using one of the first sub-pixels and the one or one of the second sub-pixels in a region that includes the defect dot, the compensated pulse to the first sub-pixels that are adjacent or close to the sub-pixel of the defect dot and that are unused in the monochromatic display.

(8) The display unit according to any one of (1) to (7), wherein the pixels included in the display panel are arranged two-dimensionally, and the sub-pixels are arranged two-dimensionally in each of the pixels.

(9) The display unit according to (8), wherein the sub-pixels are arranged to prevent the sub-pixels of same type among the four or more types from being placed next to each other.

(10) The display unit according to any one of (1) to (7), wherein the pixels included in the display panel are arranged two-dimensionally in a row direction and a column direction, and the sub-pixels are arranged in the row direction in each of the pixels, and the driving circuit applies, when the sub-pixels include the sub-pixel of the defect dot, the compensated pulse to the sub-pixels that interpose the sub-pixel of the defect dot therebetween in the row direction.

(11) An electronic apparatus with a display unit, the display unit including:

a display panel including, for each pixel, four or more types of sub-pixels that are different from one another in luminescent colors; and a driving circuit applying a pulse based on an image signal to each of the sub-pixels, and applying, when the sub-pixels include a sub-pixel of a defect dot, a compensated pulse configured to correct the defect dot to the sub-pixels that are adjacent or close to the sub-pixel of the defect dot.

It is to be noted that any combinations of (2) to (10) directed to the display unit are applicable to (11) directed to the electronic apparatus unless any contradictions occur. Such combinations are also considered as preferred ones of embodiments according to the technology.

The present disclosure contains subject matter related to that disclosed in Japanese Priority Patent Application JP 2011-268685 filed in the Japan Patent Office on Dec. 8, 2011, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display unit, comprising:

a display panel having a plurality of pixels, each pixel of the plurality of pixels including four or more types of sub-pixels that are different from one another in luminescent colors;

a detection circuit configured to compare detection currents with predicted currents for the sub-pixels and output positional information of a defect dot when a pre-determined relationship between a detection current and a predicted current of a given sub-pixel in the defect dot is satisfied; and a driving circuit configured to apply a pulse based on an image signal to each of the sub-pixels, and configured to apply, when the sub-pixels include the given sub-pixel of the defect dot, a compensated pulse configured to correct the defect dot to the sub-pixels that are adjacent or close to the given sub-pixel of the defect dot, wherein the compensated pulse is configured to allow a total luminance of the sub-pixels, adjacent or close to the given sub-pixel of the defect dot and to which the compensated pulse is applied, to have a magnitude that corrects the defect dot, wherein the each pixels of the plurality of pixels includes, as the four or more types of the sub-pixels, at least three first sub-pixels and one or more second sub-pixels, the at least three first sub-pixels configured to emit light of respective three primary colors, and the one or more second sub-pixels configured to emit color light obtained by additive color mixing, and wherein when the given sub-pixel of the defect dot is one of the at least three first sub-pixels, the one or more second sub-pixels that are adjacent to the one of the at least three first sub-pixels are illuminated by the compensated pulse, and when the given sub-pixel of the defect dot is one of the one or more second sub-pixels, two or more of the at least three first sub-pixels that are adjacent to the one of the one or more second sub-pixels are illuminated by the compensated pulse.

2. The display unit according to claim 1, wherein the compensated pulse is configured to allow the total luminance to be same or substantially same as a luminescence that is supposed to be obtained by the given sub-pixel of the defect dot at a time when the given sub-pixel of the defect dot emits light.

3. The display unit according to claim 1, wherein the driving circuit applies the compensated pulse to the one or more second sub-pixels that are adjacent or close to the given sub-pixel of the defect dot, in carrying out a monochromatic display using the at least three first sub-pixels in a region that includes the defect dot.

4. The display unit according to claim 1, wherein the driving circuit applies the compensated pulse to the at least three first sub-pixels that are adjacent or close to the given sub-pixel of the defect dot, in carrying out a monochromatic display using the one or more second sub-pixels in a region that includes the defect dot.

5. The display unit according to claim 1, wherein the driving circuit applies, in carrying out a monochromatic display using one of the at least three first sub-pixels and the one or one second sub-pixels in a region that includes the defect dot, the compensated pulse to the at least three first sub-pixels that are adjacent or close to the given sub-pixel of the defect dot and that are unused in the monochromatic display.

6. The display unit according to claim 1, wherein the plurality of pixels included in the display panel are arranged two-dimensionally, and the sub-pixels are arranged two-dimensionally in the each pixel of the plurality of pixels.

7. The display unit according to claim 6, wherein the sub-pixels are arranged to prevent the sub-pixels of same type among the four or more types from being placed next to each other.

8. The display unit according to claim 1, wherein the plurality of pixels included in the display panel are arranged two-dimensionally in a row direction and a column direction, and the sub-pixels are arranged in the row direction in the each pixel of the plurality of pixels, and the driving circuit applies, when the sub-pixels include the given sub-pixel of the defect dot, the compensated pulse to the sub-pixels that interpose the given sub-pixel of the defect dot therebetween in the row direction.

9. An electronic apparatus with a display unit, the display unit comprising:

a display panel having a plurality of pixels, each pixel of the plurality of pixels including four or more types of sub-pixels that are different from one another in luminescent colors;

a detection circuit configured to compare detection currents with predicted currents for the sub-pixels and output positional information of a defect dot when a pre-determined relationship between a detection current and a predicted current of a given sub-pixel in the defect dot is satisfied; and a driving circuit configured to apply a pulse based on an image signal to each of the sub-pixels, and configured to apply, when the sub-pixels include the given sub-pixel of the defect dot, a compensated pulse configured to correct the defect dot to the sub-pixels that are adjacent or close to the given sub-pixel of the defect dot, wherein the compensated pulse is configured to allow a total luminance of the sub-pixels, adjacent or close to the given sub-pixel of the defect dot and to which the compensated pulse is applied, to have a magnitude that corrects the defect dot, wherein the each pixel of the plurality of pixels includes, as the four or more types of the sub-pixels, at least three first sub-pixels and one or more second sub-pixels, the at least three first sub-pixels configured to emit light of respective three primary colors, and the one or more second sub-pixels configured to emit color light obtained by additive color mixing, when the given sub-pixel of the defect dot is one of the at least three first sub-pixels, the one or more second sub-pixels that are adjacent to the one of the at least three first sub-pixels are illuminated by the compensated pulse, and when the given sub-pixel of the defect dot is one of the one or more second sub-pixels, two or more of the at least three first sub-pixels that are adjacent to the one of the one or more second sub-pixels are illuminated by the compensated pulse.

10. The electronic apparatus according to claim 9, wherein the compensated pulse is configured to allow the total luminance to be same or substantially same as a luminescence that is supposed to be obtained by the given sub-pixel of the defect dot at a time when the given sub-pixel of the defect dot emits light.

11. The electronic apparatus according to claim 9, wherein the driving circuit applies the compensated pulse to the one or more second sub-pixels that are adjacent or close to the given sub-pixel of the defect dot, in carrying out a monochromatic display using the at least three first sub-pixels in a region that includes the defect dot.

12. The electronic apparatus according to claim 9, wherein the driving circuit applies the compensated pulse to the at least three first sub-pixels that are adjacent or close to the given sub-pixel of the defect dot, in carrying out a monochromatic display using the one or more second sub-pixels in a region that includes the defect dot.

13. The electronic apparatus according to claim 9, wherein the driving circuit applies, in carrying out a monochromatic display using one of the at least three first sub-pixels and the one or one second sub-pixels in a region that includes the defect dot, the compensated pulse to the at least three first sub-pixels that are adjacent or close to the given sub-pixel of the defect dot and that are unused in the monochromatic display.

14. The electronic apparatus according to claim 9, wherein the plurality of pixels included in the display panel are arranged two-dimensionally, and the sub-pixels are arranged two-dimensionally in the each pixel of the plurality of pixels.

15. The electronic apparatus according to claim 14, wherein the sub-pixels are arranged to prevent the sub-pixels of same type among the four or more types from being placed next to each other.

16. The electronic apparatus according to claim 9, wherein the plurality of pixels included in the display panel are arranged two-dimensionally in a row direction and a column direction, and the sub-pixels are arranged in the row direction in the each pixel of the plurality of pixels, and the driving circuit applies, when the sub-pixels include the given sub-pixel of the defect dot, the compensated pulse to the sub-pixels that interpose the given sub-pixel of the defect dot therebetween in the row direction.

* * * * *